US007449272B2

(12) United States Patent
Kawasaki et al.

(10) Patent No.: US 7,449,272 B2
(45) Date of Patent: Nov. 11, 2008

(54) ELECTROPHOTOGRAPHIC PHOTORECEPTOR AND METHOD OF PREPARING THE PHOTORECEPTOR, AND IMAGE FORMING METHOD, IMAGE FORMING APPARATUS AND PROCESS CARTRIDGE THEREFOR USING THE PHOTORECEPTOR

(75) Inventors: Yoshiaki Kawasaki, Susono (JP); Tetsuro Suzuki, Fuji (JP); Hiroshi Ikuno, Yokohama (JP); Tetsuya Toshine, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 527 days.

(21) Appl. No.: 11/272,826

(22) Filed: Nov. 15, 2005

(65) Prior Publication Data

US 2006/0110668 A1 May 25, 2006

(30) Foreign Application Priority Data

Nov. 19, 2004 (JP) ..... 2004-336341

(51) Int. Cl.
*G03G 15/04* (2006.01)

(52) U.S. Cl. ..... 430/66; 430/60; 430/130; 430/132; 430/58.05; 430/58.7

(58) Field of Classification Search ..... 430/66, 430/60, 130, 132, 58.05, 58.7
See application file for complete search history.

(56) References Cited

U.S. PATENT DOCUMENTS 5,339,138 A 8/1994 Mishima et al.
5,492,784 A 2/1996 Yoshikawa et al.
5,723,243 A 3/1998 Sasaki et al.
5,747,204 A 5/1998 Anzai et al.
5,830,980 A 11/1998 Anzai et al.
5,840,454 A 11/1998 Nagai et al.
5,853,935 A 12/1998 Suzuki et al.
5,871,876 A 2/1999 Ikuno et al.
6,018,014 A 1/2000 Nagai et al.
6,030,733 A 2/2000 Kami et al.
6,066,428 A 5/2000 Katayama et al.

(Continued)

FOREIGN PATENT DOCUMENTS

JP 56-048637 5/1981
JP 64-001728 1/1989

(Continued)

OTHER PUBLICATIONS

U.S. Appl. No. 11/939,239, filed Nov. 13, 2007, Hirose et al.

(Continued)

*Primary Examiner*—Mark A Chapman
(74) *Attorney, Agent, or Firm*—Oblon, Spivak, McClelland, Maier & Neustadt, P.C.

(57) ABSTRACT

An electrophotographic photoreceptor, including an electroconductive substrate; and a photosensitive layer overlying the electroconductive substrate, which includes a crosslinked layer at the surface thereof, wherein the crosslinked layer is formed by a method including:

coating a coating liquid, which includes a solvent; a radical polymerizing monomer having three or more functional groups and no charge transportable structure; and a radical polymerizing compound having a charge transportable structure on the photosensitive layer; and irradiating the coating liquid to be hardened while the surface of the photosensitive layer is controlled to have a temperature not higher than a boiling point of the solvent.

18 Claims, 3 Drawing Sheets

U.S. PATENT DOCUMENTS

| | | | | |
|---|---|---|---|---|
| 6,151,468 | A | 11/2000 | Kami et al. | |
| 6,194,535 | B1 | 2/2001 | Katayama et al. | |
| 6,210,848 | B1 | 4/2001 | Nagai et al. | |
| 6,326,112 | B1 | 12/2001 | Tamura et al. | |
| 6,521,387 | B2 | 2/2003 | Kawasaki et al. | |
| 6,558,863 | B2 | 5/2003 | Rokutanzono et al. | |
| 6,641,964 | B2 | 11/2003 | Ikuno et al. | |
| 6,790,572 | B2 | 9/2004 | Tamoto et al. | |
| 6,824,939 | B2 | 11/2004 | Kurimoto et al. | |
| 6,844,124 | B2 | 1/2005 | Ikuno et al. | |
| 6,853,823 | B2 | 2/2005 | Sugino et al. | |
| 6,853,834 | B2 | 2/2005 | Kurimoto et al. | |
| 6,858,362 | B2 | 2/2005 | Tamoto et al. | |
| 6,936,388 | B2 | 8/2005 | Suzuki et al. | |
| 7,175,957 | B2 * | 2/2007 | Suzuki et al. | 430/66 |
| 7,179,573 | B2 * | 2/2007 | Suzuki et al. | 430/66 |
| 2004/0053152 | A1 | 3/2004 | Nagai et al. | |
| 2004/0197688 | A1 | 10/2004 | Tamoto et al. | |
| 2004/0234875 | A1 | 11/2004 | Toda et al. | |
| 2004/0248024 | A1 * | 12/2004 | Suzuki et al. | 430/66 |
| 2004/0253527 | A1 * | 12/2004 | Suzuki et al. | 430/66 |
| 2005/0100804 | A1 | 5/2005 | Tamoto et al. | |
| 2005/0105942 | A1 | 5/2005 | Kurimoto et al. | |
| 2005/0141919 | A1 | 6/2005 | Kitajima et al. | |
| 2005/0158641 | A1 * | 7/2005 | Yanagawa et al. | 430/66 |
| 2005/0158644 | A1 | 7/2005 | Kondo et al. | |
| 2005/0175911 | A1 | 8/2005 | Tamoto et al. | |
| 2005/0196193 | A1 | 9/2005 | Tamoto et al. | |
| 2005/0221210 | A1 * | 10/2005 | Suzuki et al. | 430/58.15 |
| 2005/0287452 | A1 | 12/2005 | Tamura et al. | |

FOREIGN PATENT DOCUMENTS

| | | |
|---|---|---|
| JP | 04-281461 | 10/1992 |
| JP | 05-216249 | 8/1993 |
| JP | 08-262779 | 10/1996 |
| JP | 10-171135 | 6/1998 |
| JP | 2000-066425 | 3/2000 |
| JP | 2000-086665 | 3/2000 |
| JP | 2004-302451 | 10/2004 |
| JP | 2004-302452 | 10/2004 |

OTHER PUBLICATIONS

U.S. Appl. No. 11/943,713, filed Nov. 21, 2007, Ishikawa et al.
U.S. Appl. No. 12/000,239, filed Dec. 11, 2007, Fujiwara et al.
U.S. Appl. No. 11/563,710, filed Nov. 28, 2006, Inaba et al.
U.S. Appl. No. 11/616,523, filed Dec. 27, 2006, Fujiwara et al.
U.S. Appl. No. 11/621,805, filed Jan. 10, 2007, Suzuki et al.
U.S. Appl. No. 11/685,441, filed Mar. 13, 2007, Yanagawa et al.
U.S. Appl. No. 11/692,682, filed Mar. 28, 2007, Mori et al.
U.S. Appl. No. 11/736,258, filed Apr. 17, 2007, Kawasaki et al.
U.S. Appl. No. 12/035,016, filed Feb. 21, 2008, Iwamoto et al.
U.S. Appl. No. 12/047,011, filed Mar. 12, 2008, Kami et al.
U.S. Appl. No. 11/684,520, filed Mar. 9, 2007, Toshine et al.
U.S. Appl. No. 11/750,570, filed May 18, 2007, Ikuno et al.
U.S. Appl. No. 11/834,240, filed Aug. 6, 2007, Hirose et al.
U.S. Appl. No. 11/500,352, filed Aug. 8, 2006, Toshine et al.
U.S. Appl. No. 11/855,510, filed Sep. 14, 2007, Kami et al.
U.S. Appl. No. 11/136,488, filed May 25, 2005, Yanagawa et al.

* cited by examiner

ELECTROPHOTOGRAPHIC PHOTORECEPTOR AND METHOD OF PREPARING THE PHOTORECEPTOR, AND IMAGE FORMING METHOD, IMAGE FORMING APPARATUS AND PROCESS CARTRIDGE THEREFOR USING THE PHOTORECEPTOR

BACKGROUND OF THE INVENTION

1. Field of the Invention

The present invention relates to an electrophotographic photoreceptor and a method of preparing the photoreceptor, and to an image forming method, an image forming apparatus and a process cartridge therefor using the photoreceptor.

2. Discussion of the Background

Recently, organic photoreceptors (OPCs) have been widely used instead of inorganic photoreceptors for copiers, facsimiles, laser printers and their complex machines because of their good performances and advantages. Specific examples of the reasons include (1) optical properties such as a wide range of light absorbing wavelength and a large amount of absorbing light; (2) electrical properties such as high sensitivity and stable chargeability; (3) choice of the materials; (4) good manufacturability; (5) low cost; (6) non-toxicity, etc.

On the other hand, as image forming apparatuses become smaller, photoreceptors have smaller diameters recently. In addition, photoreceptors are required to have high durability as image forming apparatuses produce images at a higher speed and are free from maintenance. In this respect, the organic photoreceptor typically has a soft surface layer mainly formed from a low-molecular-weight charge transport material and an inactive polymer, and therefore the organic photoreceptor typically has a drawback of being mechanically abraded with an image developer and a cleaner with ease when repeated used in the electrophotographic process. In addition, as toner particles has smaller particle diameters due to requirements for high-quality images, cleaning blades need to have higher rubber hardness and higher contact pressure for the purpose of increasing cleanability, and which also accelerates abrading photoreceptors. Such abrasions of photoreceptors deteriorate electrical properties thereof such as sensitivities and chargeabilities, and cause abnormal images such as image density deterioration and background fouling. When a photoreceptor is locally abraded, images having black stripes due to defective cleaning are produced. At present, photoreceptors are exchanged because of these abrasions and damages.

Therefore, it is indispensable to decrease the abrasion amount of the organic photoreceptor so as to have high durability, and which is the most pressing issue to solve in this field.

As methods of improving the abrasion resistance of a photoreceptor, (1) Japanese Laid-Open Patent Publication No. 56-48637 discloses a photoreceptor using a hardening binder in its surface layer; (2) Japanese Laid-Open Patent Publication No. 64-1728 discloses a photoreceptor using charge transport polymer material; and (3) Japanese Laid-Open Patent Publication No. 4-281461 discloses a photoreceptor having a surface layer wherein an inorganic filler is dispersed.

To improve the abrasion resistance of the photoreceptor of (1), Japanese Patent No. 3262488 discloses a photoreceptor including a hardened acrylate monomer.

As an abrasion resistance technology of a photosensitive layer in place of these technologies, Japanese Patent No. 3194392 discloses a method of forming a charge transport layer using a coating liquid formed from a monomer having a carbon-carbon double bond, a charge transport material having a carbon-carbon double bond and a binder resin. The binder resin includes a binder resin having a carbon-carbon double bond and a reactivity with the charge transport material, and a binder resin having neither a carbon-carbon double bond nor a reactivity with the charge transport material.

Japanese Laid-Open Patent Publication No. 2000-66425 discloses a photosensitive layer including a hardened positive hole transport compound having two or more chain polymerizing functional groups in the same molecule.

Taking these inventions into consideration, the present inventors discovered that a surface layer formed of a crosslinked resin, wherein at least a radical polymerizing monomer having three or more functional groups not having charge transportable structure and a radical polymerizing compound having charge transportable structure are hardened, improved electrical properties and abrasion resistance of the resultant photoreceptor. However, it cannot be said that this surface layer formed of a crosslinked resin has sufficient durability, and the surfaceness largely varies depending on the crosslinking conditions, i.e., the surface concavities and convexities tend to be large. Therefore, the surface of a photoreceptor is so poorly cleaned that a cleaning blade therefor is locally chipped, resulting in abnormal striped images.

Because of these reasons, a need exists for a long-life and high-performance electrophotographic photoreceptor having high abrasion and scratch resistance, good electrical properties, and producing high-quality images for long periods.

SUMMARY OF THE INVENTION

Accordingly, one object of the present invention is to provide a long-life and high-performance electrophotographic photoreceptor having high abrasion and scratch resistance, good electrical properties, and producing high-quality images for long periods.

Another object of the present invention is to provide a method of preparing the electrophotographic photoreceptor.

A further object of the present invention is to provide an image forming method using the electrophotographic photoreceptor.

Another object of the present invention is to provide an image forming apparatus using the electrophotographic photoreceptor.

A further object of the present invention is to provide a process cartridge using the electrophotographic photoreceptor for an image forming apparatus.

These objects and other objects of the present invention, either individually or collectively, have been satisfied by the discovery of an electrophotographic photoreceptor, comprising an electroconductive substrate; and a photosensitive layer located overlying the electroconductive substrate, comprising a crosslinked layer at the surface thereof, wherein the crosslinked layer is formed by a method comprising:

coating a coating liquid comprising a solvent, a radical polymerizing monomer having three or more functional groups and no charge transportable structure, and a radical polymerizing compound having a charge transportable structure on the photosensitive layer; and irradiating the coating liquid to be hardened while the surface of the photosensitive layer is controlled to have a temperature not higher than a boiling point of the solvent.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1A:
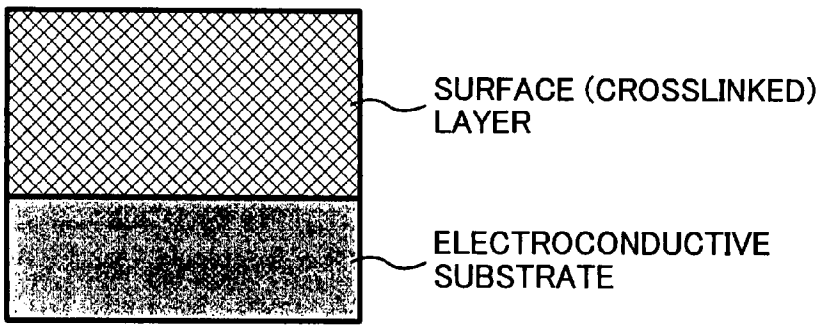
FIGS. 1A and 1B are cross-sectional views of embodiments of coated layers of the electrophotographic photoreceptor of the present invention.

The present invention provides an electrophotographic photoreceptor having high abrasion and scratch resistance, good cleanability, and producing high-quality images for long periods, comprising:

an electroconductive substrate; and a photosensitive layer located overlying the electroconductive substrate, comprising a crosslinked layer at the surface thereof, wherein the crosslinked layer is formed by a method comprising:

coating a coating liquid comprising a solvent, a radical polymerizing monomer having three or more functional groups and no charge transportable structure, and a radical polymerizing compound having a charge transportable structure on the photosensitive layer; and irradiating the coating liquid to be hardened while the surface of the photosensitive layer is controlled to have a temperature not higher than a boiling point of the solvent.

This is because the crosslinked surface layer of the present invention includes a radical polymerizing monomer having three or more functional groups, which develops a three-dimensional (3D) network, and the crosslinked surface layer is firmly crosslinked and hardened to have high abrasion resistance. Meanwhile, when only a monofunctional or a bifunctional radical polymerizing monomer is used, the crosslinkage therein becomes poor and the crosslinked surface layer does not have a noticeable abrasion resistance. When a polymer material is included therein, the development of the 3D network is impaired and the crosslinkage therein deteriorates, resulting in less abrasion resistance than that of the present invention. Further, the polymer material has poor compatibility with a hardened material produced by a reaction between the polymer material and the radical polymerizing constituents, i.e., the radical polymerizing monomer and the radical polymerizing compound having a charge transportable structure, resulting in a layer separation causing a local abrasion and a damage on the surface.

In addition to the radical polymerizing monomer having three or more functional groups, the crosslinked surface layer of the present invention includes a radical polymerizing compound having a charge transportable structure, which is included in the crosslinkage when the radical polymerizing monomer having three or more functional groups is hardened. When the crosslinked surface layer includes a low-molecular-weight charge transport material having no functional group, the low-molecular-weight charge transport material separates out and becomes clouded due to its low compatibility, and mechanical strength of the crosslinked surface layer deteriorates.

Further, the crosslinked layer of the present invention is hardened by irradiating a coating liquid comprising a solvent, a radical polymerizing monomer having three or more functional groups and a radical polymerizing compound having a charge transportable structure on the photosensitive layer while the surface of the photosensitive layer is controlled to have a temperature not higher than a boiling point of the solvent. The radical polymerizing monomer and compound produce a radical when irradiated and start polyaddition, and the radical polymerizing monomer and compound perform a chain transfer reaction, resulting in progress of the crosslinking reaction.

Typically, the temperature of the surface of the photosensitive layer rapidly increases when irradiated. When the surface temperature thereof is higher than a boiling point of the solvent included in a surface layer coating liquid, the hardening speed lowers and the crosslinked density deteriorates. The reason is not yet clarified, however, it is speculated that the solvent remaining on the surface layer rapidly decreases when the surface temperature of the photosensitive layer is higher than a boiling point thereof, which prevents the radical polymerizing monomer from being flexible, resulting in lowering of the hardening speed and the crosslinked density. Therefore, the mechanical strength lowers, and the abrasion and scratch resistance deteriorates in long-term use. In addition, when the hardening speed lowers, concavities and convexities on the surface tend to become large, resulting in poor cleanability thereof. Further, the crosslinked resin layer has a large frictional force with a cleaning blade, and the blade is occasionally reversed or occasionally makes a frictional noise. However, the radical polymerizing monomer is sufficiently flexible if the surface temperature of the photosensitive layer is controlled to be not higher than a boiling point of the solvent included in a surface layer coating liquid when irradiated. Therefore, the hardening speed and crosslinked density do not lower, resulting in improvement of the mechanical strength and smaller concavities and convexities on the surface.

Next, the constituents in the crosslinked surface layer coating liquid for use in the present invention will be explained.

The radical polymerizing monomer having three or more functional groups and no charge transportable structure for use in the present invention is a monomer which has neither a positive hole transport structure such as triarylamine, hydrazone, pyrazoline and carbazole nor an electron transport structure such as condensed polycyclic quinone, diphenoquinone, a cyano group and an electron attractive aromatic ring having a nitro group, and has three or more radical polymerizing functional groups. Any radical polymerizing functional groups can be used, provided they have a carbon-carbon double bonding and capable of radically polymerizing. Specific examples of the radical polymerizing functional groups include the following 1-substituted ethylene functional groups and 1,1-substituted ethylene functional groups.

Specific examples of the 1-substituted ethylene functional groups include functional groups having the following formula:

$$CH_2{=}CH{-}X_2{-}$$

wherein $X_2$ represents a substituted or an unsubstituted phenylene group, an arylene group such as a naphthylene group, a substituted or an unsubstituted alkenylene group, a —CO-group, a —COO-group and a —CON($R_{36}$)-group wherein $R_{36}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group.

Specific examples of the substituents include vinyl groups, styryl groups, 2-methyl-1,3-butadienyl groups, vinylcarbonyl groups, acryloyloxy groups, acryloylamide groups, vinylthioether groups, etc.

Specific examples of the 1,1-substituted ethylene functional groups include functional groups having the following formula:

$$CH_2{=}CH(Y_4){-}X_3{-} \quad (11)$$

wherein $Y_4$ represents a substituted or an unsubstituted alkyl group, a substituted or an unsubstituted aralkyl group, a substituted or an unsubstituted phenyl group, an aryl group such as a naphtyl group, a halogen atom, a cyano group, a nitro group, an alkoxy group such as a methoxy group or a ethoxy group and a —$COOR_{37}$ group wherein $R_{37}$ represents a hydrogen atom, a substituted or an unsubstituted methyl group, an alkyl group such as an ethyl group, a substituted or an unsubstituted benzyl group, an aralkyl group such as a phenethyl group, a substituted or an unsubstituted phenyl group and an aryl group such as a naphtyl group, or a —$CONR_{38}R_{39}$ wherein $R_{38}$ and $R_{39}$ independently represent a hydrogen atom, a substituted or an unsubstituted methyl group, an alkyl group such as an ethyl group, a substituted or an unsubstituted benzyl group, a naphthylmethyl group, an aralkyl group such as a phenethyl group, a substituted or an unsubstituted phenyl group and an aryl group such as a naphtyl group; $X_3$ represents a substituted or an unsubstituted phenylene group, an arylene group such as a naphthylene group, a substituted or an unsubstituted alkenylene group, a —CO-group, a —COO-group, a —CON($R_{36}$)-group wherein $R_{36}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group; and at least either $Y_4$ or $X_3$ is an oxycarbonyl group, a cyano group, an alkenylene group and an aromatic ring.

Specific examples of the substituents include α-acryloyloxy chloride groups, methacryloyloxy groups, α-cyanoethylene groups, α-cyanoacryloyloxy groups, α-cyanophenylene groups, methacryloylamino groups, etc.

Specific examples of further substituents for the substituents of $X_2$, $X_3$ and $Y_4$ include halogen atoms, nitro groups, cyano groups, methyl groups, alkyl groups such as ethyl groups, methoxy groups, alkoxy groups such as ethoxy groups, aryloxy groups such as phenoxy groups, phenyl groups, aryl groups such as naphthyl groups, benzyl groups, aralkyl groups such as phenethyl groups.

Among these radical polymerizing function groups, the acryloyloxy groups and methacryloyloxy groups are effectively used. A compound having three or more acryloyloxy groups can be formed by, e.g., performing an ester reaction or an ester exchange reaction among a compound having three or more hydroxyl groups, an acrylic acid (salt), halide acrylate and ester acrylate. A compound having three or more methacryloyloxy groups can be formed by the same method. The radical polymerizing function groups in a monomer having three or more radical polymerizing function groups may be the same or different from one another.

Specific examples of the radical polymerizing monomer having three or more functional groups and no charge transportable structure include, but are mot limited to, the following materials.

Namely, trimethylolpropanetriacrylate (TMPTA), trimethylolpropanetrimethacrylate, HPA-modified trimethylolpropanetriacrylate, EO-modified trimethylolpropanetriacrylate, PO-modified trimethylolpropanetriacrylate, caprolactone-modified trimethylolpropanetriacrylate, HPA-modified trimethylolpropanetrimethacrylate, pentaerythritoltriacrylate, pentaerythritoltetraacrylate (PETTA), glyceroltriacrylate, ECH-modified glyceroltriacrylate, EO-modified glyceroltriacrylate, PO-modified glyceroltriacrylate, tris(acryloxyethyl)isocyanurate, dipentaerythritolhexaacrylate (DPHA), caprolactone-modified dipentaerythritolhexaacrylate, dipentaerythritolhydroxypentaacrylate, alkyl-modified dipentaerythritolpentaacrylate, alkyl-modified dipentaerythritoltetraacrylate, alkyl-modified dipentaerythritoltriacrylate, dimethylolpropanetetraacrylate (DTMPTA), pentaerythritolethoxytetraacrylate, 2,2,5,5-tetrahydroxymethylcyclopentanonetetraacrylate, etc. are available. These can be used alone or in combination.

The crosslinked surface layer preferably includes the radical polymerizing monomer having three or more functional groups and no charge transportable structure in an amount of from 20 to 80% by weight, and more preferably from 30 to 70% by weight. When less than 20% by weight, a three-dimensional crosslinked bonding density of the crosslinked surface layer is insufficient, and the abrasion resistance thereof does not remarkably improve more than a layer including a conventional thermoplastic resin. When greater than 80% by weight, a content of a charge transportable compound lowers and electrical properties of the resultant photoreceptor deteriorates. Although it depends on a required abrasion resistance and electrical properties, in consideration of a balance therebetween, a content of the radical polymerizing monomer having three or more functional groups and no charge transportable structure is most preferably from 30 to 70% by weight based on total weight of the crosslinked surface layer.

The radical polymerizing compound having a charge transportable structure for use in the present invention is a compound which has a positive hole transport structure such as triarylamine, hydrazone, pyrazoline and carbazole or an electron transport structure such as condensed polycyclic quinone, diphenoquinone, a cyano group and an electron attractive aromatic ring having a nitro group, and has a radical polymerizing functional group. Specific examples of the radical polymerizing functional group include the above-mentioned radical polymerizing monomers, and particularly the acryloyloxy groups and methacryloyloxy groups are effectively used.

In addition, the radical polymerizing compound having a charge transportable structure may be monofunctional or multifunctional, having two or more functional groups. However, the radical polymerizing compound having a charge transportable structure is preferably monofunctional in terms of the layer quality and electrical properties. When a multifunctional charge transportable compound having two or more functional groups is used, although fixed with plural bondings in the crosslinked structure, a distortion arises in a hardening resin because the charge transportable structure is extremely bulky and an internal stress in the crosslinked surface layer increases, and therefore the resultant photoreceptor frequently has a crack and a scratch due to a carrier adherence. This does not cause problems in a layer having a thickness of 5 μm or less, however, the internal stress therein becomes large and the layer tends to have a crack when having a thickness greater than 5 μm.

Further, as the multifunctional charge transportable compound having two or more functional groups is fixed with plural bondings in the crosslinked structure, an intermediate structure (cation radical) when a charge is transported cannot stably be maintained, resulting in deterioration of sensitivity due to a charge trap and increase of a residual potential. This deterioration of electrical properties results in deterioration of image density and thinner letter images. Therefore, the radical polymerizing compound having a charge transportable structure being fixed like a pendant between the crosslinkage is preferably used to prevent the crack and scratch and to stabilize the electrical properties.

In addition, a triarylamine structure is effectively used as the charge transportable structure. Further, when a compound having the following formula (1) or (2), electrical properties such as a sensitivity and a residual potential are preferably maintained.

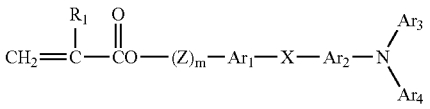

(1)

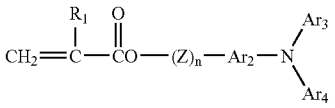

(2)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n represent 0 and an integer of from 1 to 3.

In the formulae (1) and (2), among substituted groups of $R_1$, the alkyl groups include methyl groups, ethyl groups, propyl groups, butyl groups, etc.; the aryl groups include phenyl groups, naphtyl groups, etc.; aralkyl groups include benzyl groups, phenethyl groups, naphthylmethyl groups, etc.; and alkoxy groups include methoxy groups, ethoxy groups, propoxy groups, etc. These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups.

The substituted group of $R_1$ is preferably a hydrogen atom or a methyl group.

$Ar_3$ and $Ar_4$ independently represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a crycenyl group and a naphthacenyl group.

Specific examples of the non-condensed cyclic hydrocarbon groups and heterocyclic groups include monovalent groups of monocyclic hydrocarbon compounds such as benzene, diphenylether, polyethylenediphenylether, diphenylthioether, and diphenylsulfone; monovalent groups of non-condnesed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include monovalent groups such as carbazole, dibenzofuran, dibenzothiophene, oxadiazole and thiadiazole.

Specific examples of the substituted or unsubstituted aryl group represented by $Ar_3$ and $Ar_4$ include the following groups:

(1) a halogen atom, a cyano group and a nitro group, (2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_2$) wherein $R_2$ represents an alkyl group specified in (2). Specific examples thereof include methoxy groups, ethoxy groups, n-propoxy groups, I-propoxy groups, t-butoxy groups, s-butoxy groups, I-butoxy groups, 2-hydroxyethoxy groups, benzyloxy groups, trifluoromethoxy groups, etc.

(4) aryloxy groups, and specific examples of the aryl groups include phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

(6)

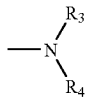

wherein $R_3$ and $R_4$ independently represent a hydrogen atom, an alkyl groups specified in (2) and an aryl group, and specific examples of the aryl groups include phenyl groups, biphenyl groups and naphthyl groups, and these may include an alkoxy group having 1 to 4 carbon atoms, an alkyl group having 1 to 4 carbon atoms or a halogen atom as a substituent, and $R_3$ and $R_4$ may form a ring together. Specific examples of the groups having this formula include amino groups, diethylamino groups, N-methyl-N-phenylamino groups, N,N-diphenylamino groups, N-N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group.

(8) a substituted or an unsubstituted styryl group, a substituted or an unsubstituted β-phenylstyryl group, a diphenylaminophenyl group, a ditolylaminophenyl group, etc.

The arylene group represented by $Ar_1$ and $Ar_2$ are derivative divalent groups from the aryl groups represented by $Ar_3$ and $Ar_4$.

The above-mentioned X represents a single bond, a substituted or an unsubstituted alkylene group, a substituted or an unsubstituted cycloalkylene group, a substituted or an unsubstituted alkyleneether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further includes a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkylene groups include methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenylethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples thereof include cyclohexylidine groups, cyclohexylene groups and 3,3-dimethylcyclohexylidine groups, etc.

Specific examples of the substituted or unsubstituted alkyleneether groups include ethyleneoxy, propyleneoxy, ethyleneglycol, propyleneglycol, diethyleneglycol, tetraethyleneglycol and tripropyleneglycol, and the alkylene group of the alkyleneether group may include a substituent such as a hydroxyl group, a methyl group and an ethyl group.

The vinylene group has the following formula:

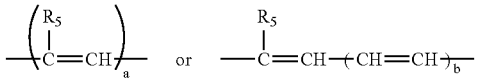

wherein R5 represents a hydrogen atom, an alkyl group (same as those specified in (2)), an aryl group (same as those represented by $Ar_3$ and $Ar_4$); a represents 1 or 2; and b represents 1, 2 or 3. Z represents a substituted or an unsubstituted alkylene group, a substituted or an unsubstituted alkyleneether group and alkyleneoxycarbonyl group. Specific examples of the substituted or unsubstituted alkylene group include those of X. Specific examples of the substituted or unsubstituted alkyleneether group include those of X. Specific examples of the alkyleneoxycarbonyl group include caprolactone-modified groups.

In addition, the monofunctional radical polymerizing compound having a charge transportable structure is more preferably a compound having the following formula (3):

(3)

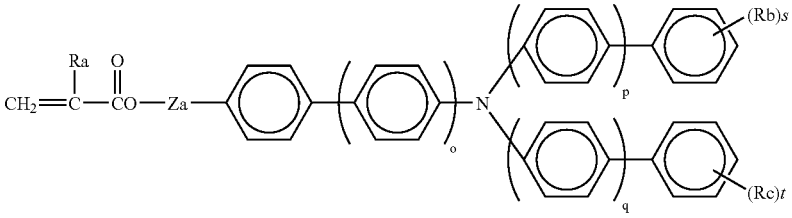

wherein o, p and q independently represent 0 or 1; Ra represents a hydrogen atom or a methyl group; Rb and Rc represents a substituent besides a hydrogen atom and an alkyl group having 1 to 6 carbon atoms, and may be different from each other when having plural carbon atoms; s and t represent 0 or an integer of from 1 to 3; Za represents a single bond, a methylene group, ethylene group,

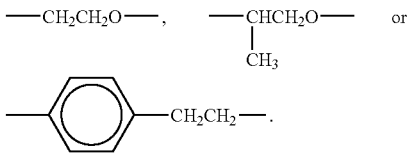

The compound having formula (3) is preferably a compound having an methyl group or a ethyl group as a substituent of Rb and Rc.

The monofunctional radical polymerizing compound having a charge transportable structure and the formulae (1), (2) or particularly (3) for use in the present invention does not become an end structure because a double bonding between the carbons is polymerized while opened to the both sides, and is built in a chain polymer. In a crosslinked polymer polymerized with a radical polymerizing monomer having three or more functional groups, the compound is present in a main chain and in a crosslinked chain between the main chains (the crosslinked chain includes an intermolecular crosslinked chain between a polymer and another polymer and an intramolecular crosslinked chain wherein a portion having a folded main chain and another portion originally from the monomer, which is polymerized with a position apart therefrom in the main chain are polymerized). Even when the compound is present in a main chain or a crosslinked chain, a triarylamine structure suspending from the chain has at least three aryl groups radially located from a nitrogen atom, is not directly bonded with the chain and suspends through a carbonyl group or the like, and is sterically and flexibly fixed although bulky. The triarylamine structures can spatially be located so as to be moderately adjacent to one another in a polymer, and has less structural distortion in a molecule. Therefore, it is speculated that the monofunctional radical polymerizing compound having a charge transportable structure in a surface layer of an electrophotographic photoreceptor can have an intramolecular structure wherein blocking of a charge transport route is comparatively prevented.

Specific examples of the monofunctional radical polymerizing compound having a charge transportable structure include, but are not limited to, compounds having the following formulae.

No. 1

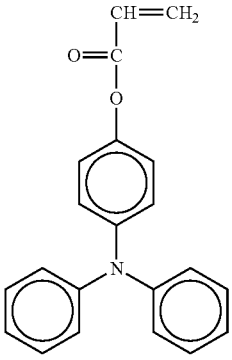

No. 2

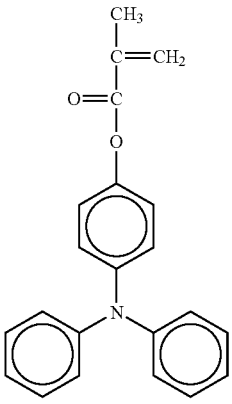

-continued

No. 3

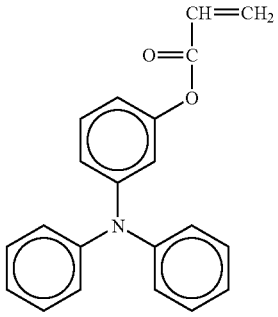

No. 4

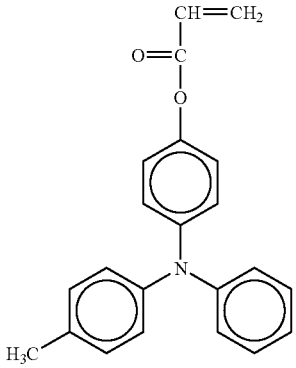

No. 5

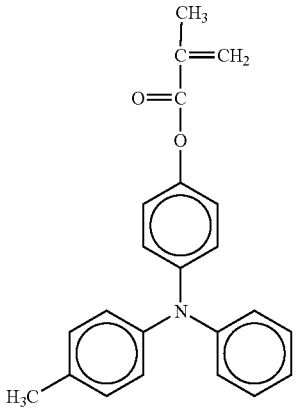

No. 6

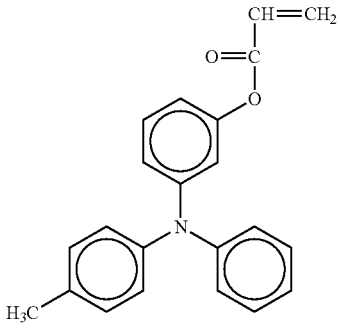

-continued
No. 7
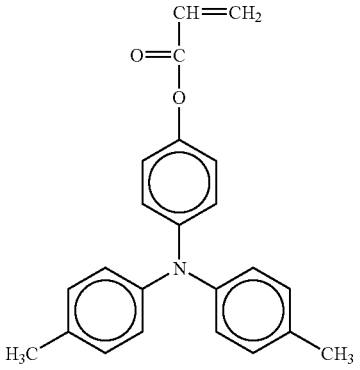
No. 8
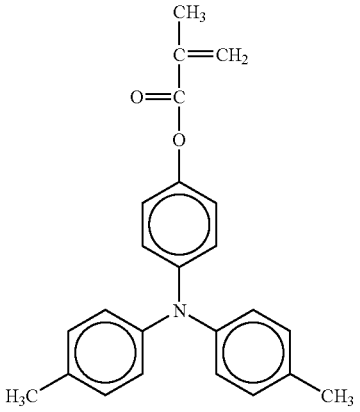
No. 9
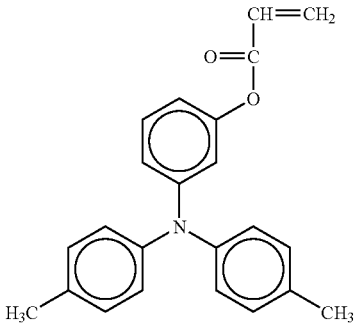
No. 10
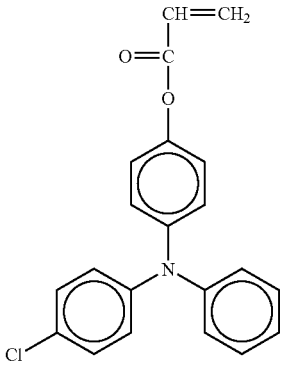
-continued
No. 11
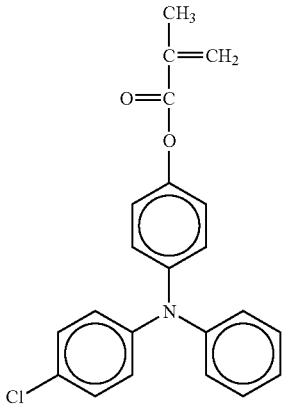
No. 12
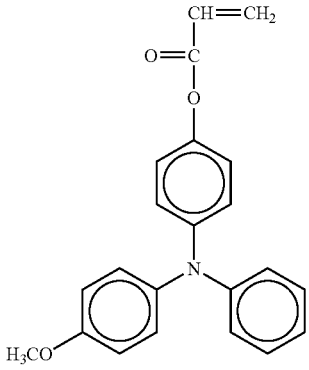
No. 13
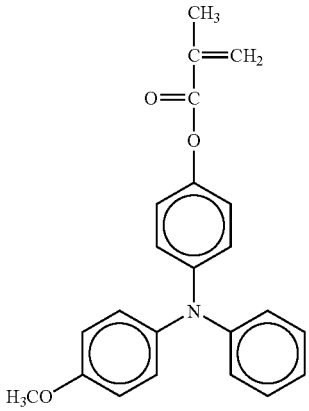
No. 14
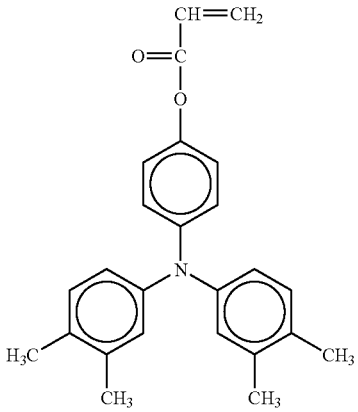

-continued
No. 15
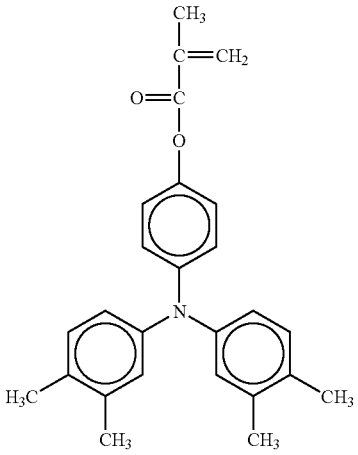
No. 16
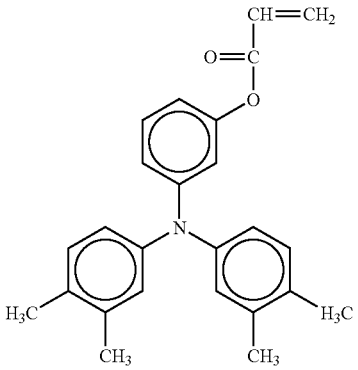
No. 17
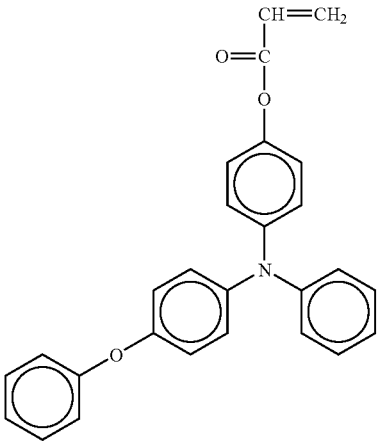
-continued
No. 18
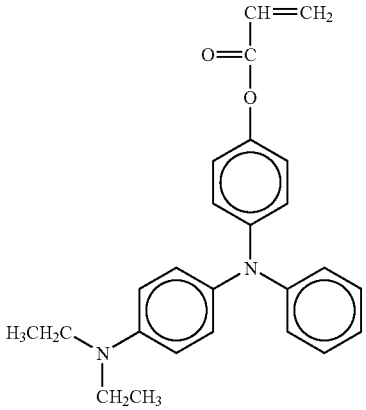
No. 19
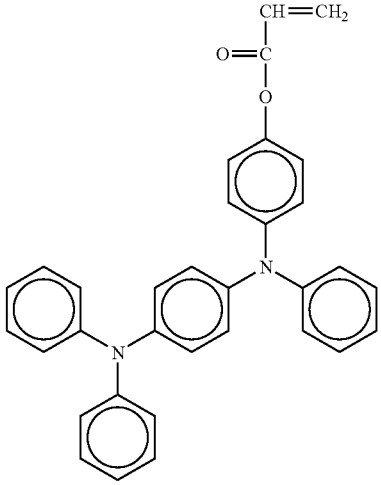
No. 20
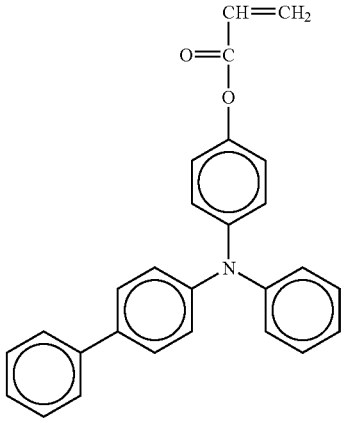

-continued
No. 21
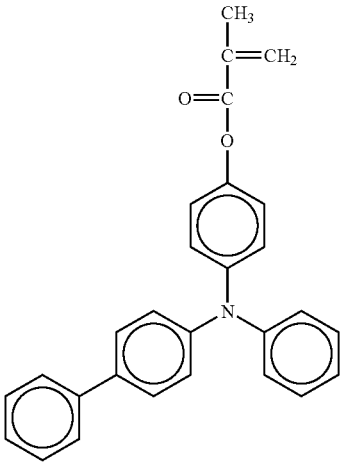
No. 22
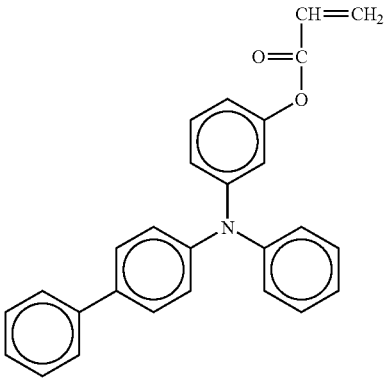
No. 23
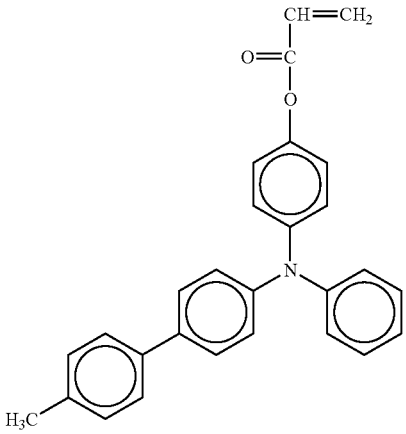
-continued
No. 24
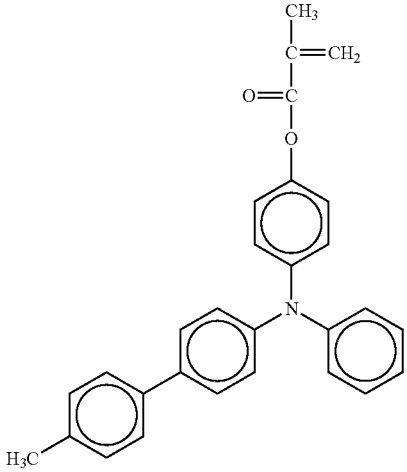
No. 25
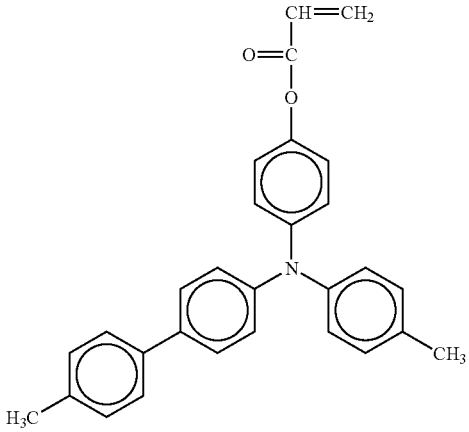
No. 26
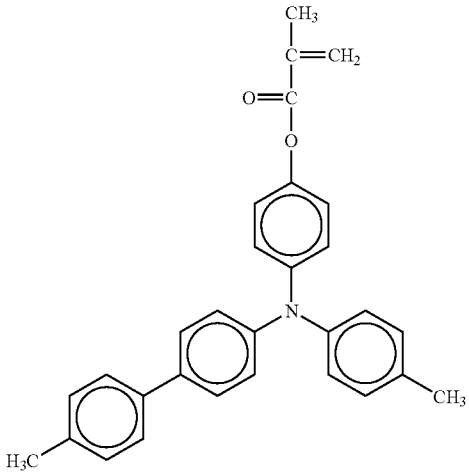

-continued
No. 27
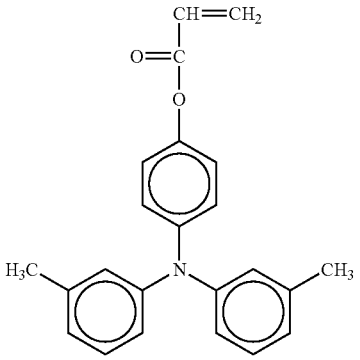
No. 28
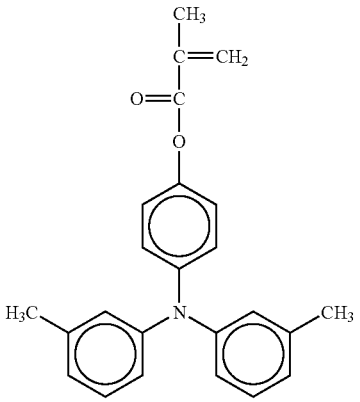
No. 29
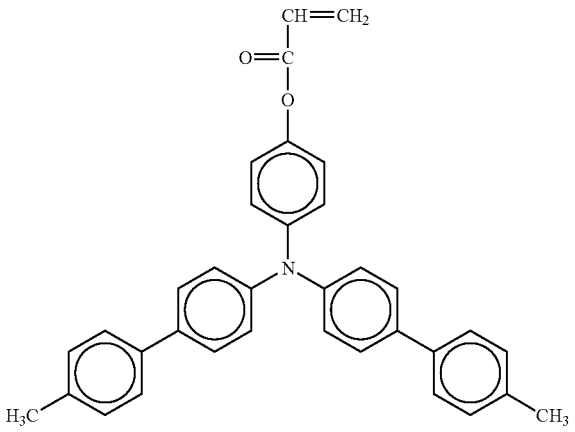
-continued
No. 30
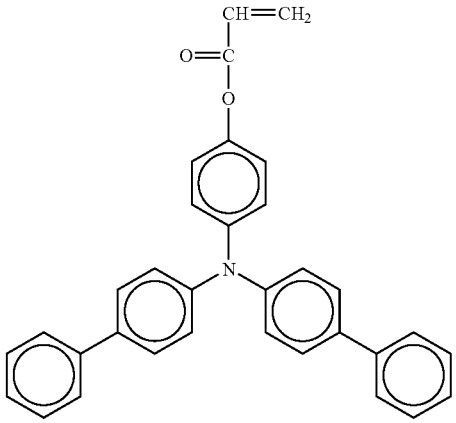
No. 31
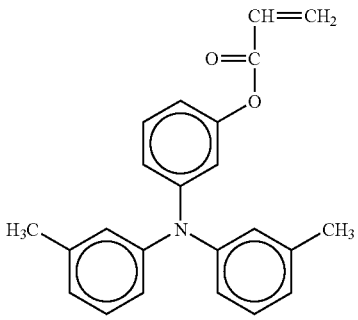
No. 32
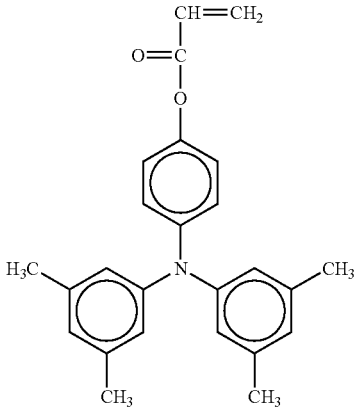

-continued
No. 33
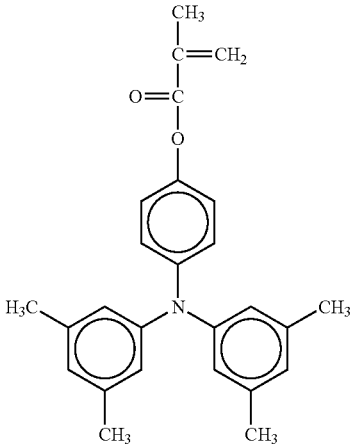
No. 34
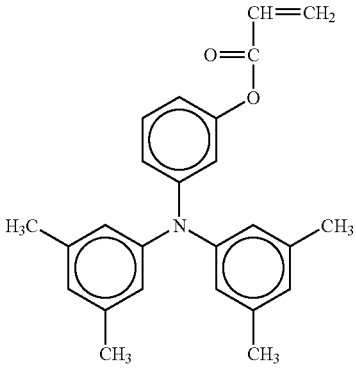
No. 35
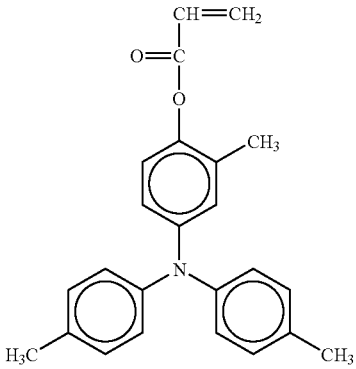
No. 36
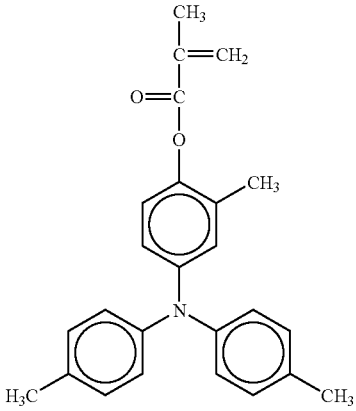
-continued
No. 37
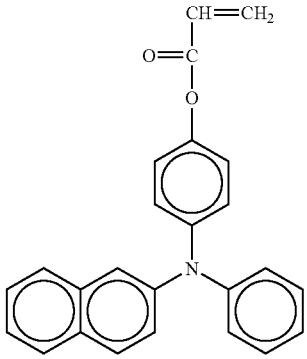
No. 38
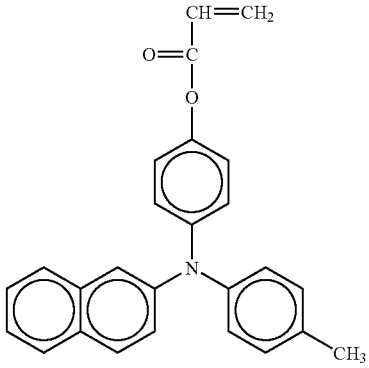
No. 39
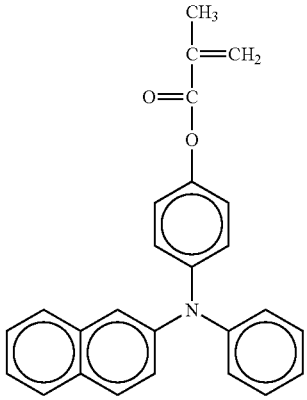
No. 40
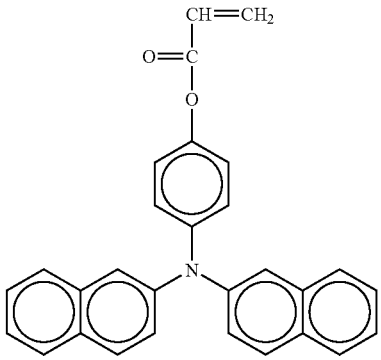

-continued
No. 41
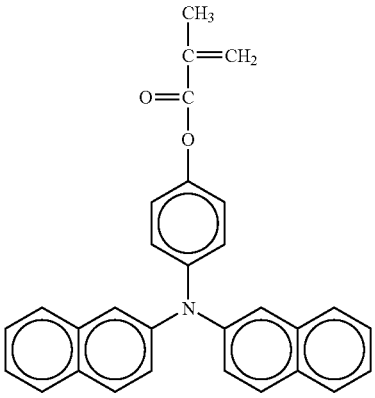
No. 42
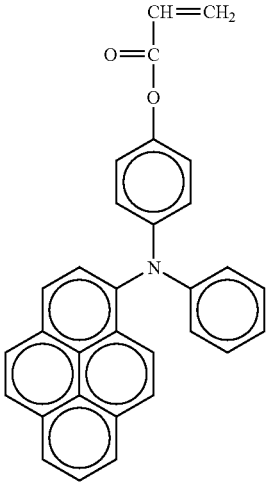
No. 43
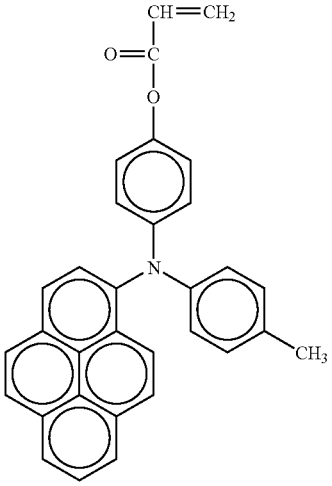
-continued
No. 44
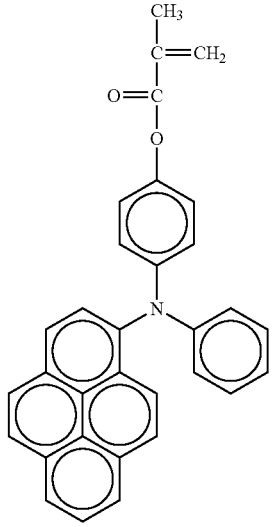
No. 45
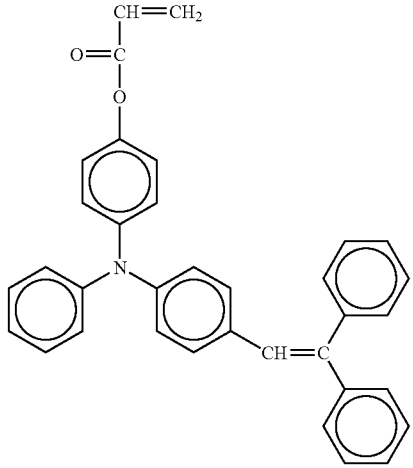
No. 46
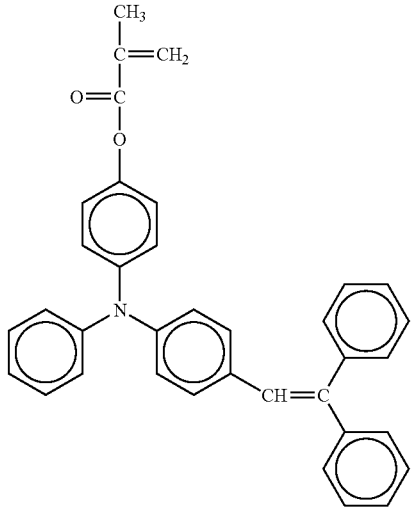

-continued
No. 47
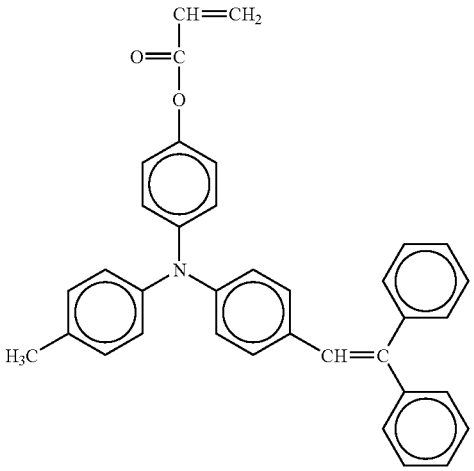
No. 48
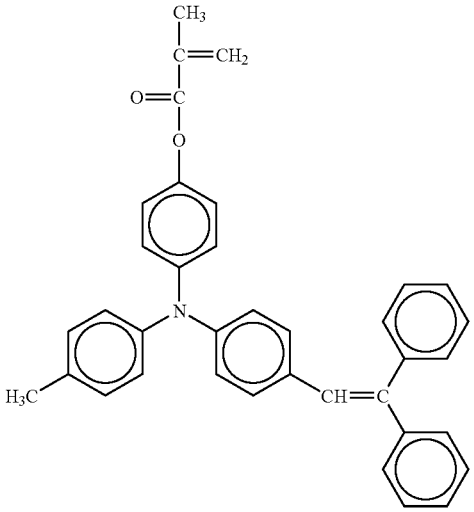
No. 49
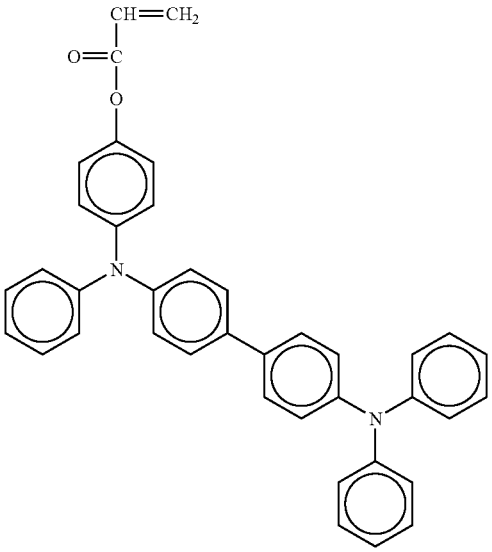
-continued
No. 50
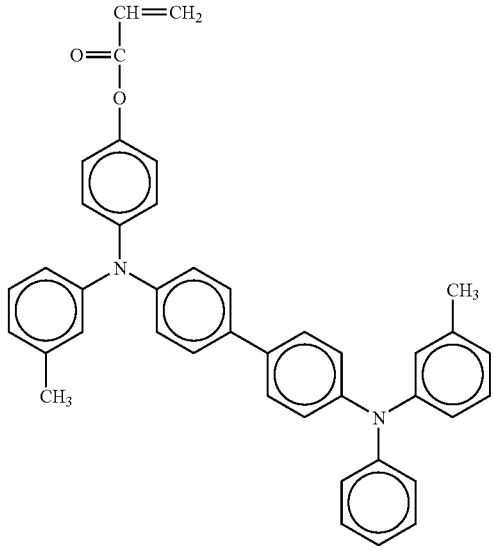
No. 51
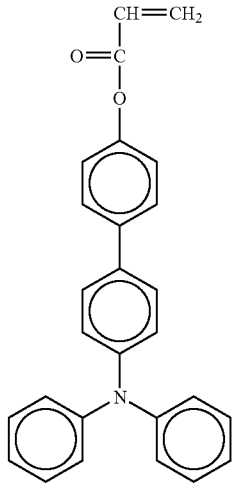
No. 52
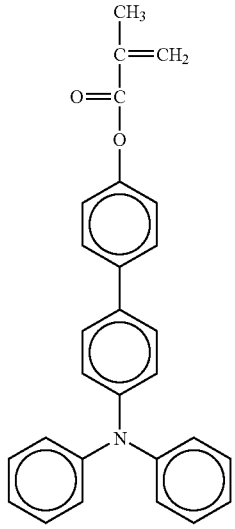

-continued
No. 53
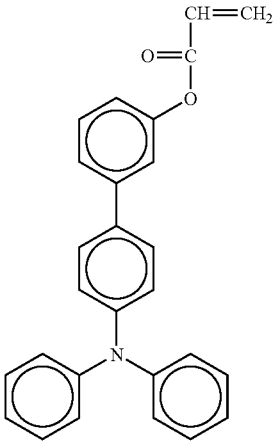
No. 54
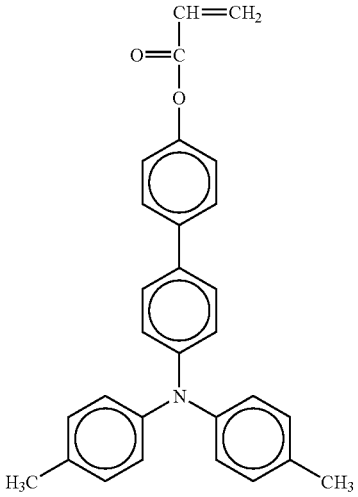
No. 55
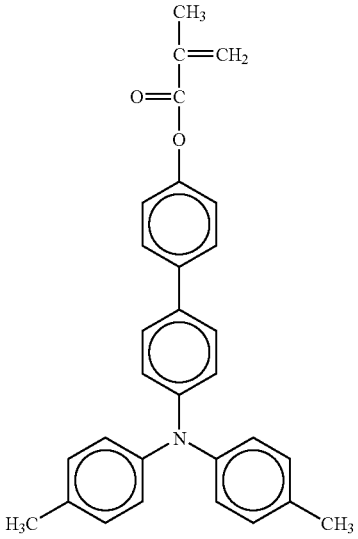
-continued
No. 56
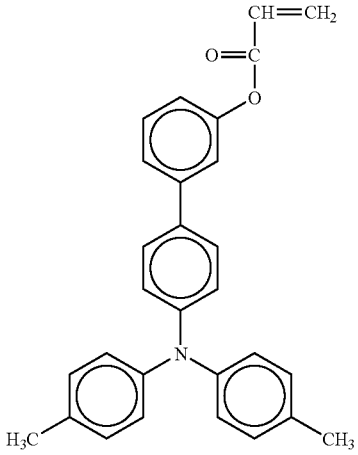
No. 57
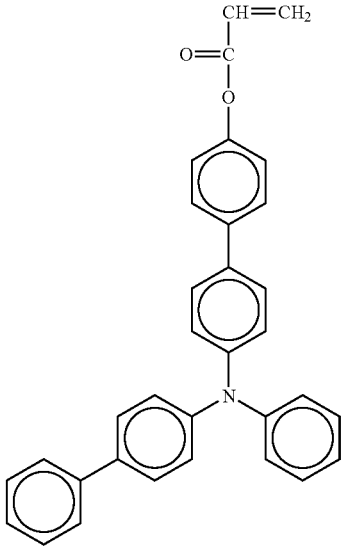
No. 58
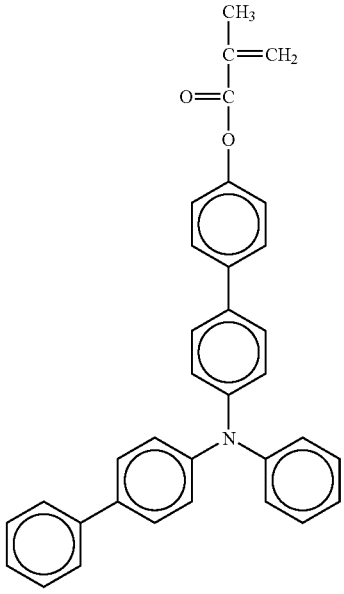

-continued
No. 59
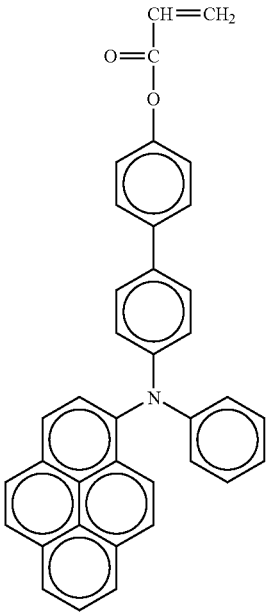
No. 60
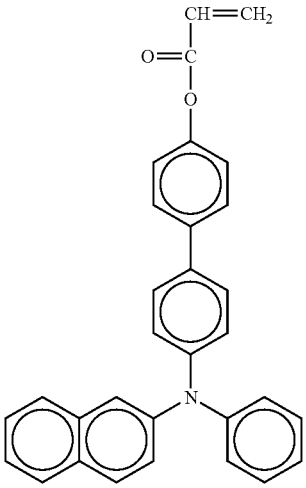
No. 61
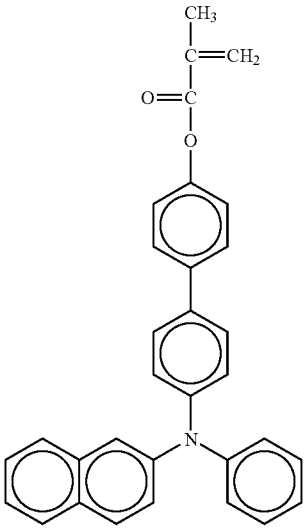
-continued
No. 62
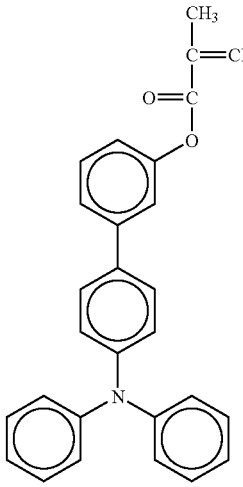
No. 63
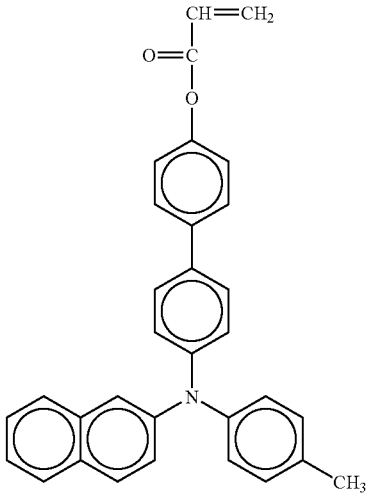
No. 64
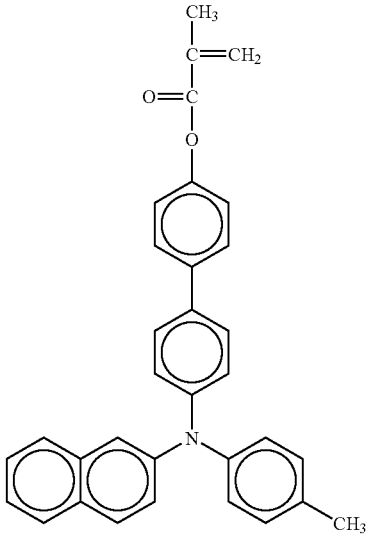

-continued
No. 65
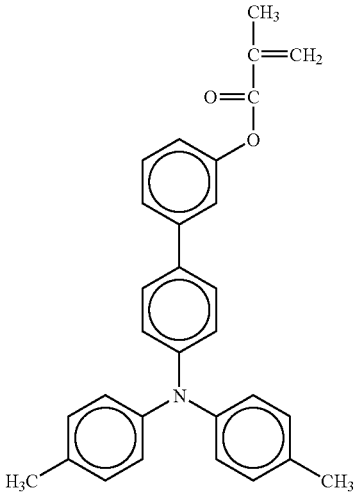
No. 66
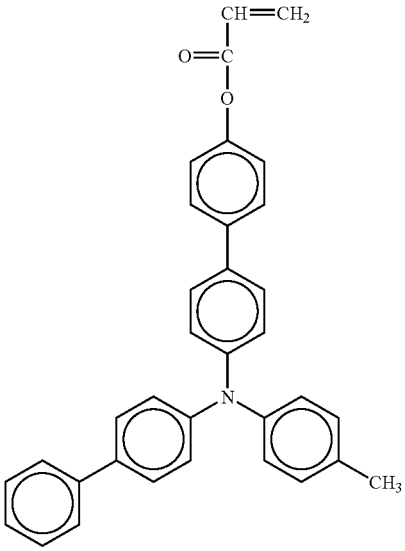
No. 67
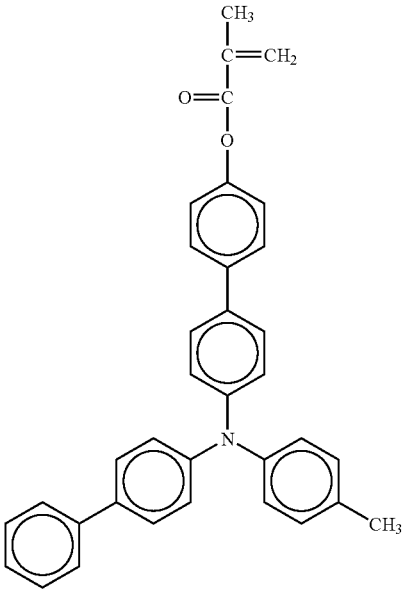
-continued
No. 68
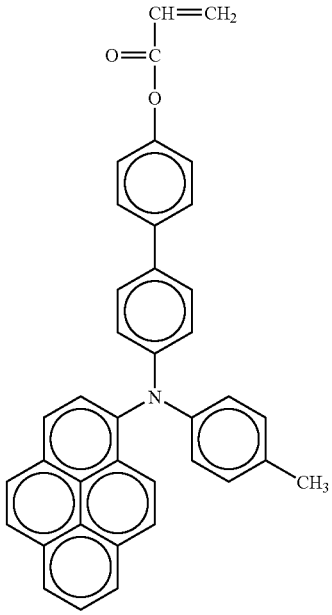
No. 69
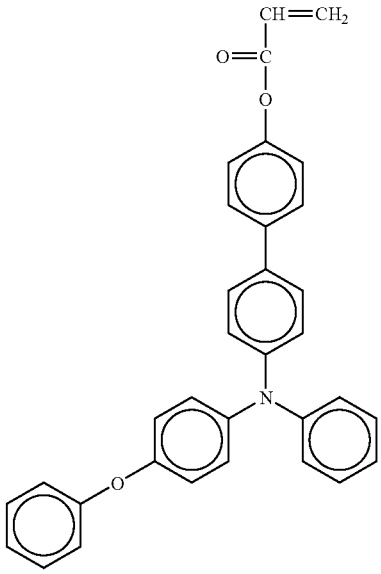

-continued
No. 70
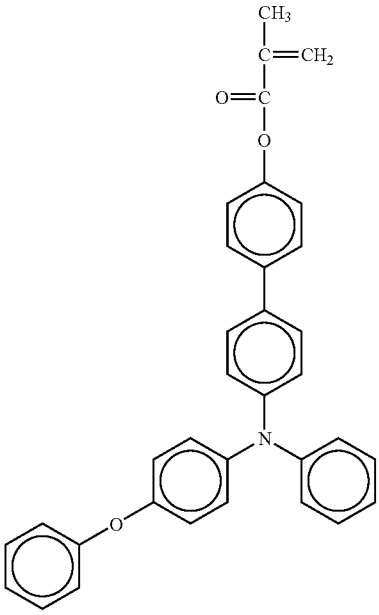
No. 71
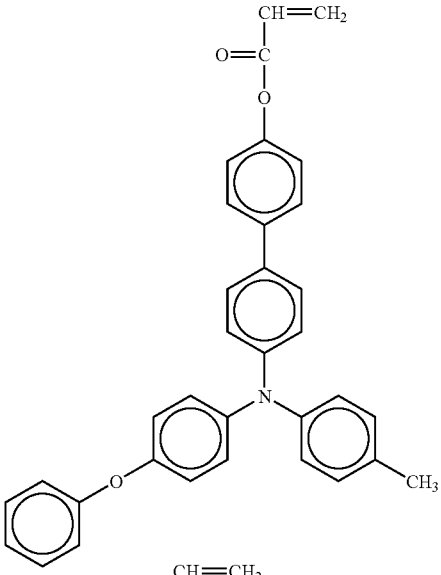
No. 72
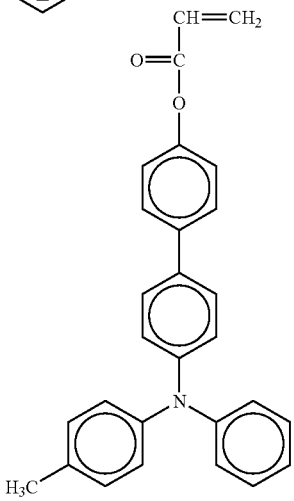
-continued
No. 73
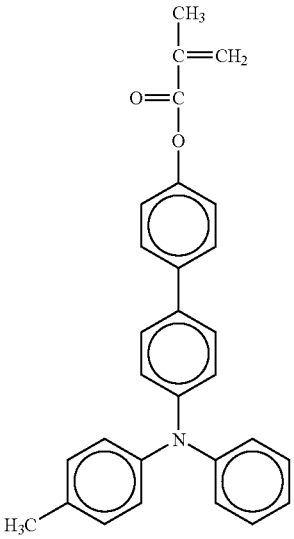
No. 74
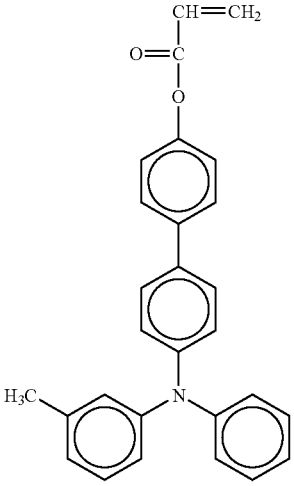
No. 75
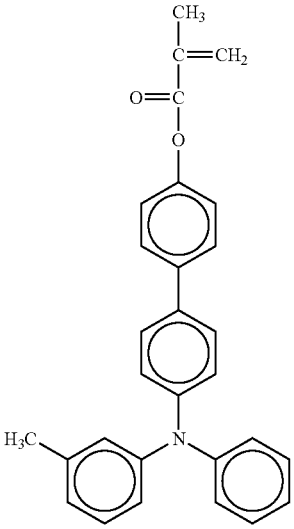

-continued
No. 76
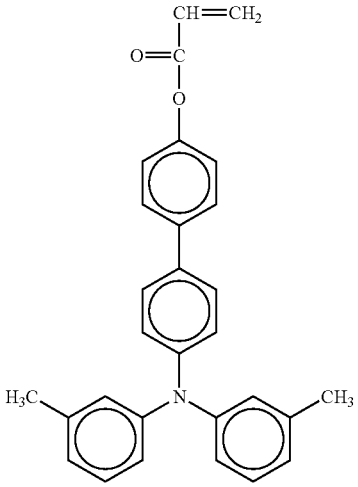
No. 77
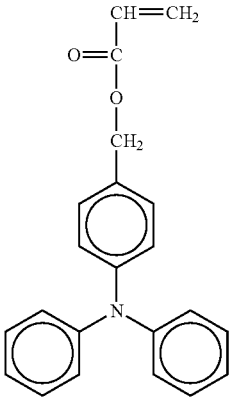
No. 78
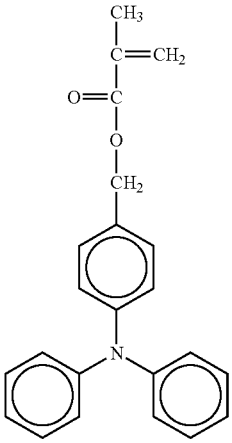
-continued
No. 79
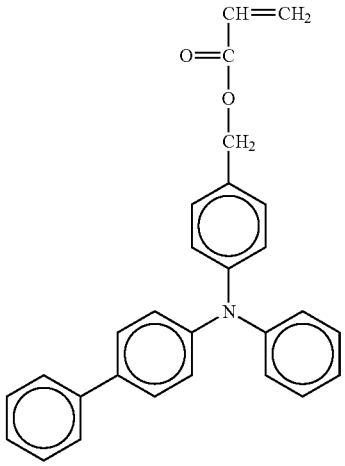
No. 80
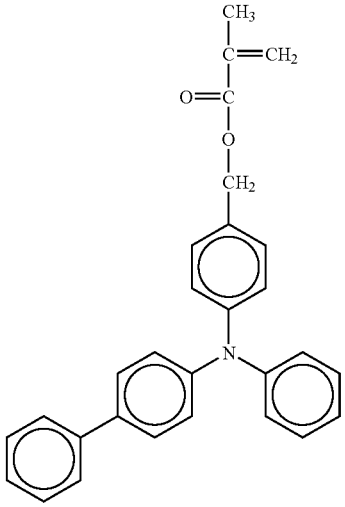
No. 81
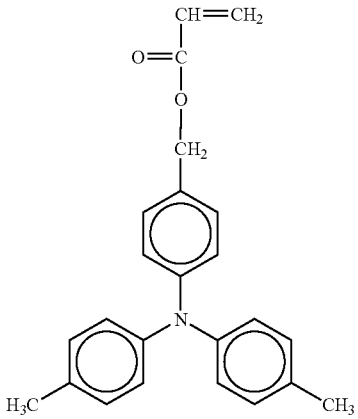

-continued
No. 82
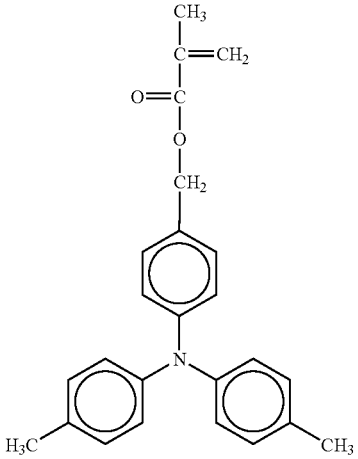
No. 83
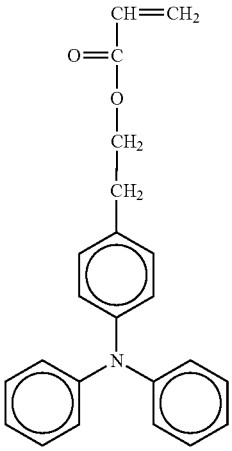
No. 84
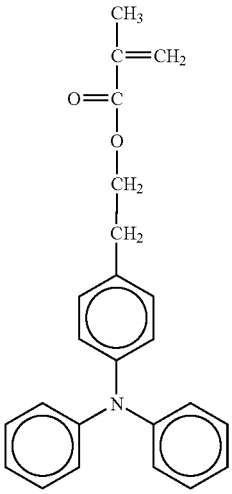
-continued
No. 85
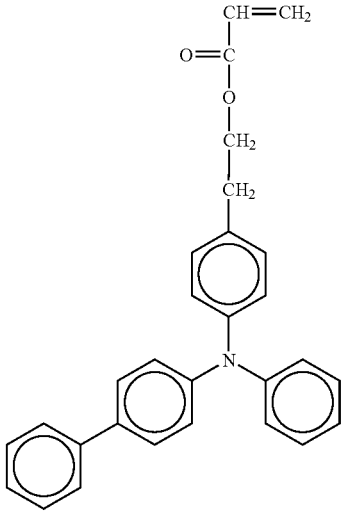
No. 86
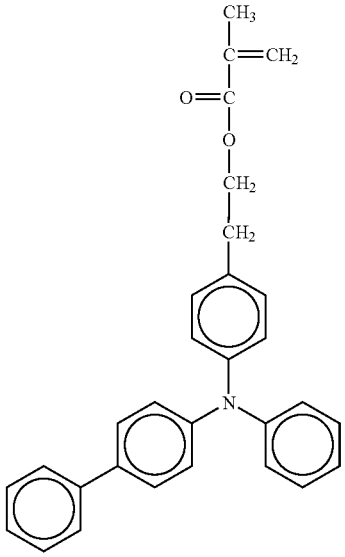
No. 87
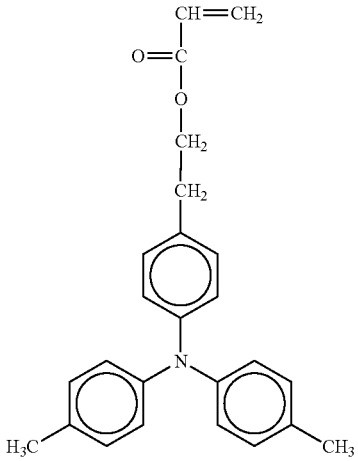

-continued
No. 88
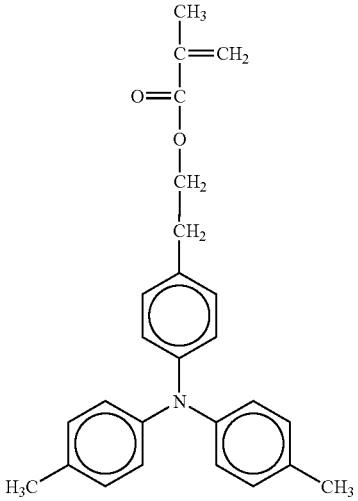
No. 89
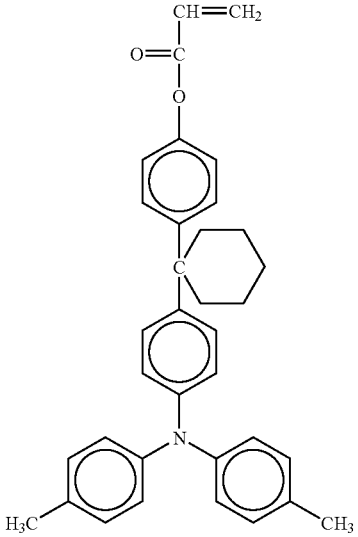
No. 90
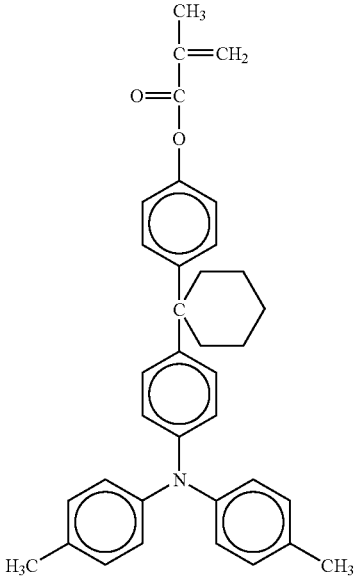
-continued
No. 91
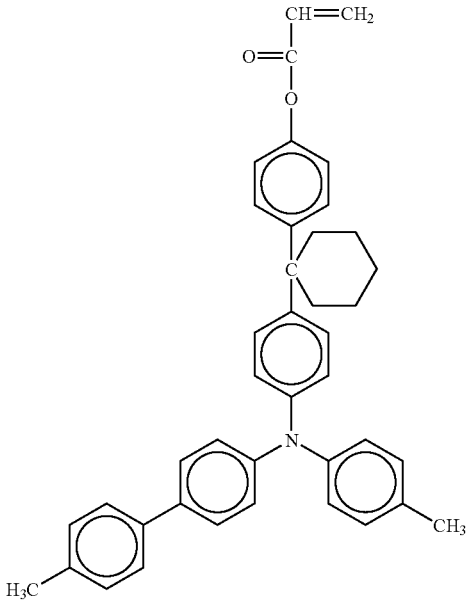
No. 92
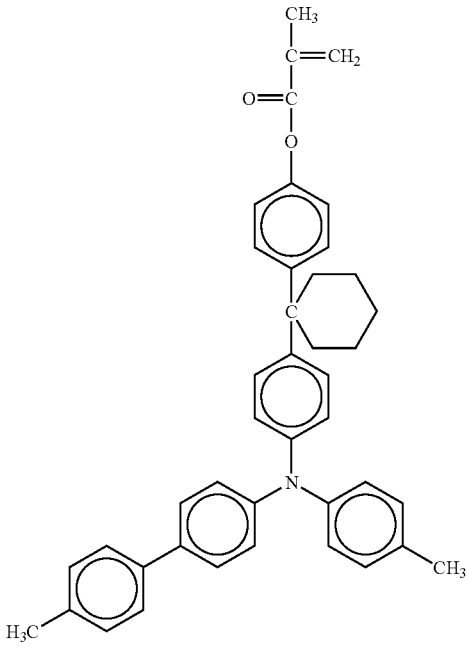

-continued
No. 93
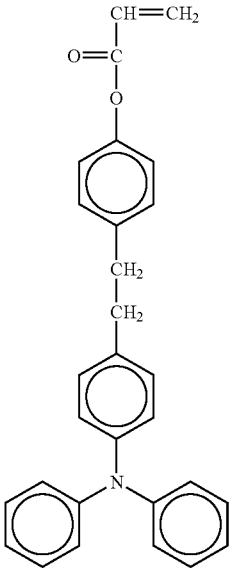
No. 94
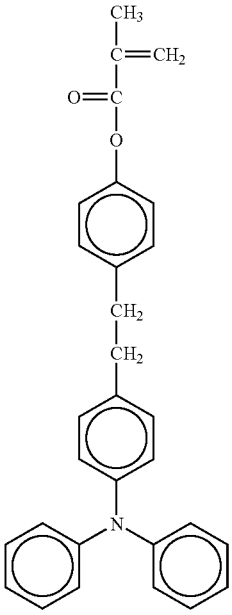
-continued
No. 95
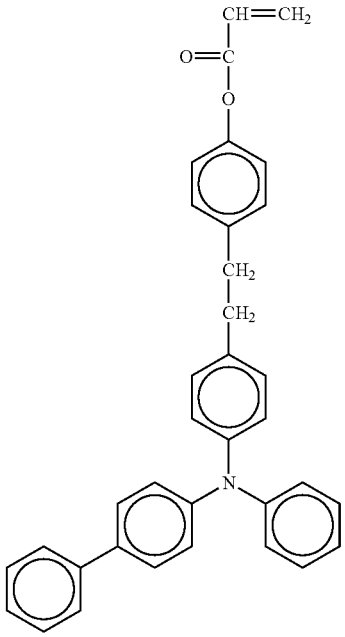
No. 96
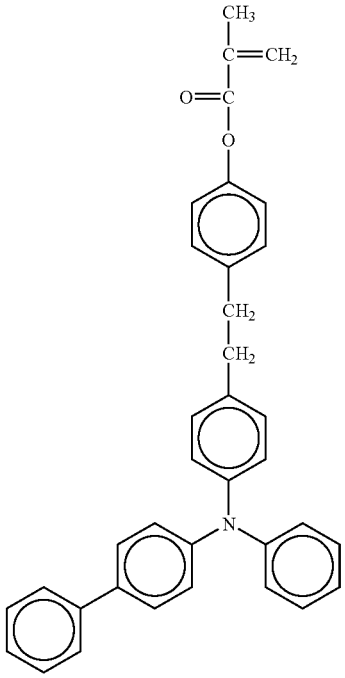

-continued
No. 97
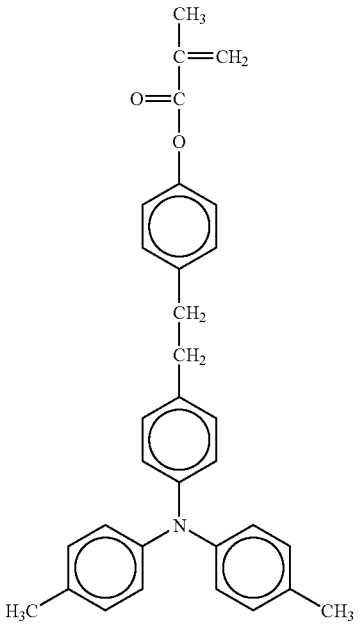
No. 98
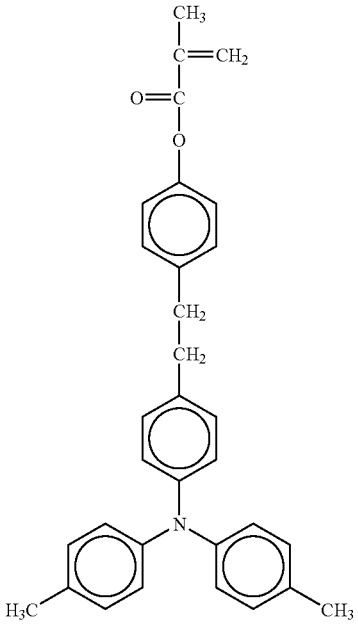
-continued
No. 99
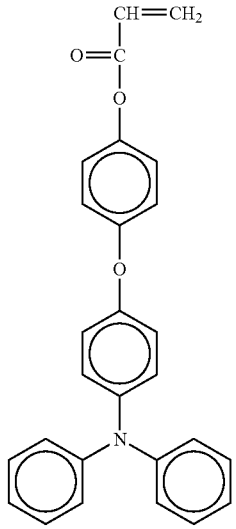
No. 100
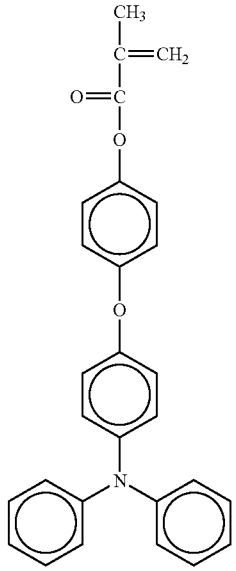

-continued
No. 101
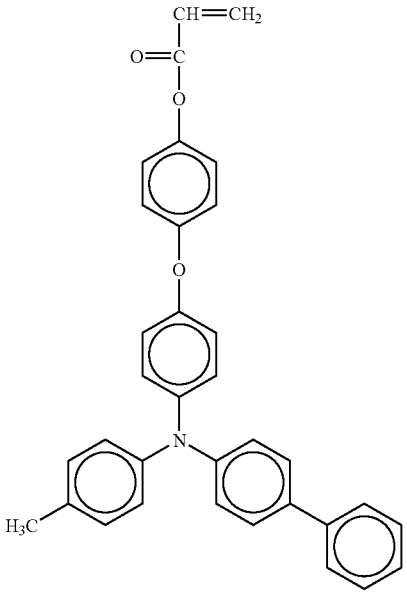
No. 102
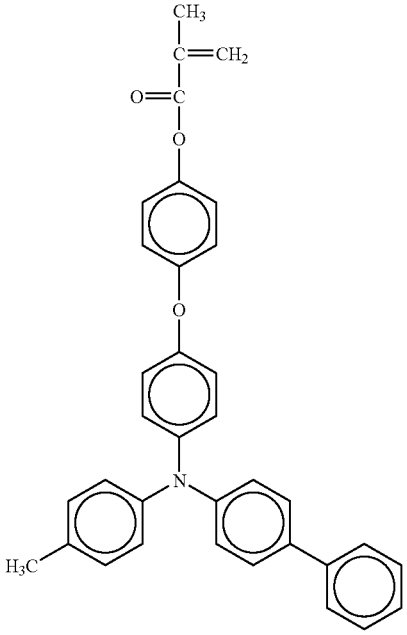
-continued
No. 103
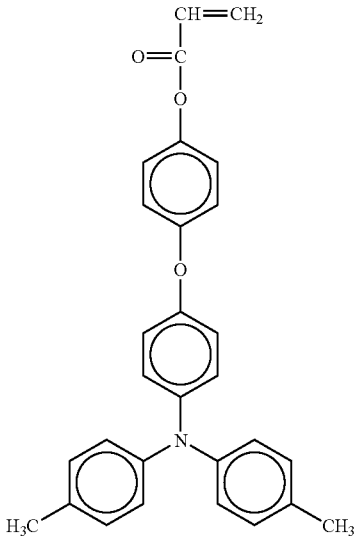
No. 104
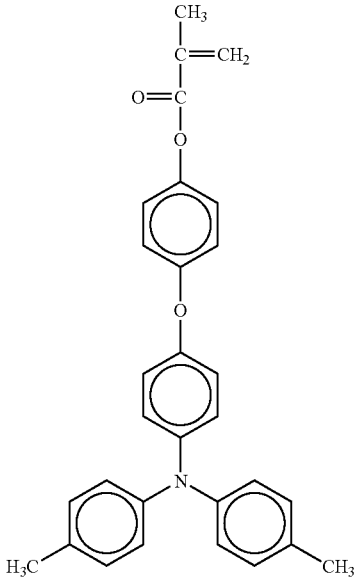

-continued
No. 105
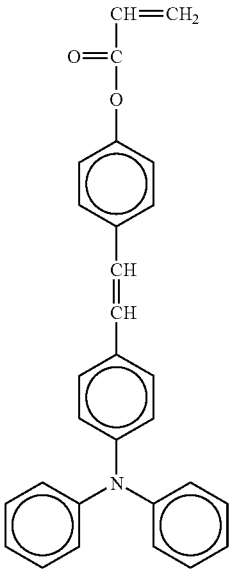
No. 106
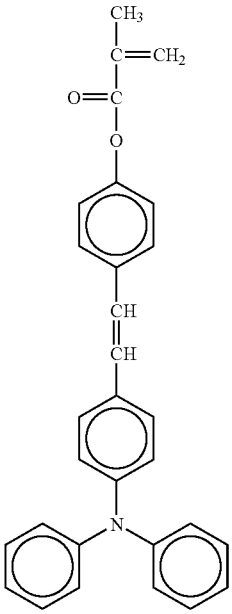
-continued
No. 107
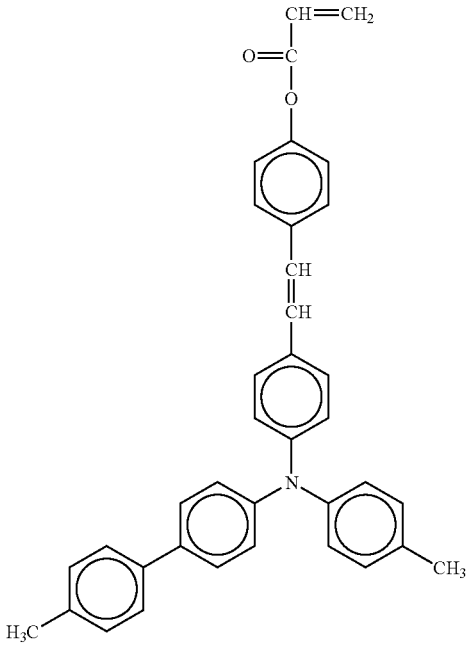
No. 108
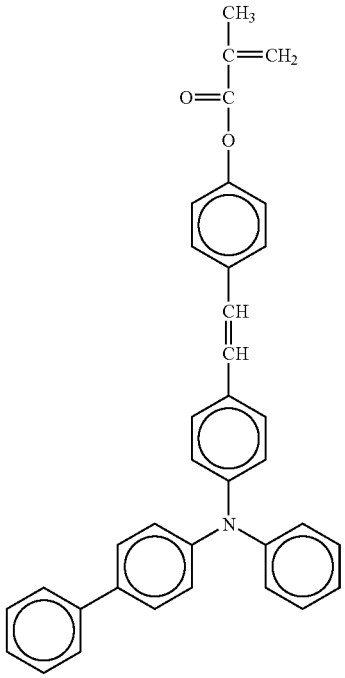

-continued
No. 109
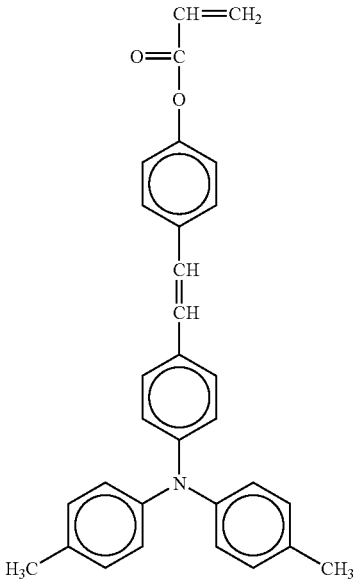
No. 110
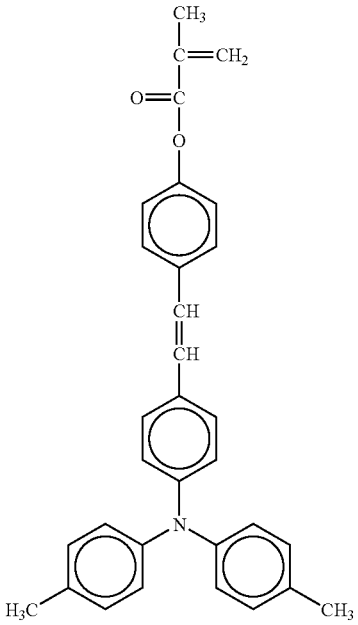
-continued
No. 111
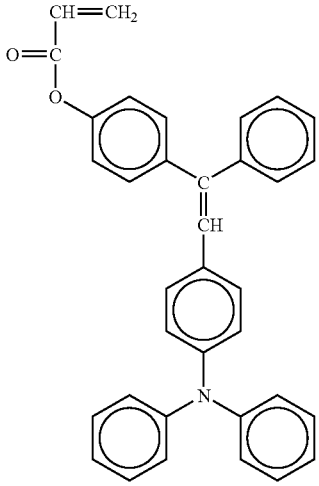
No. 112
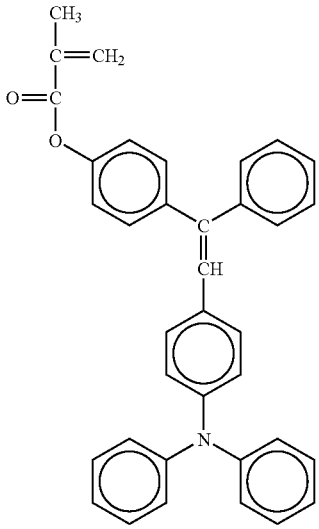
No. 113
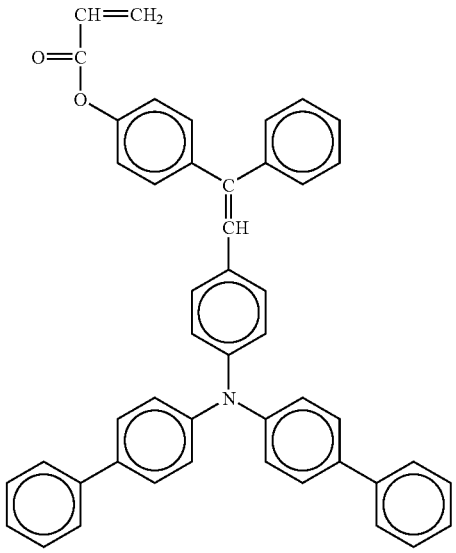

-continued
No. 114
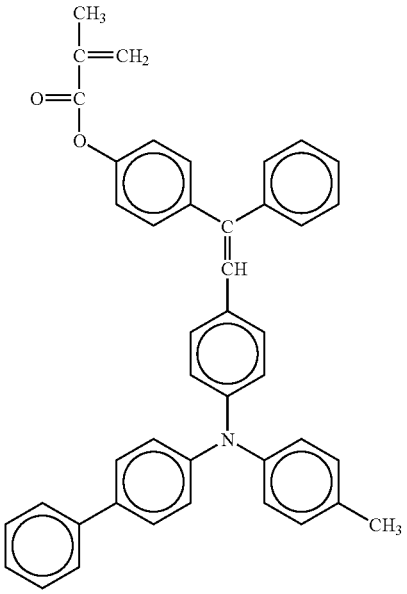
No. 115
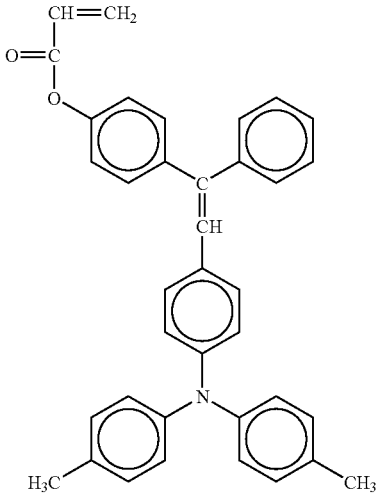
No. 116
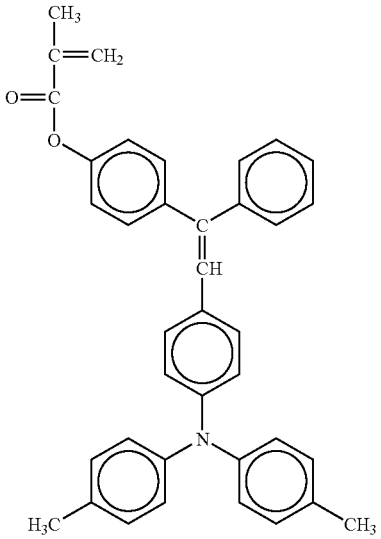
-continued
No. 117
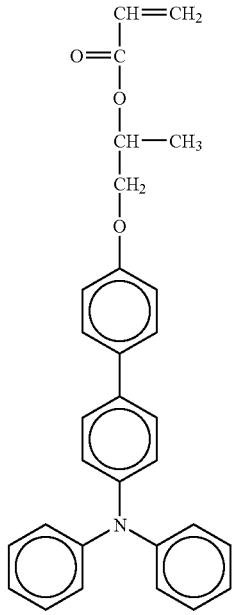
No. 118
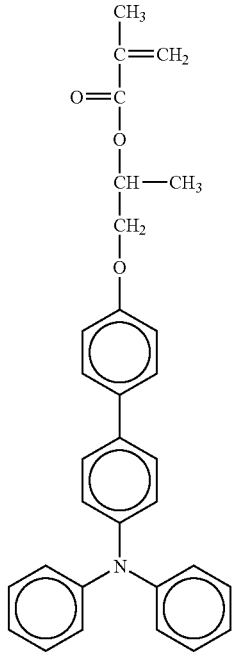

-continued
No. 119
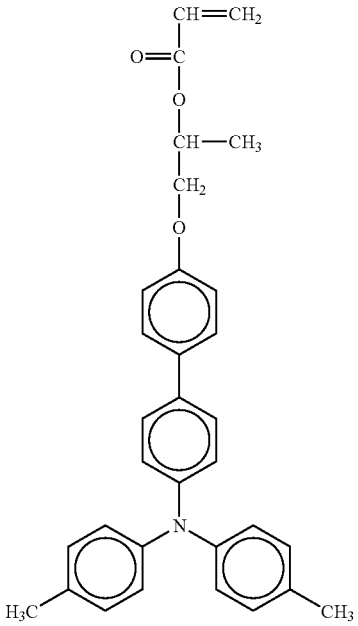
No. 120
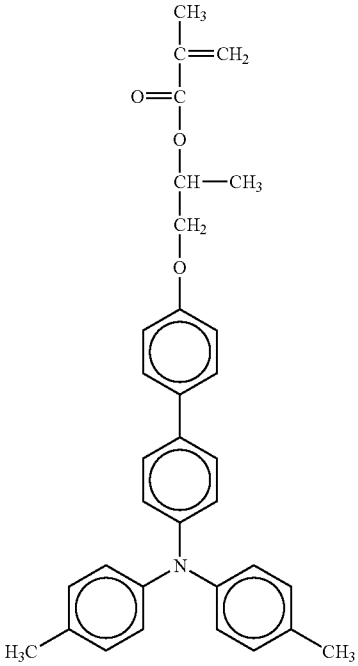
-continued
No. 121
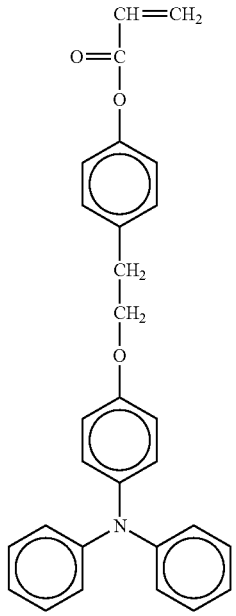
No. 122
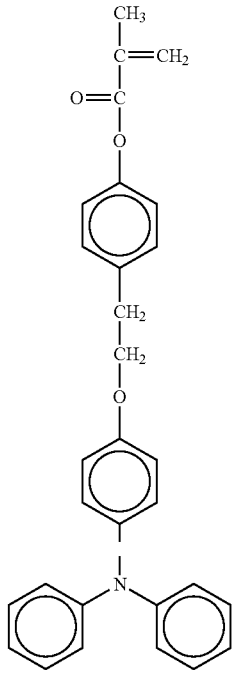

-continued
No. 123
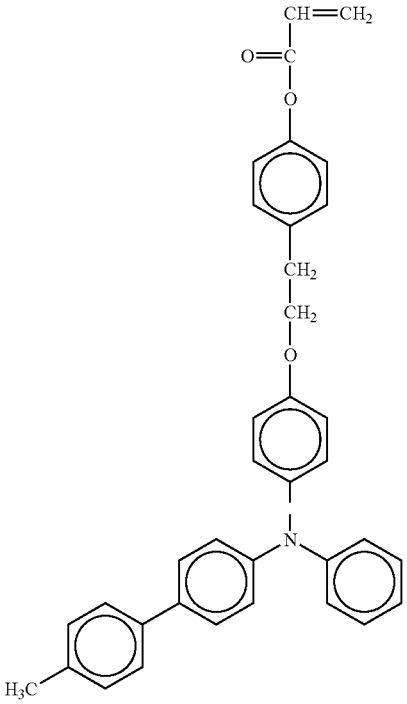
No. 124
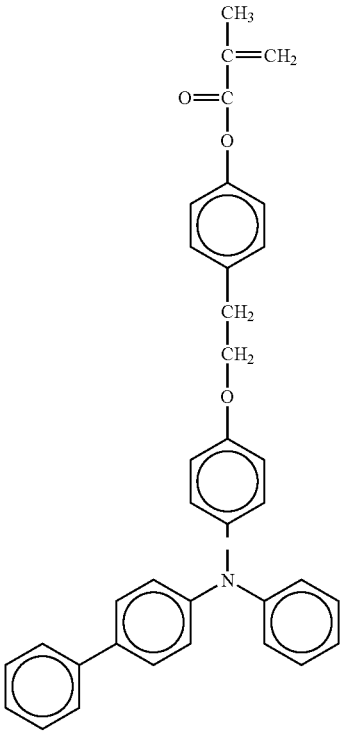
-continued
No. 125
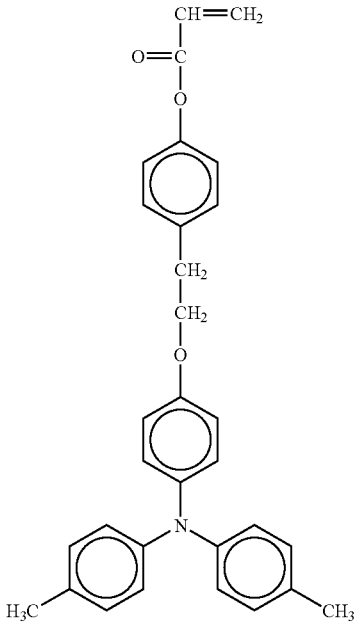
No. 126
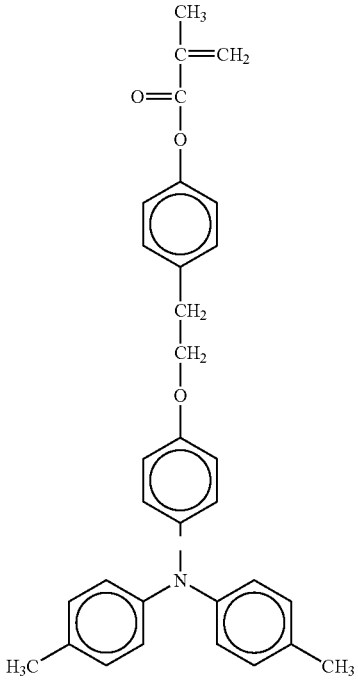

-continued
No. 127
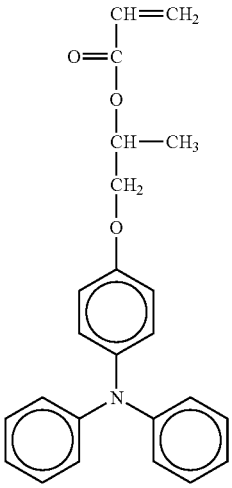
No. 128
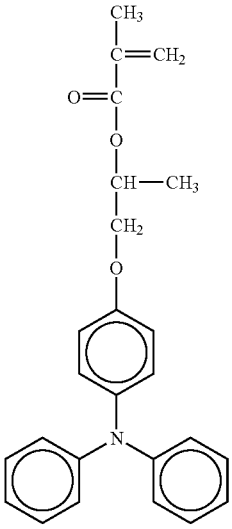
No. 129
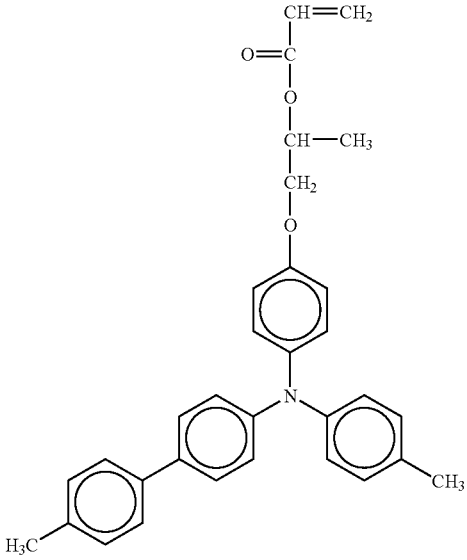
-continued
No. 130
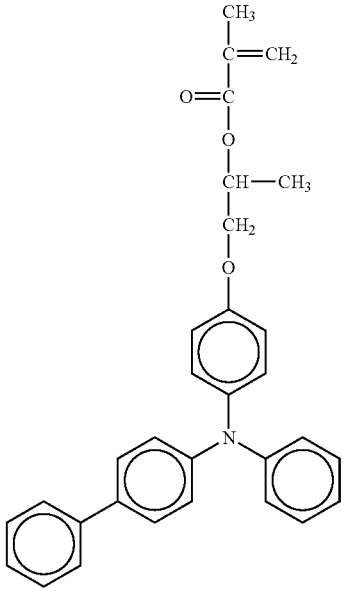
No. 131
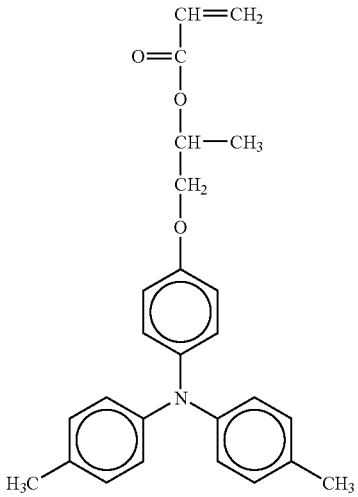
No. 132
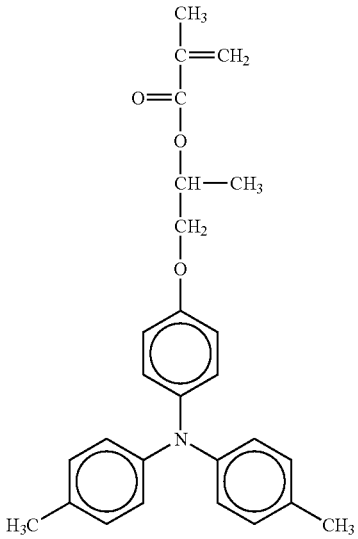

-continued
No. 133
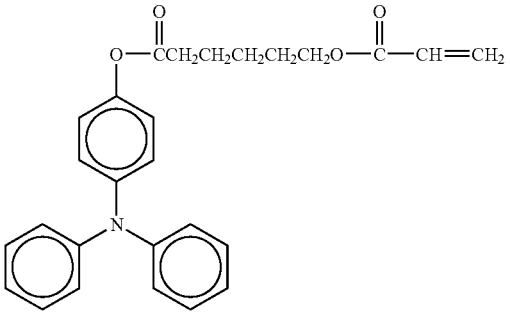
No. 134
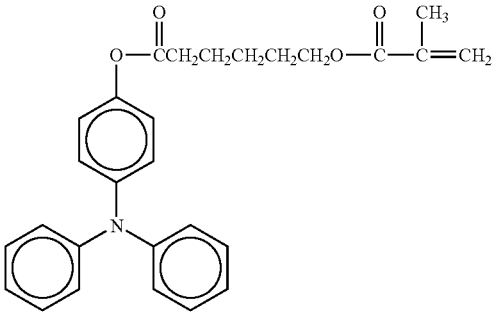
No. 135
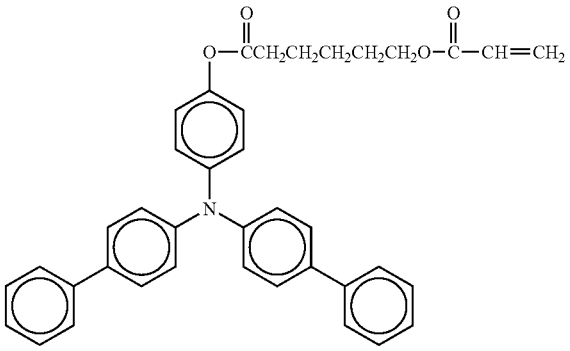
-continued
No. 136
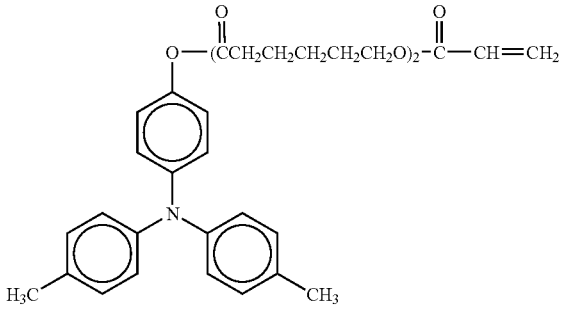
No. 137
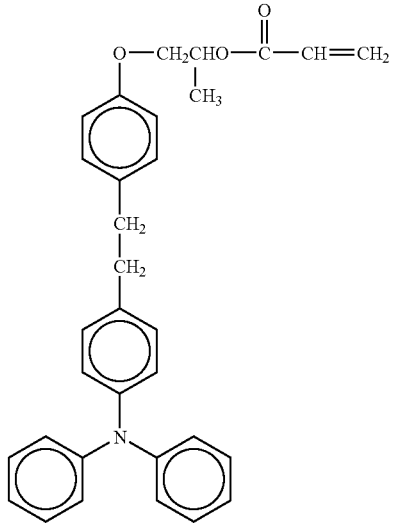
No. 138
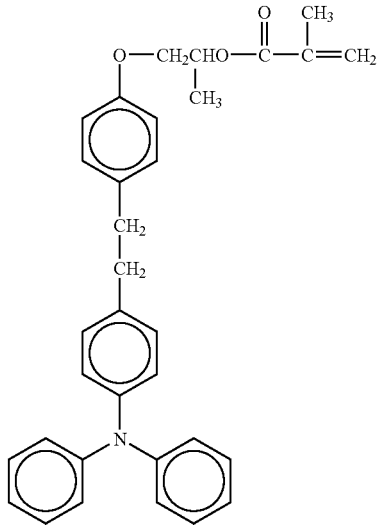

-continued
No. 139
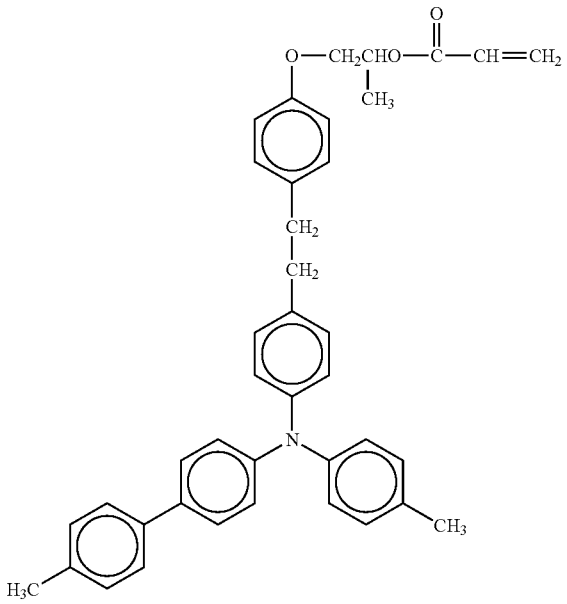
No. 140
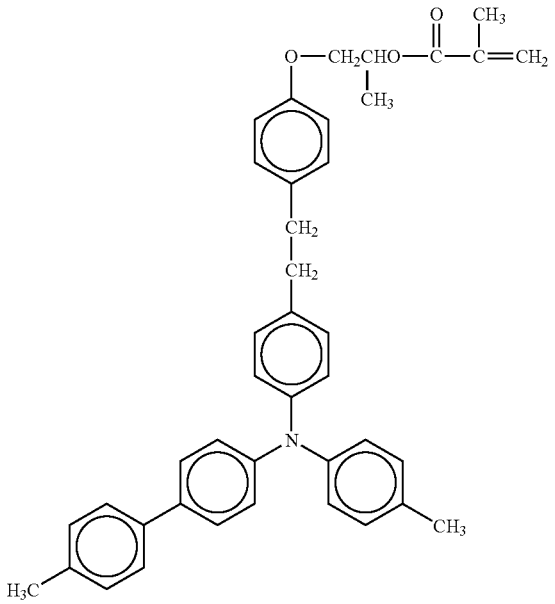
-continued
No. 141
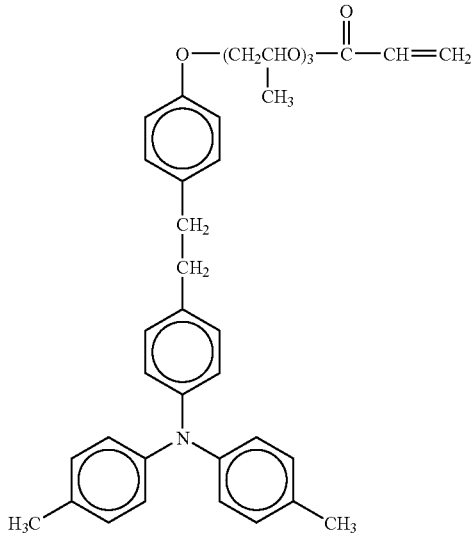
No. 142
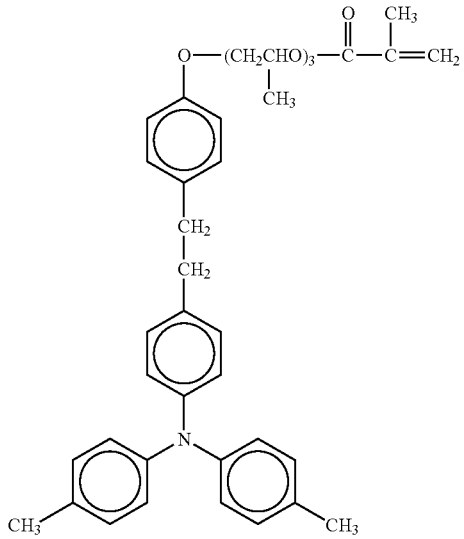
No. 143
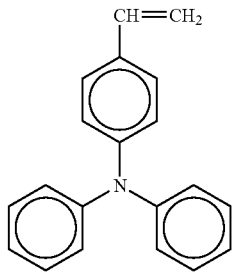

-continued
No. 144
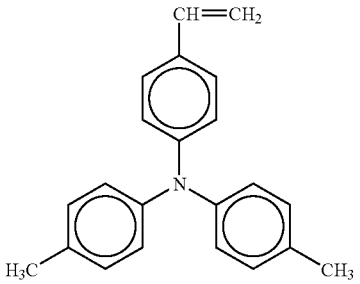
No. 145
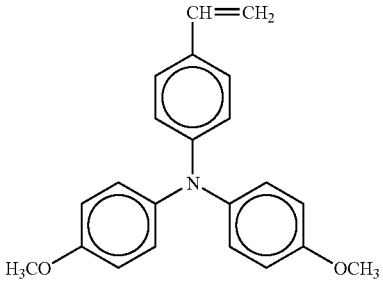
No. 146
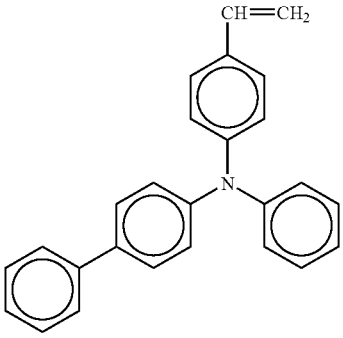
No. 147
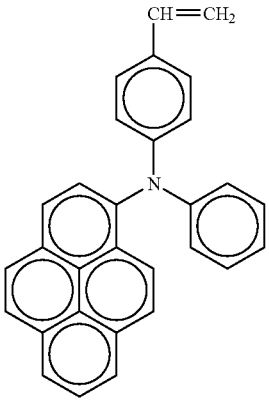
-continued
No. 148
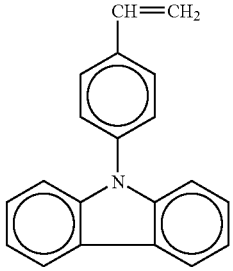
No. 149
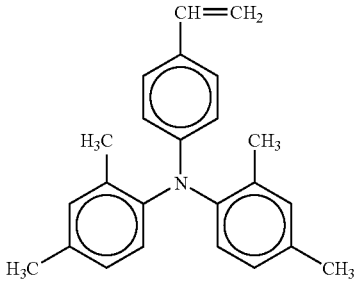
No. 150
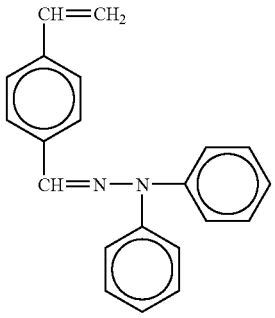
No. 151
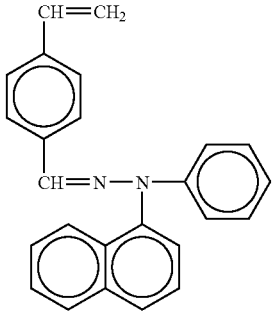

-continued
No. 152
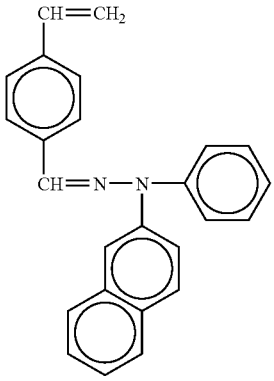
No. 153
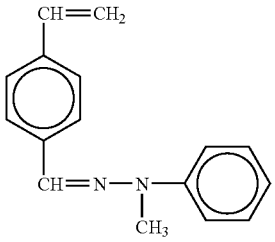
No. 154
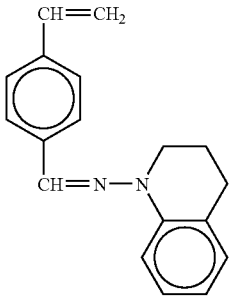
No. 155
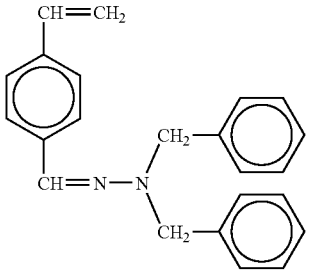
No. 156
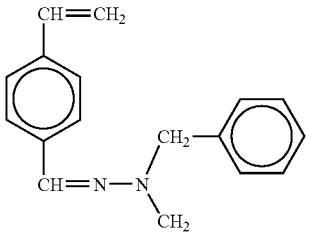
-continued
No. 157
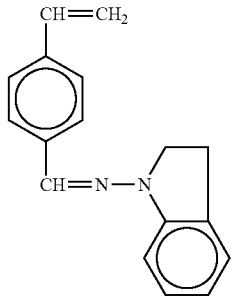
No. 158
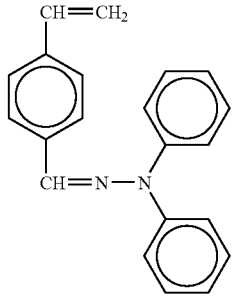
No. 159
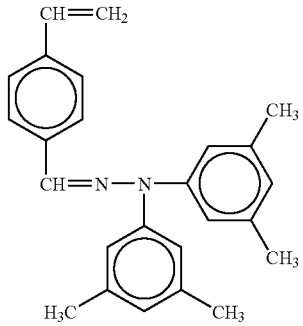
No. 160
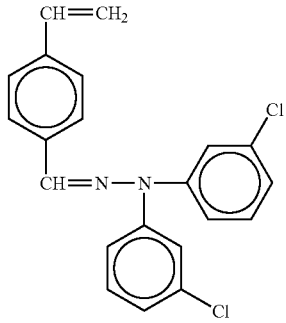
Specific examples of the bifunctional radical polymerizing compound having a charge transportable structure include, but are not limited to, the following materials.

NO. 161
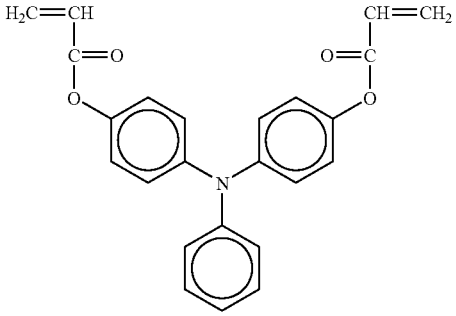
NO. 162
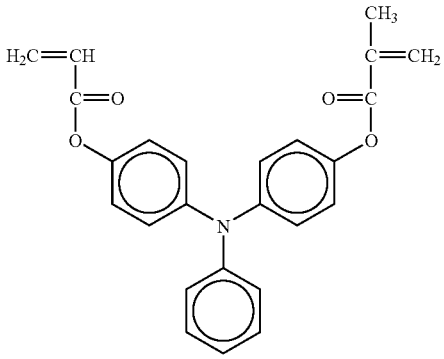
NO. 163
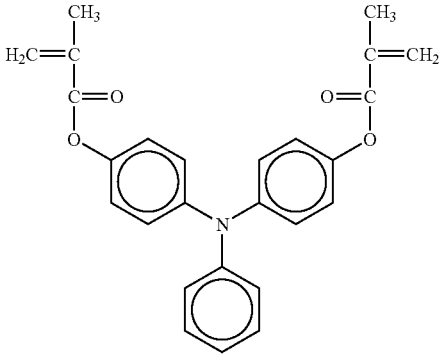
NO. 164
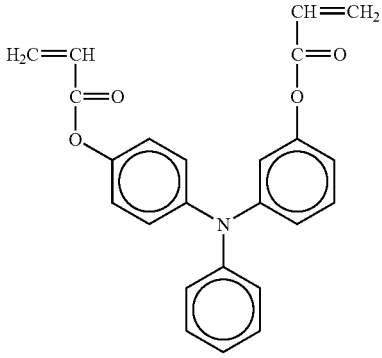
NO. 165
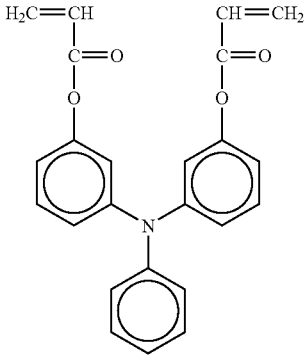
NO. 166
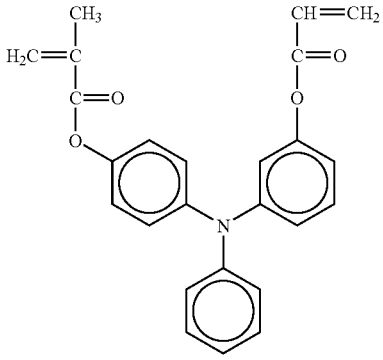
NO. 167
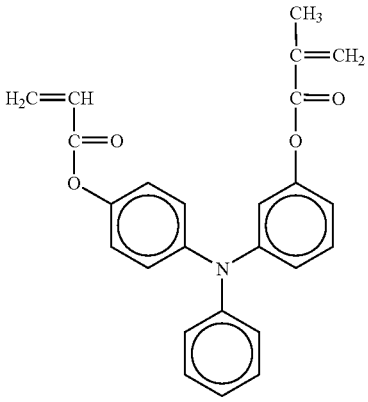
NO. 168
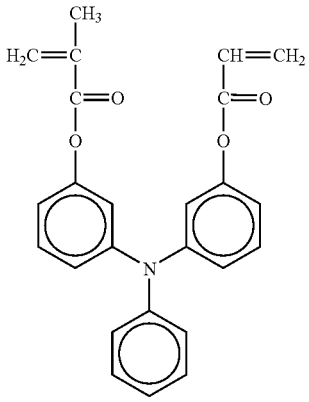

-continued
NO. 169
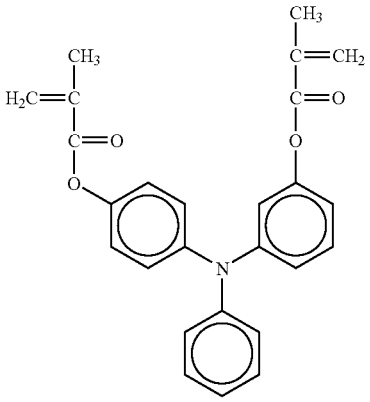
NO. 170
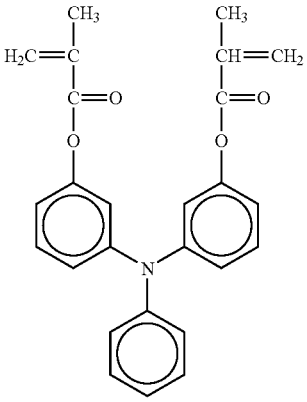
NO. 171
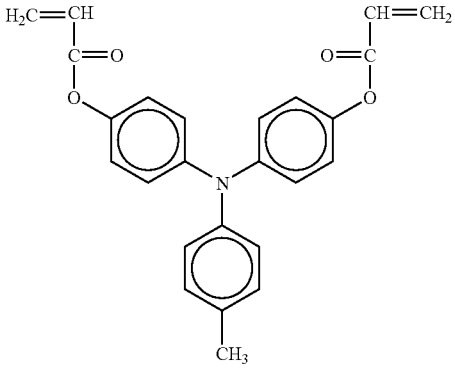
NO. 172
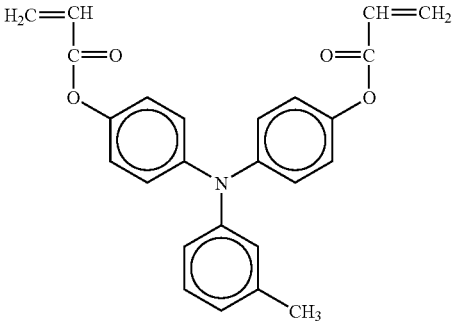
NO. 173
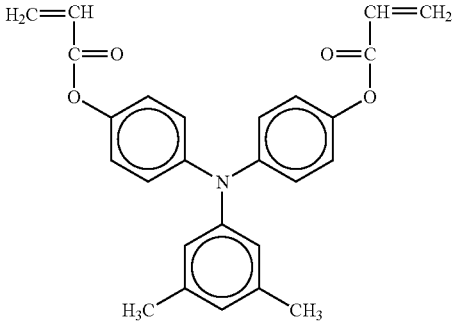
NO. 174
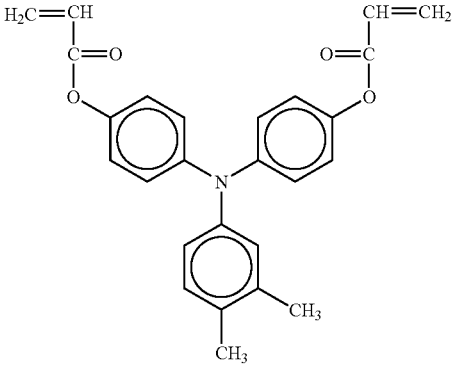
NO. 175
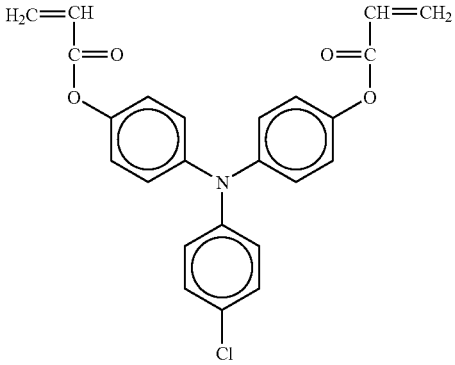
NO. 176
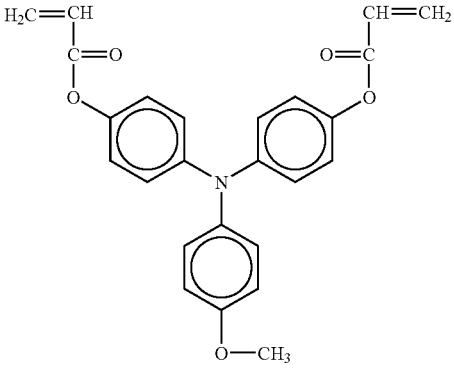

-continued
NO. 177
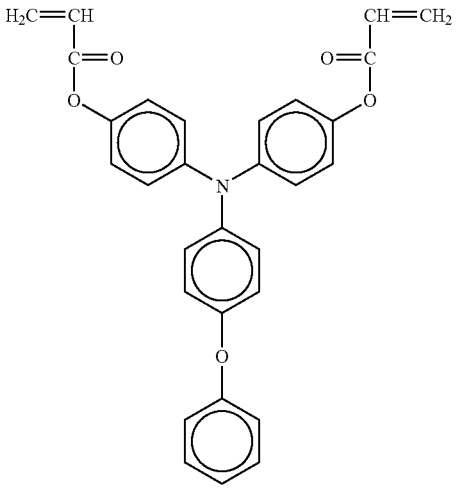
NO. 178
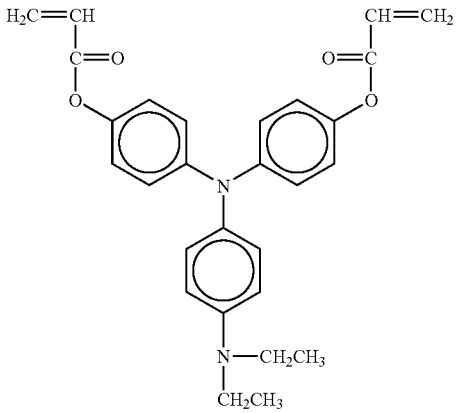
NO. 179
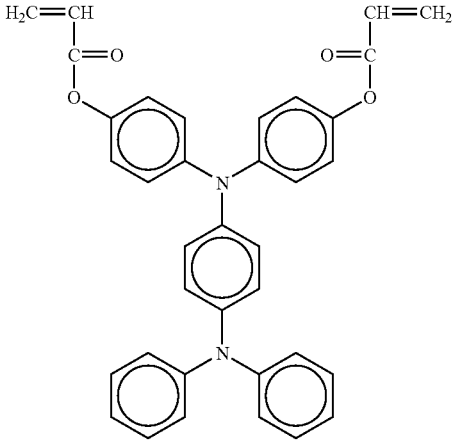
NO. 180
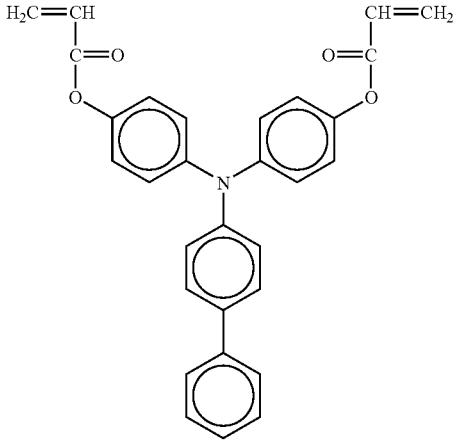
NO. 181
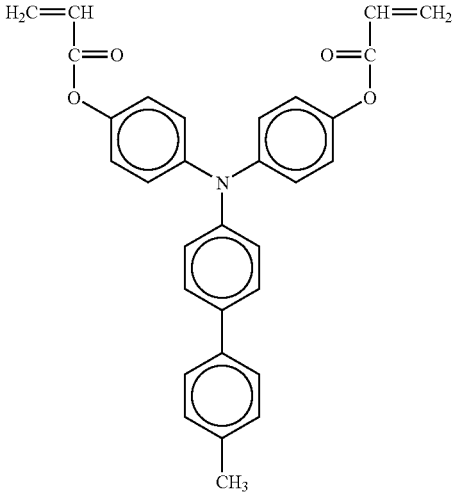
NO. 182
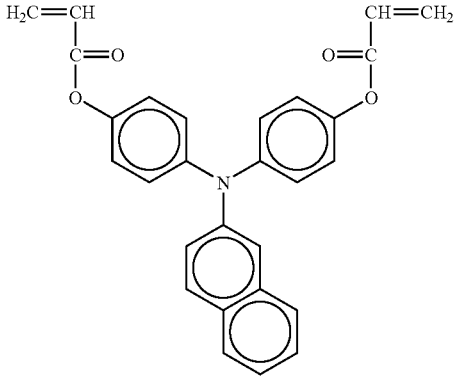

-continued
NO. 183
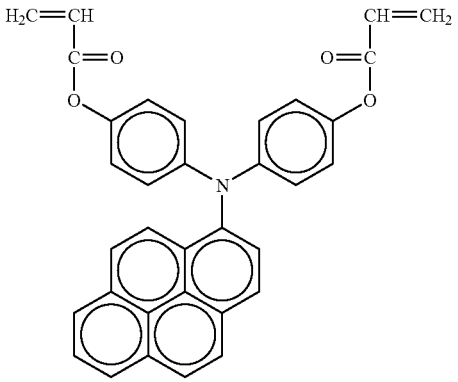
NO. 184
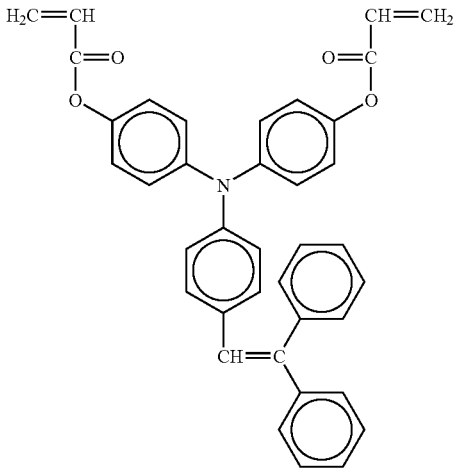
NO. 185
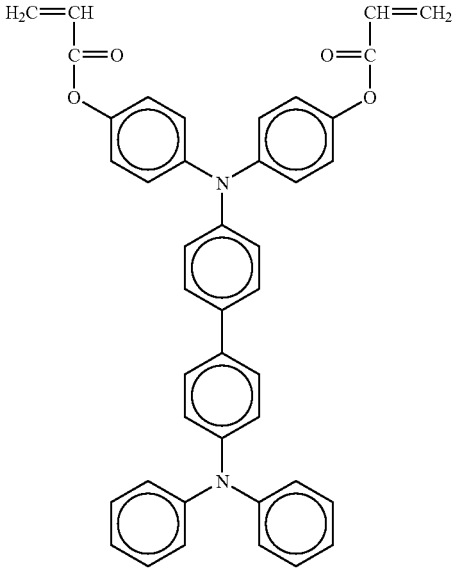
NO. 186
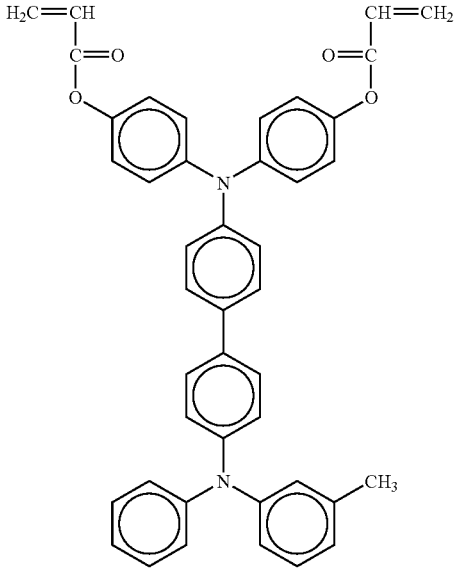
NO. 187
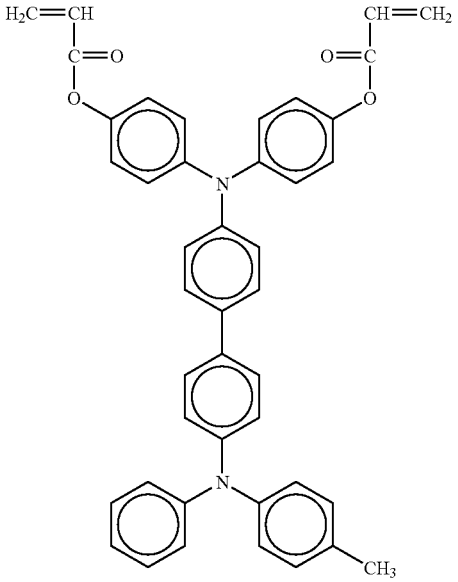
NO. 188
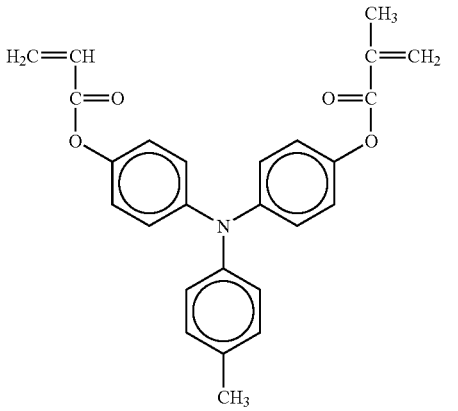

-continued
NO. 189
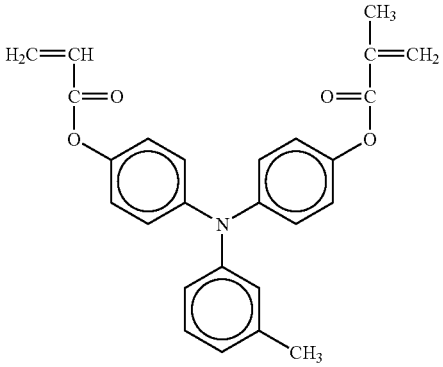
NO. 190
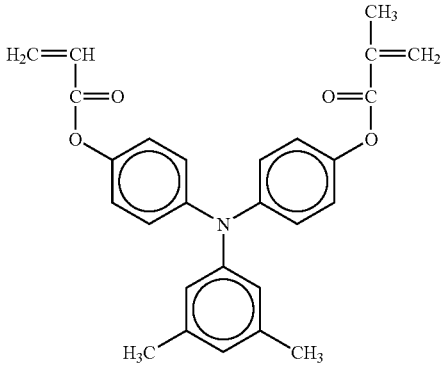
NO. 191
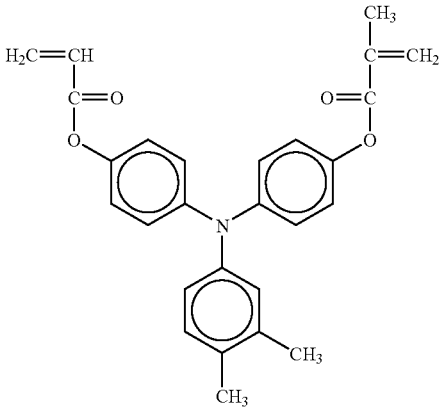
NO. 192
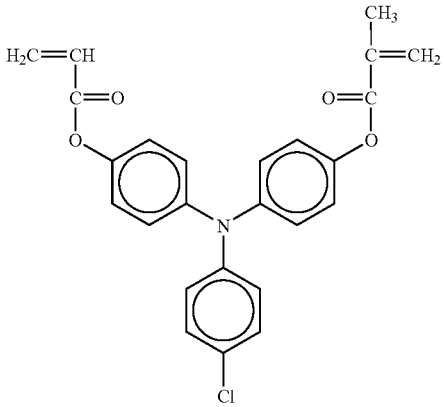
NO. 193
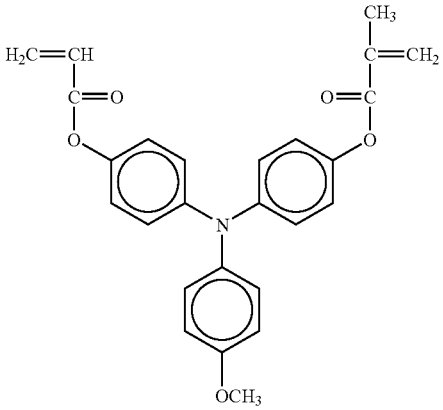
NO. 194
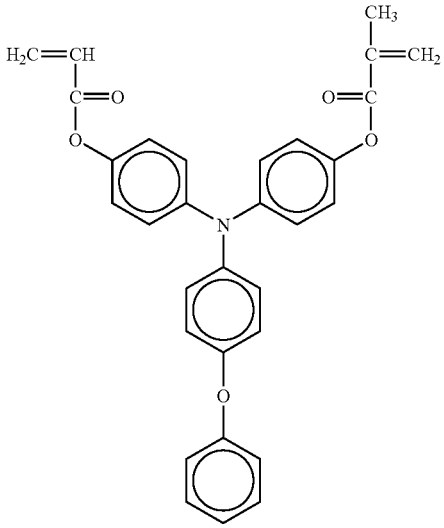

-continued
NO. 195
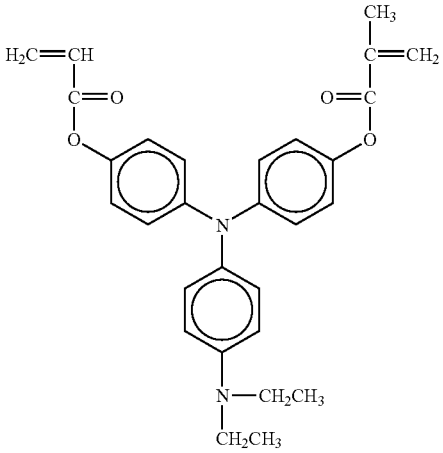
NO. 196
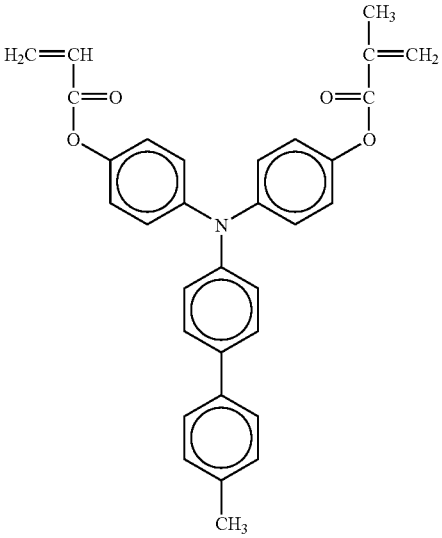
NO. 197
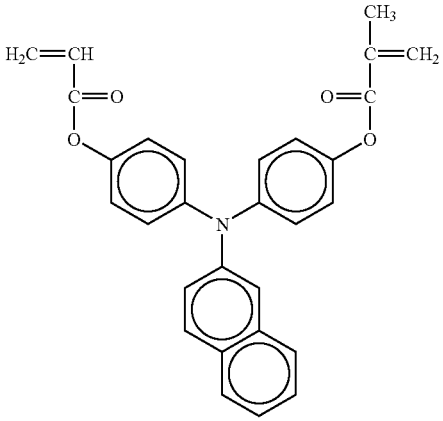
NO. 198
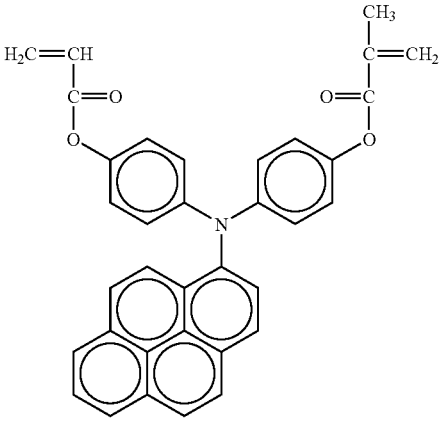
NO. 199
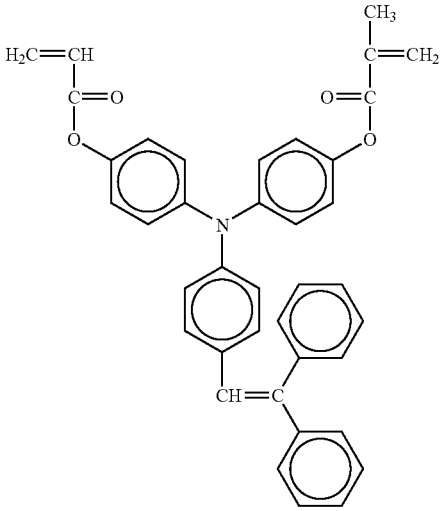
NO. 200
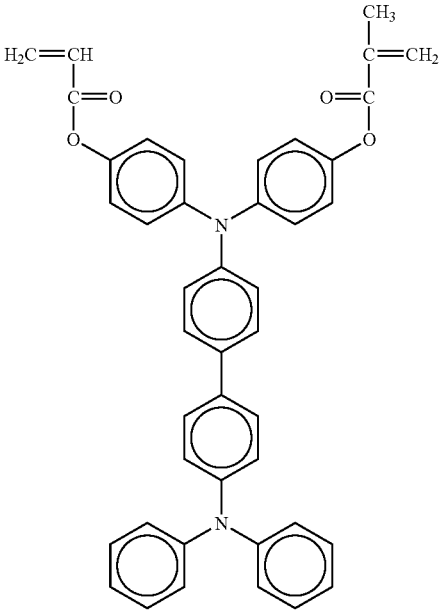

-continued
NO. 201
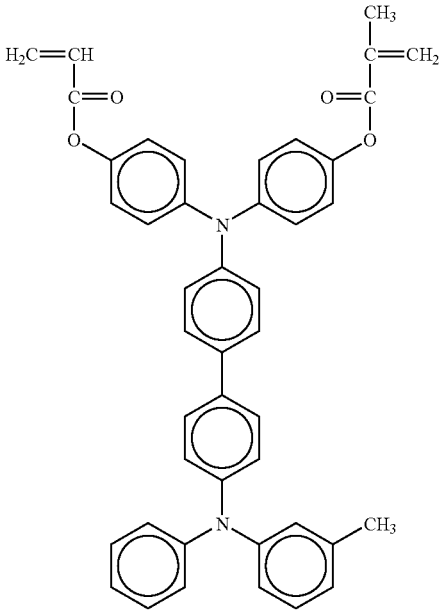
NO. 202
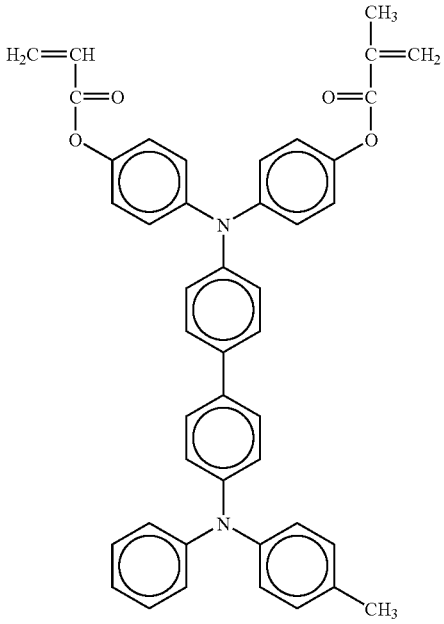
NO. 203
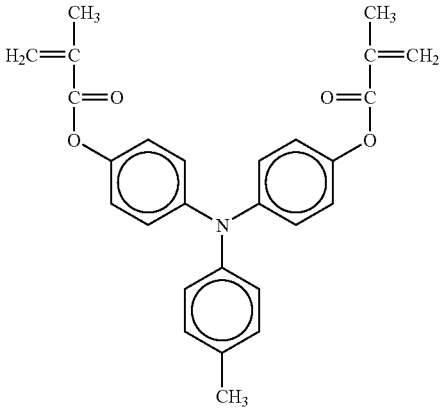
NO. 204
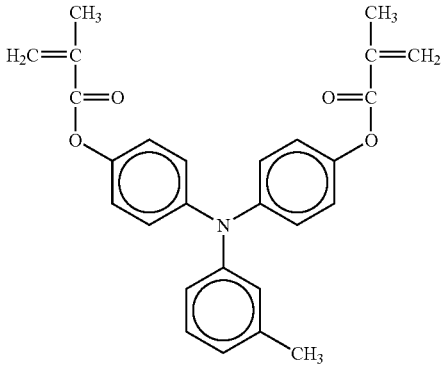
NO. 205
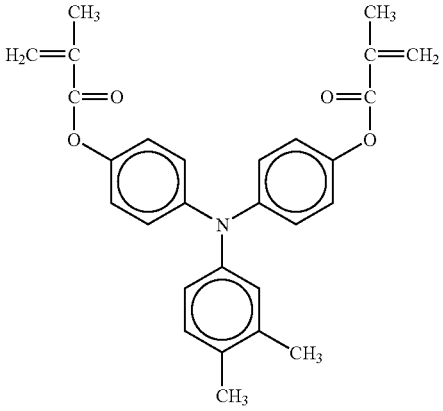
NO. 206
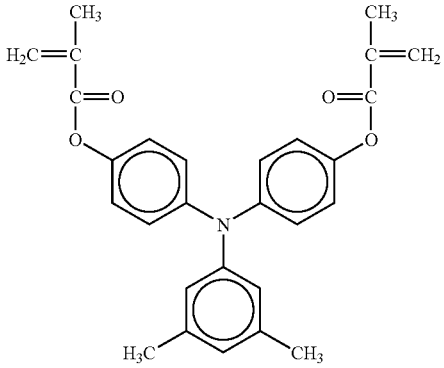

-continued
NO. 207
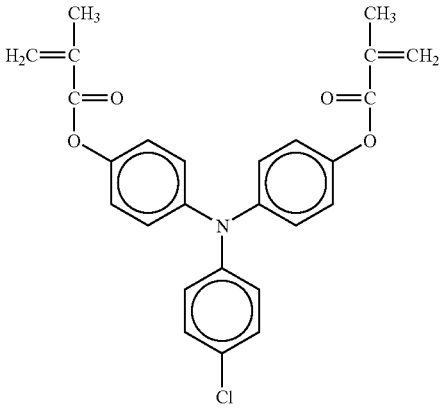
NO. 208
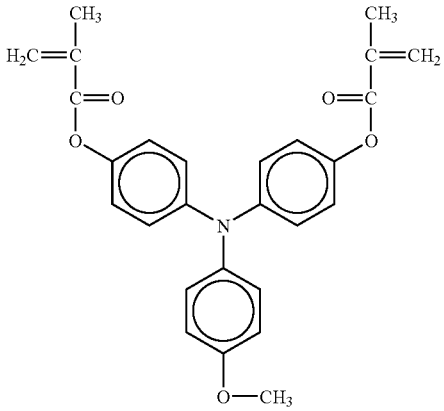
NO. 209
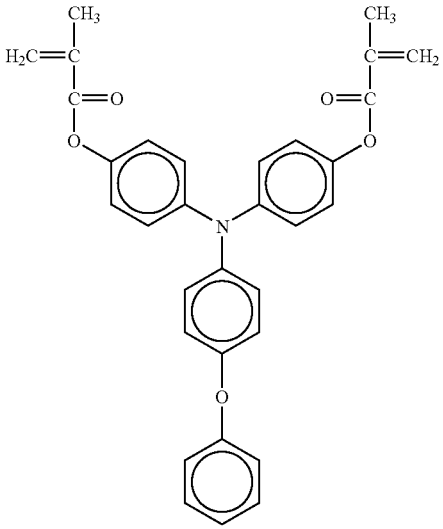
NO. 210
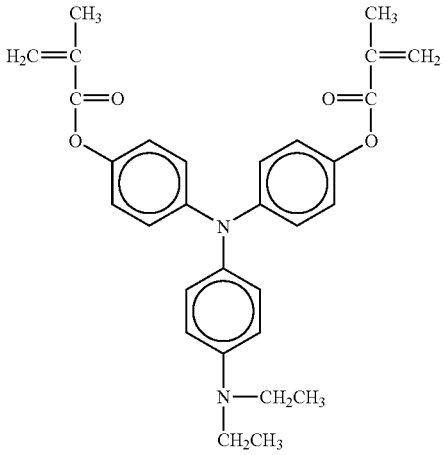
NO. 211
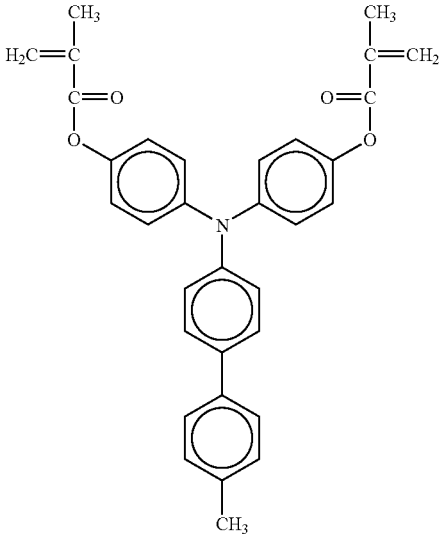
NO. 212
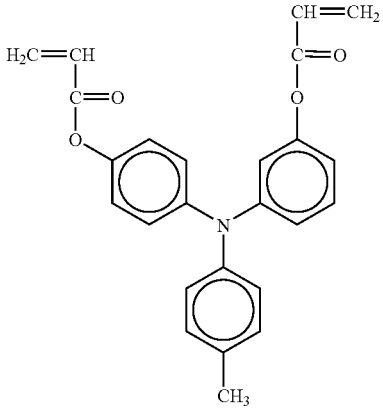

-continued
NO. 213
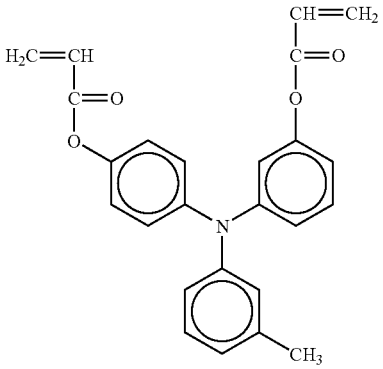
NO. 214
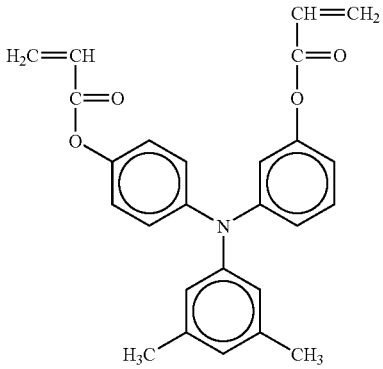
NO. 215
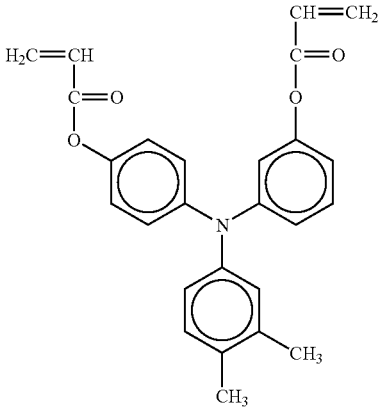
NO. 216
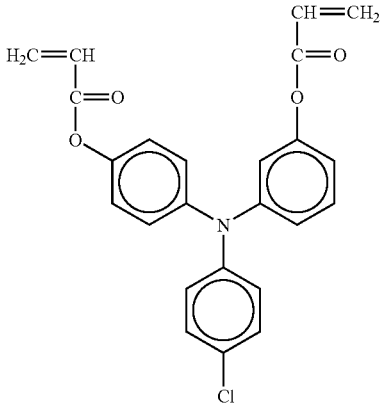
NO. 217
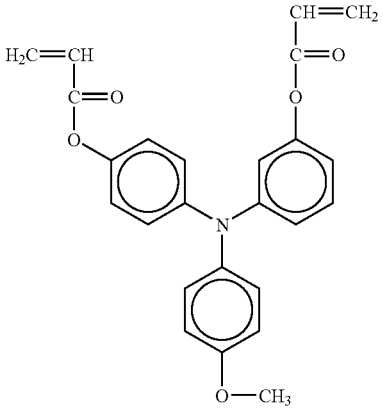
NO. 218
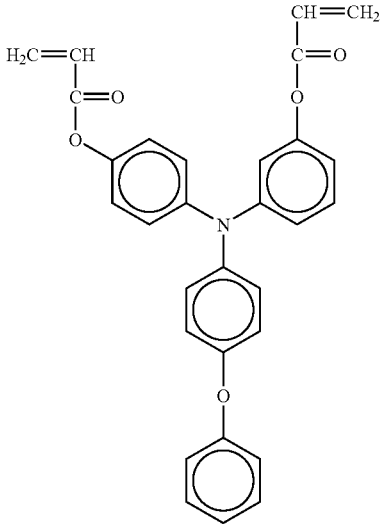

-continued
NO. 219
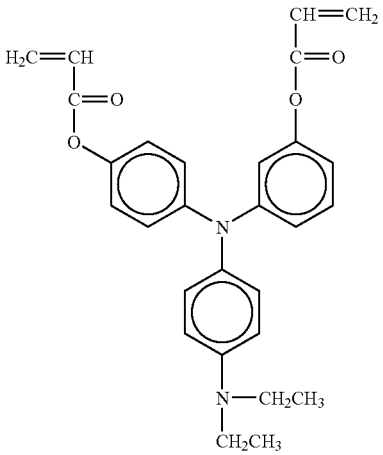
NO. 220
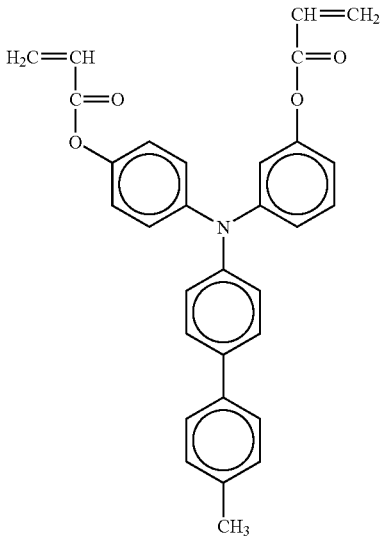
NO. 221
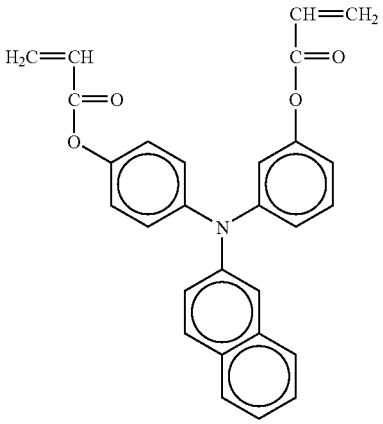
NO. 222
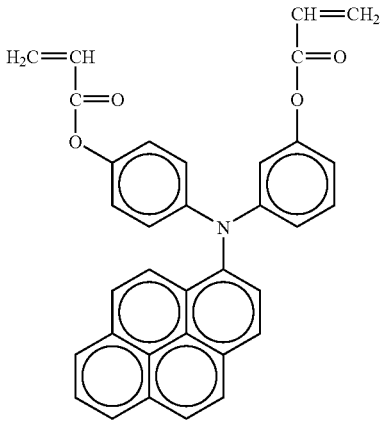
NO. 223
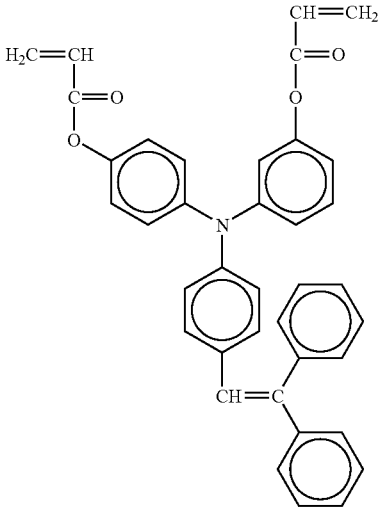
NO. 224
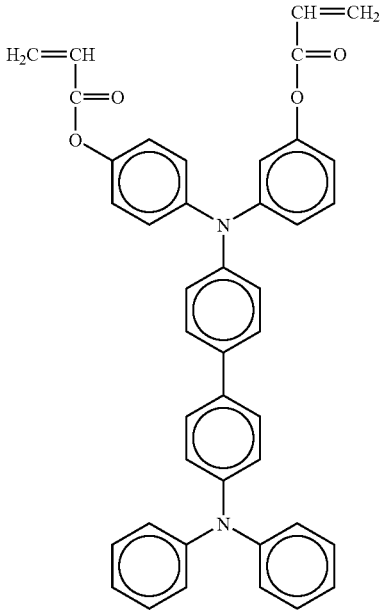

-continued
NO. 225
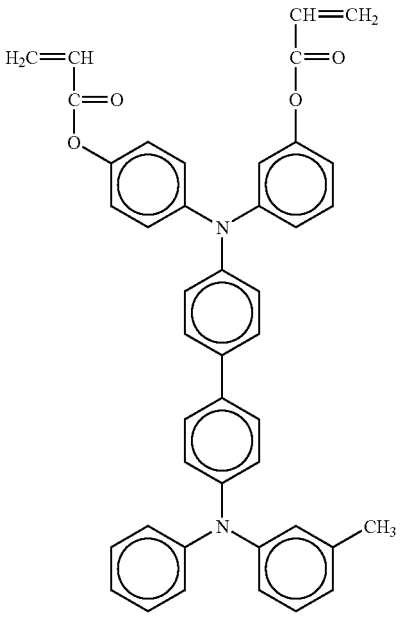
NO. 226
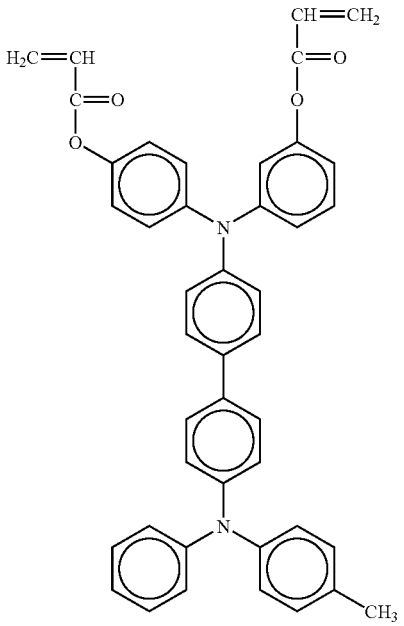
NO. 227
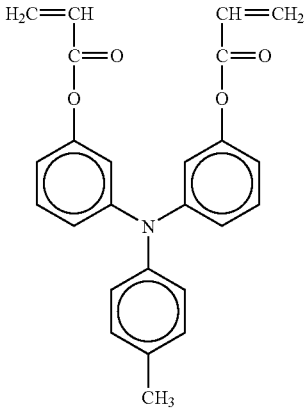
NO. 228
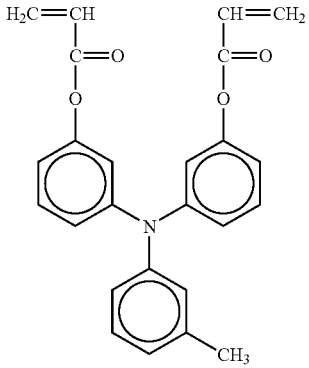
NO. 229
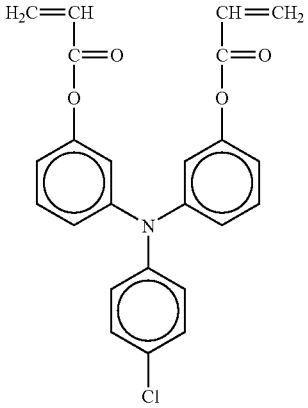
NO. 230
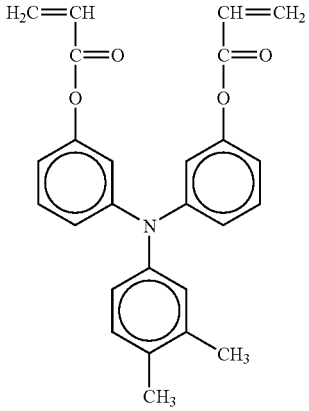

-continued
NO. 231
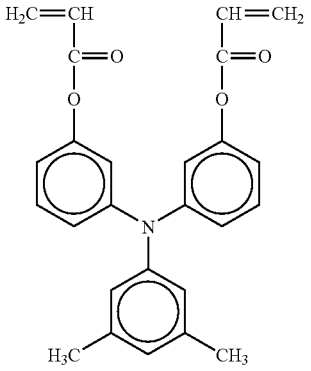
NO. 232
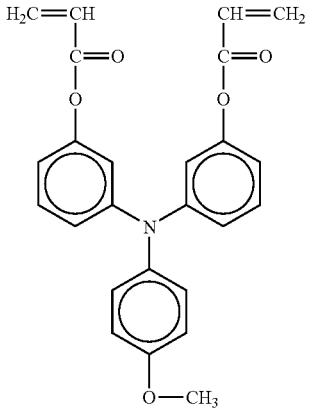
NO. 233
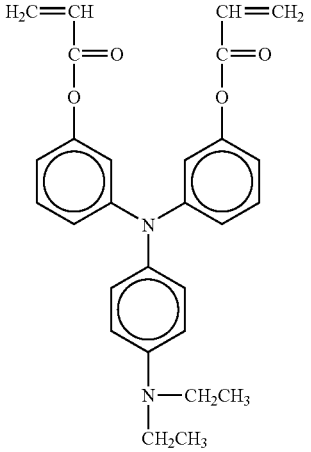
NO. 234
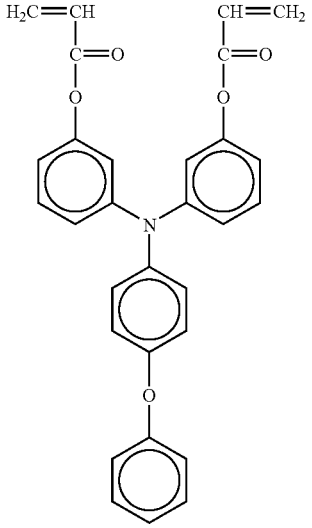
NO. 235
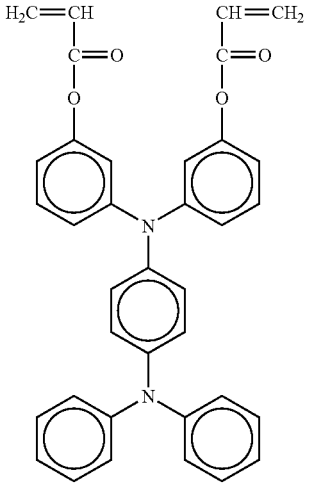
NO. 236
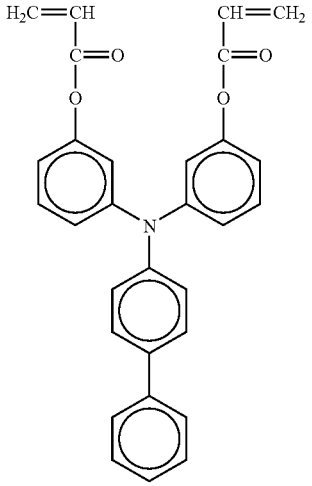

-continued
NO. 237
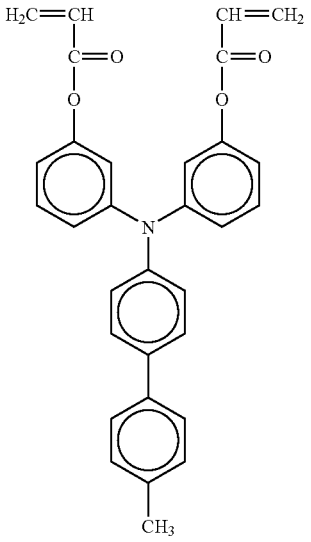
NO. 238
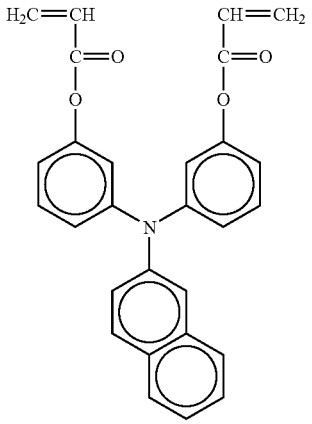
NO. 239
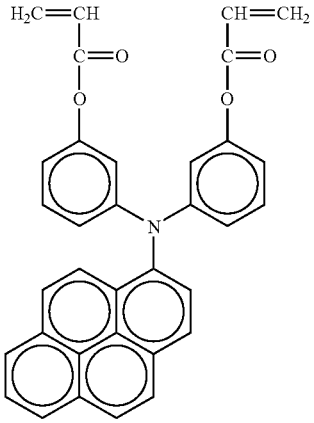
NO. 240
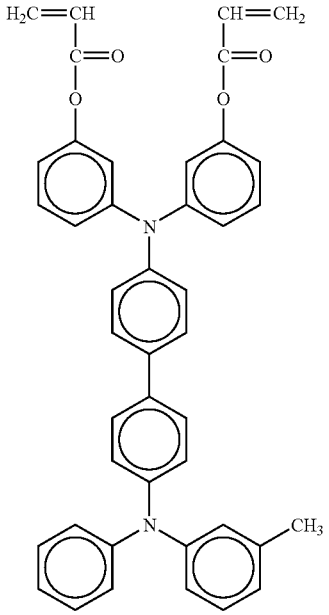

-continued
NO. 241
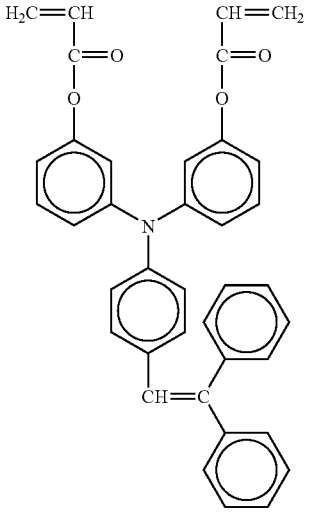
NO. 242
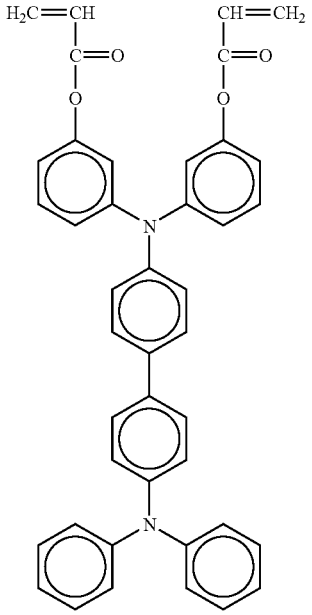
NO. 243
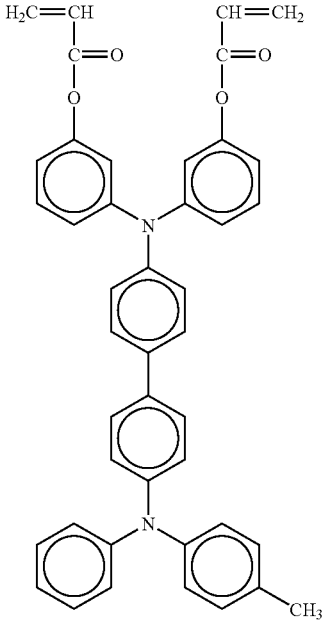

-continued
NO. 244
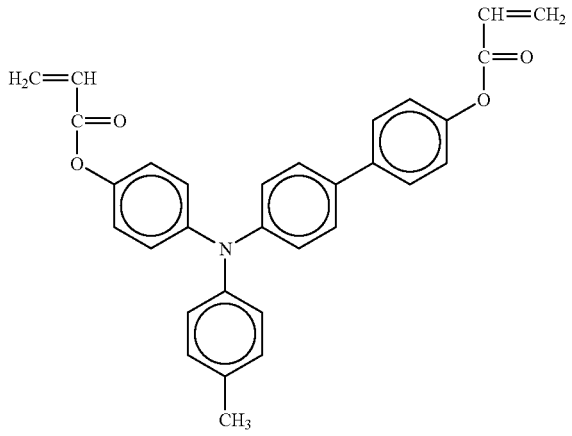
NO. 245
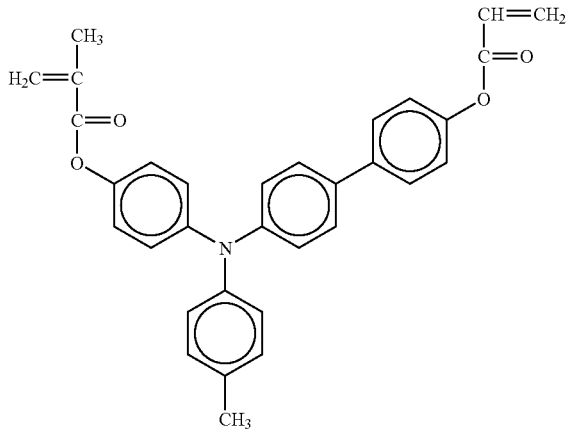
NO. 246
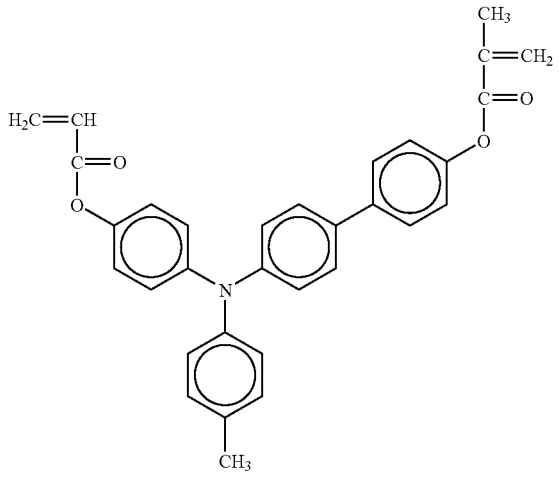

-continued
NO. 247
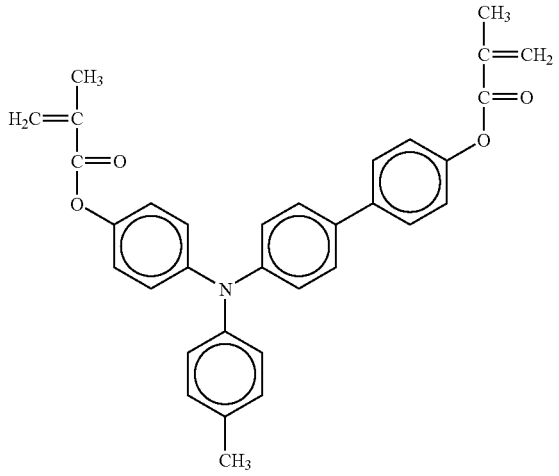
NO. 248
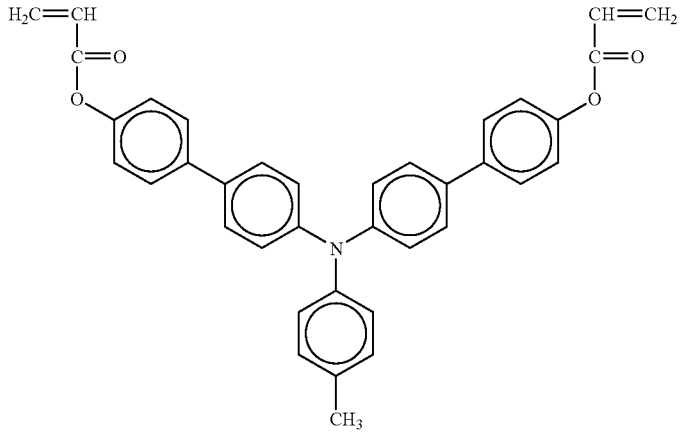
NO. 249
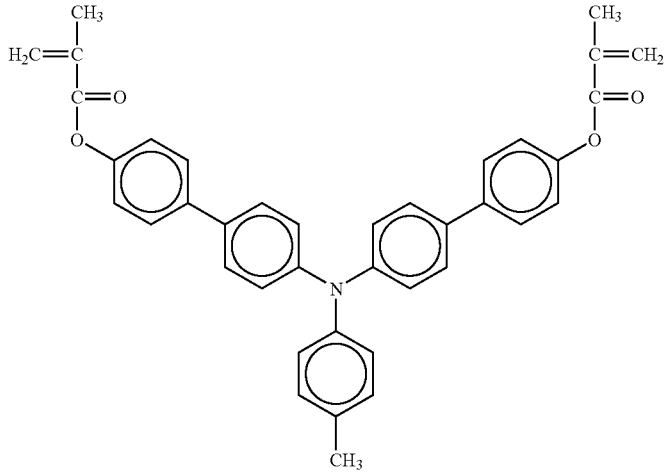

-continued
NO. 250
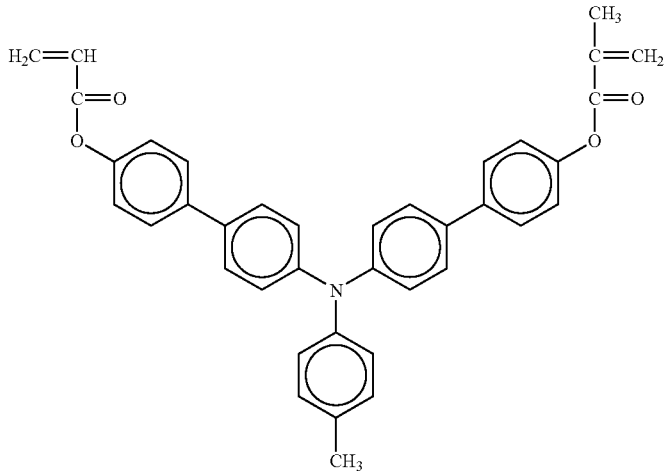
NO. 251
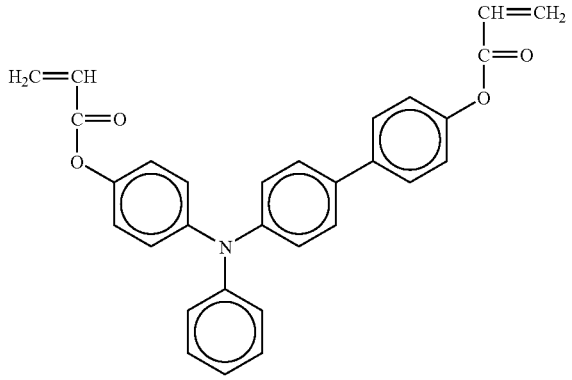
NO. 252
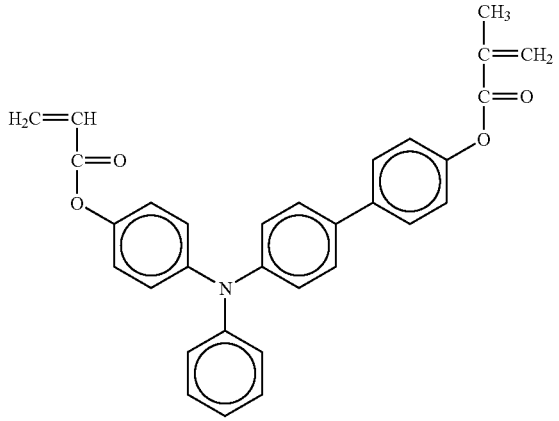

-continued
NO. 253
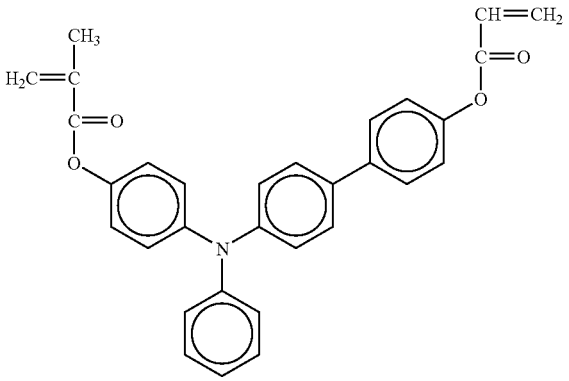
NO. 254
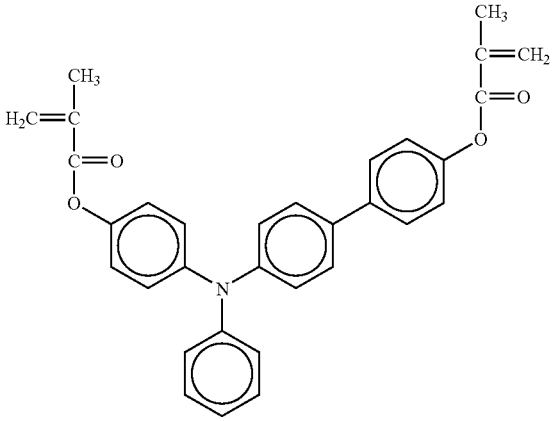
NO. 255
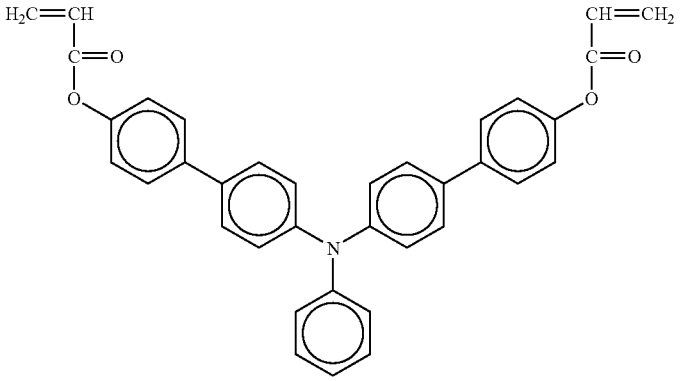
NO. 256
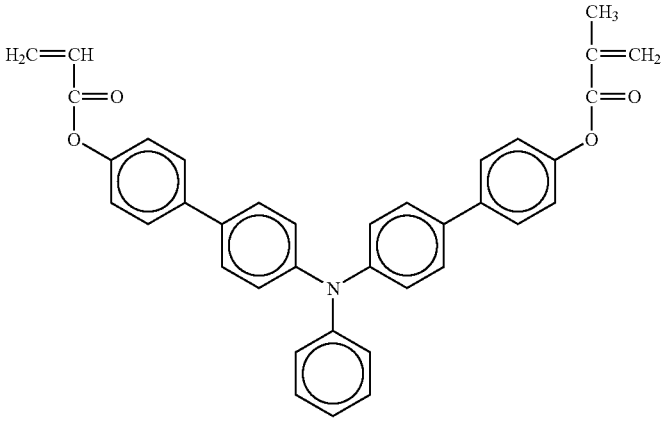

-continued
NO. 257
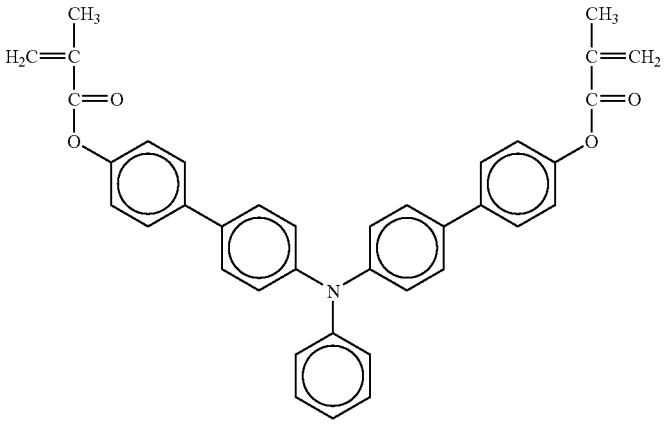
NO. 258
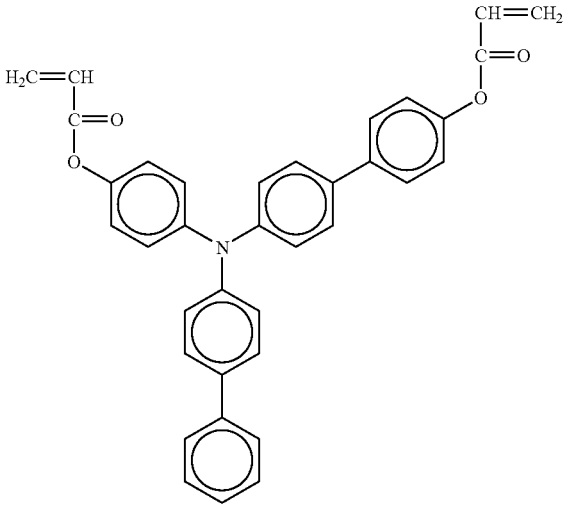
NO. 259
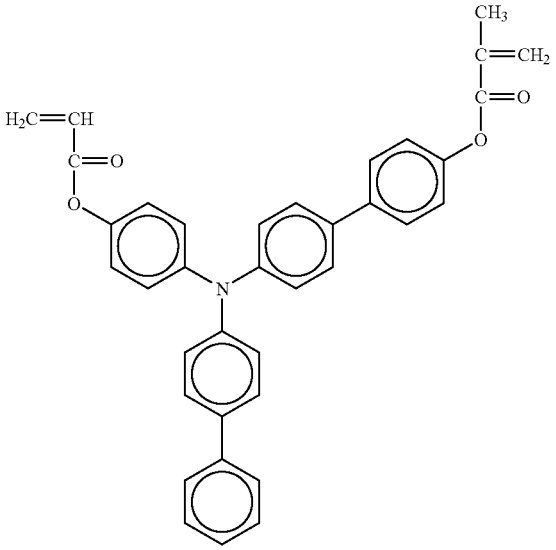

-continued
NO. 260
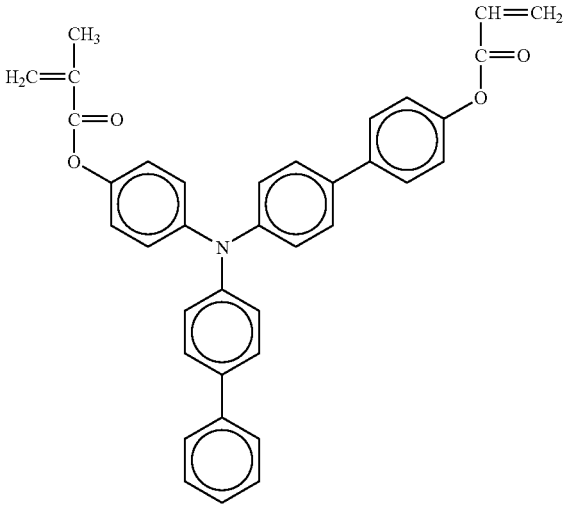
NO. 261
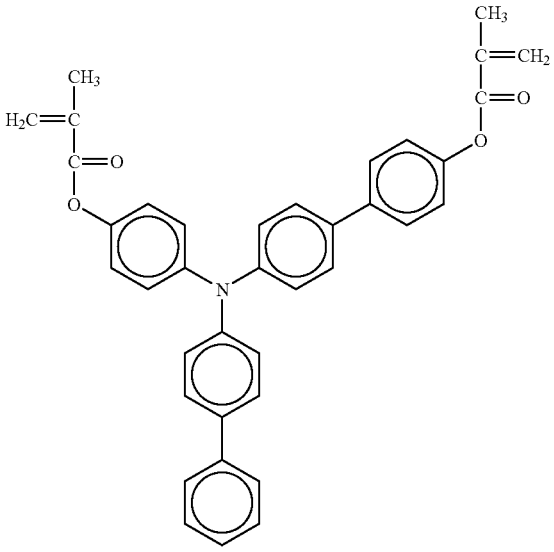
NO. 262
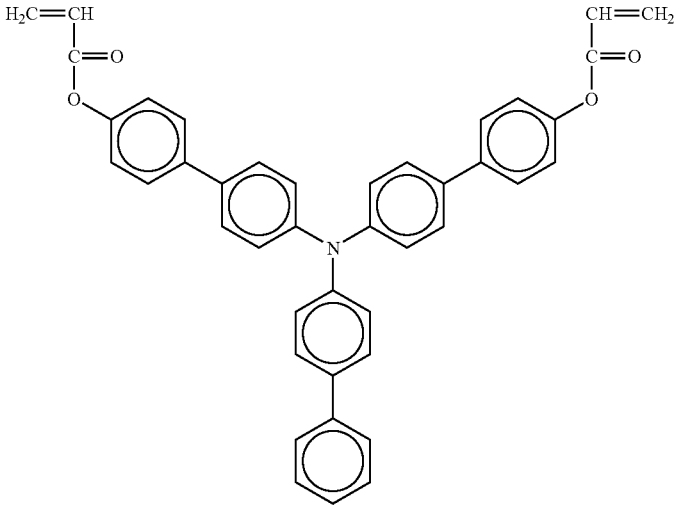

-continued
NO. 263
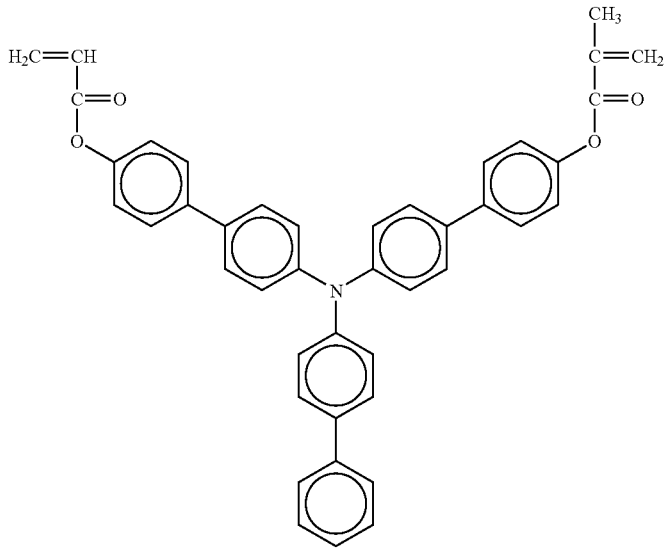
NO. 264
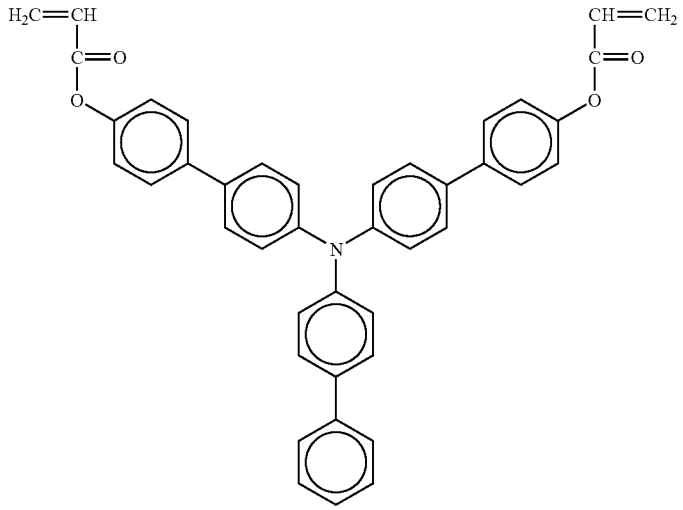
NO. 265
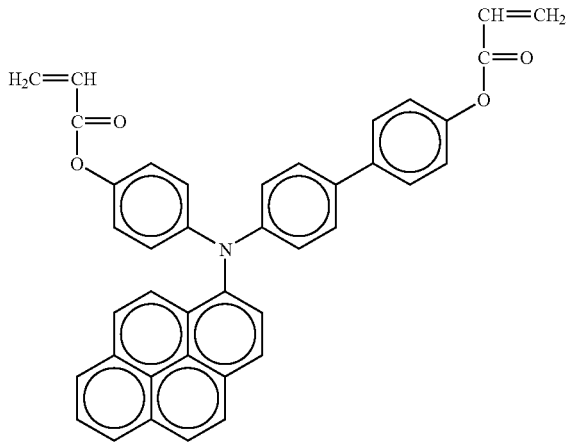

-continued
NO. 266
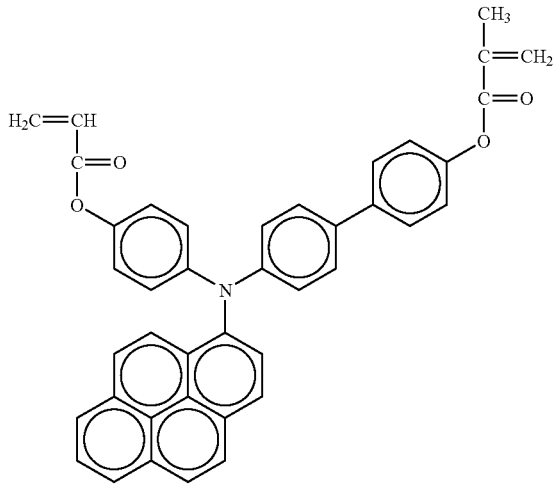
NO. 267
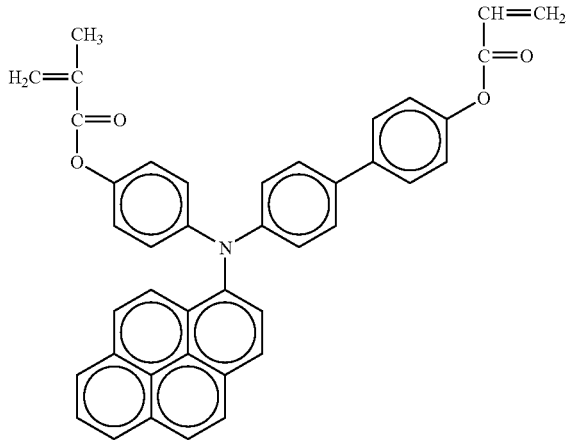
NO. 268
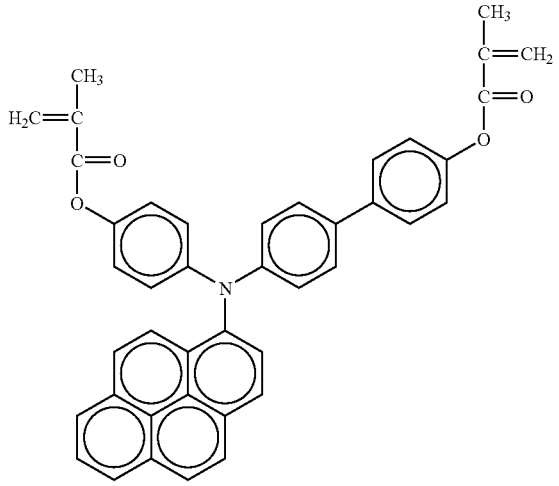

-continued
NO. 269
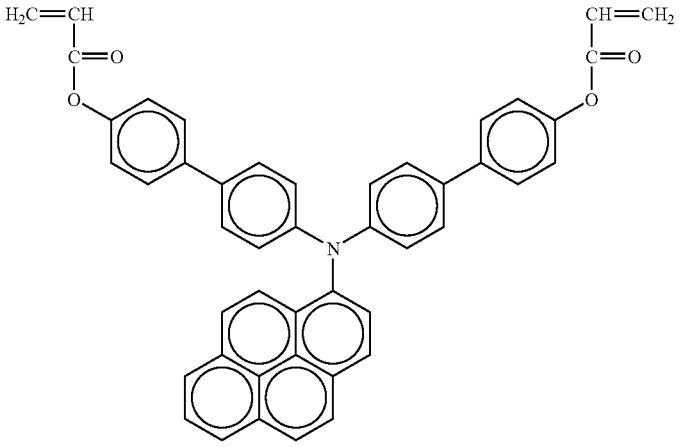
NO. 270
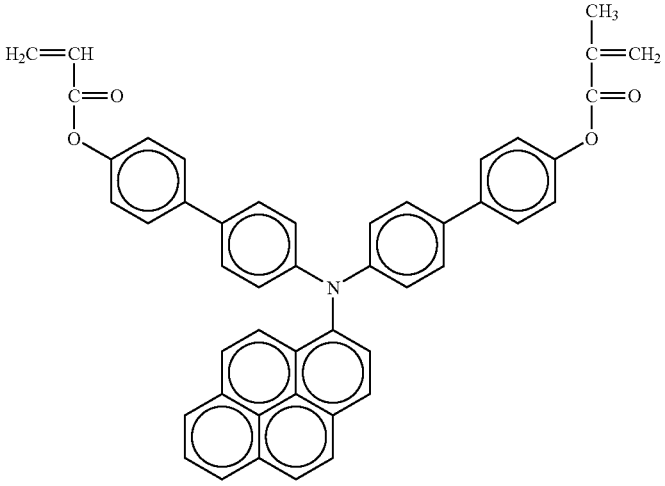
NO. 271
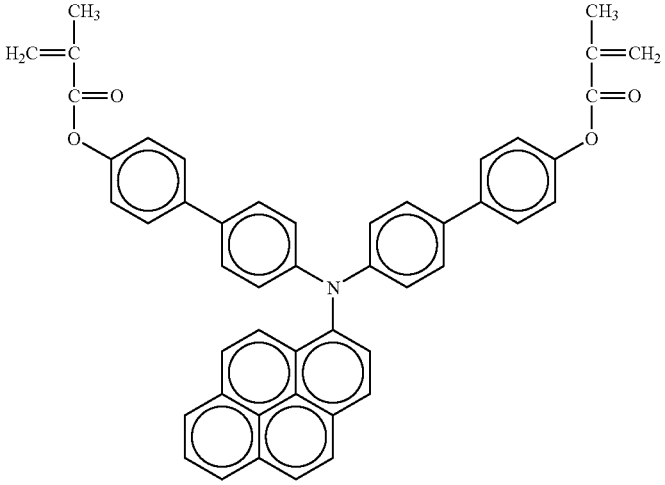

-continued
NO. 272
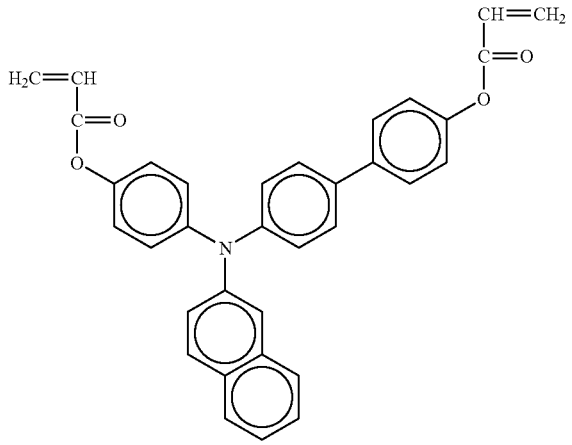
NO. 273
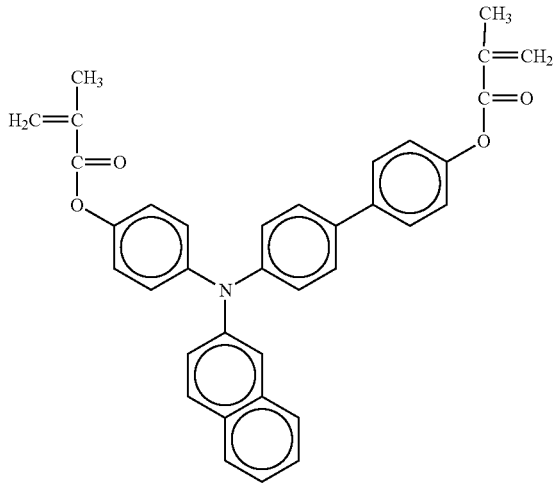
NO. 274
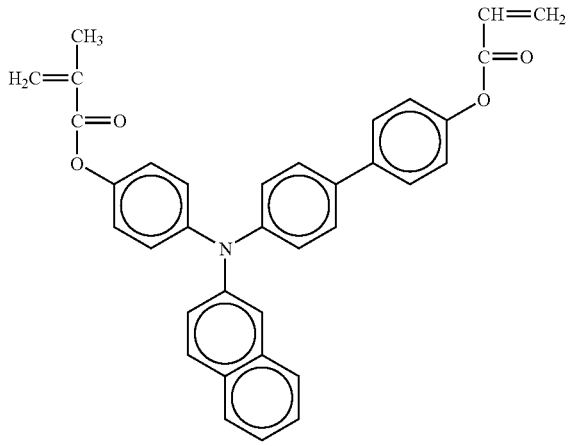

-continued
NO. 275
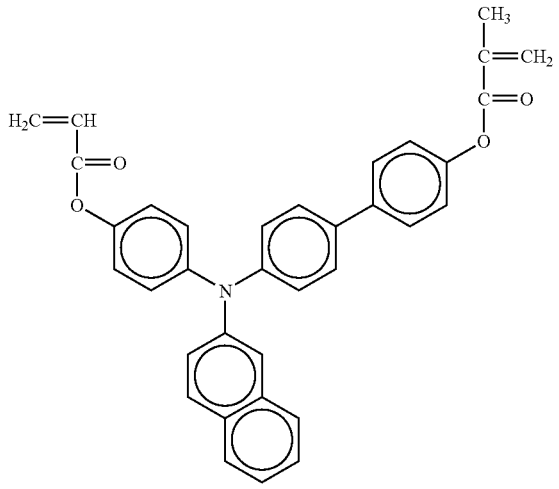
NO. 276
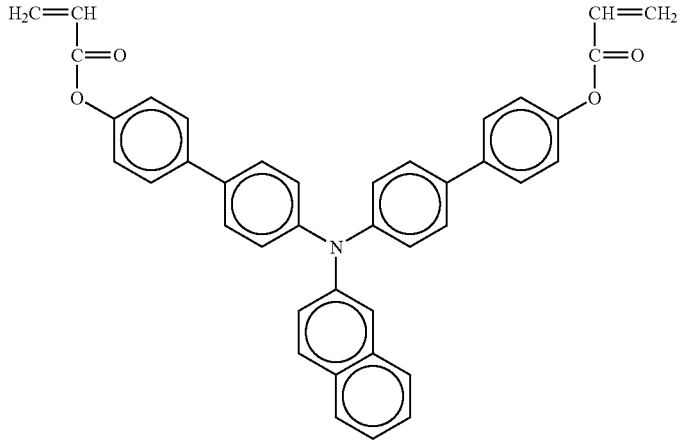
NO. 277
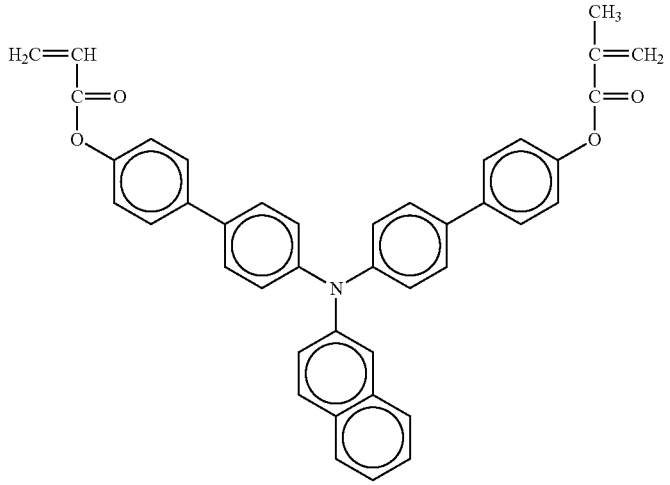

-continued
NO. 278
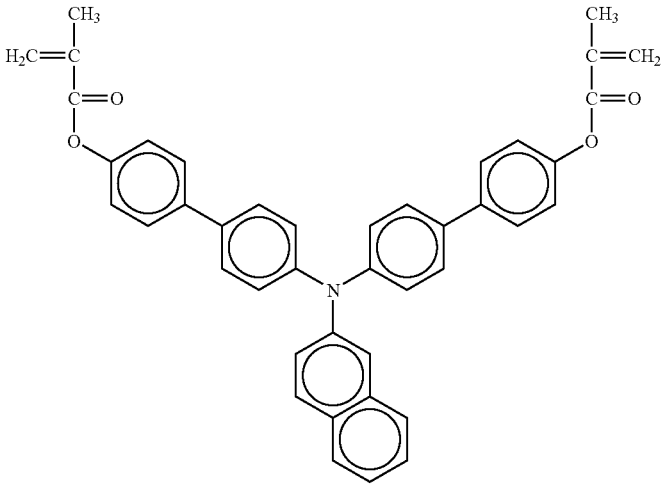
NO. 279
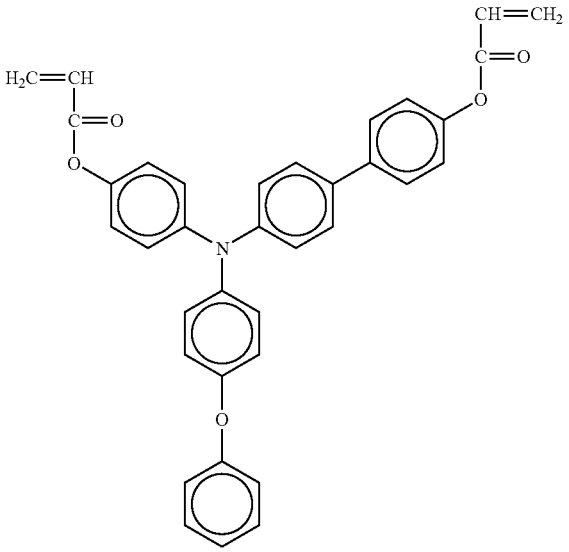
NO. 280
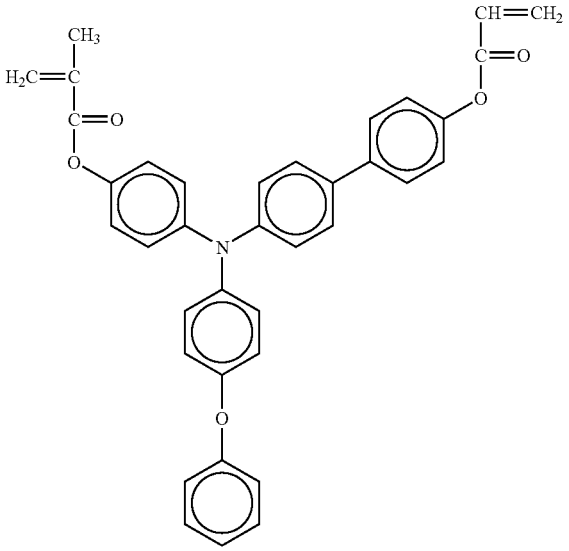

-continued
NO. 281
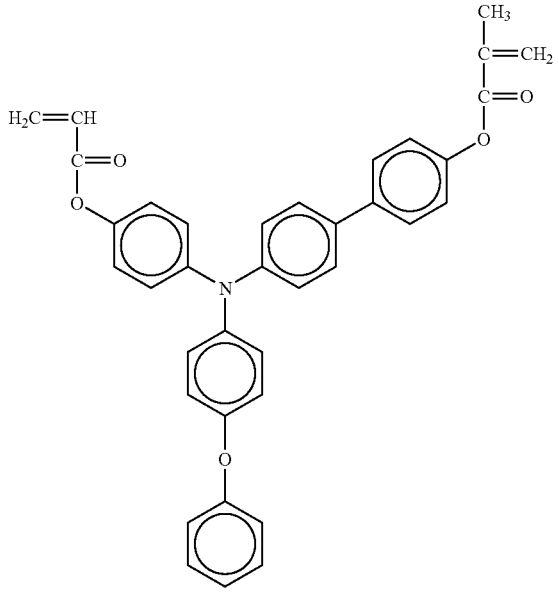
NO. 282
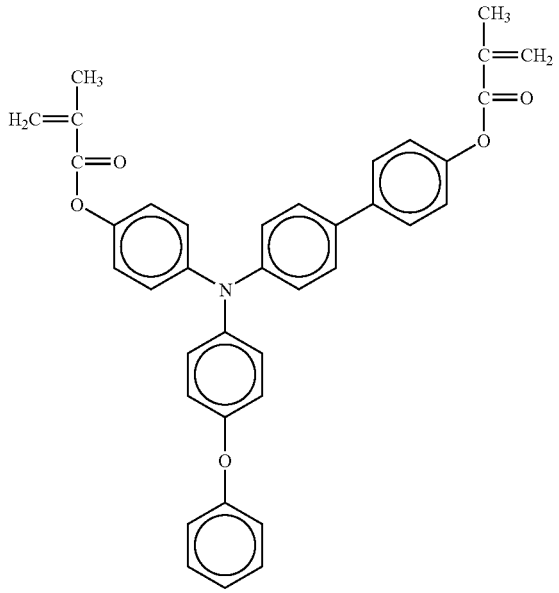

-continued
NO. 283
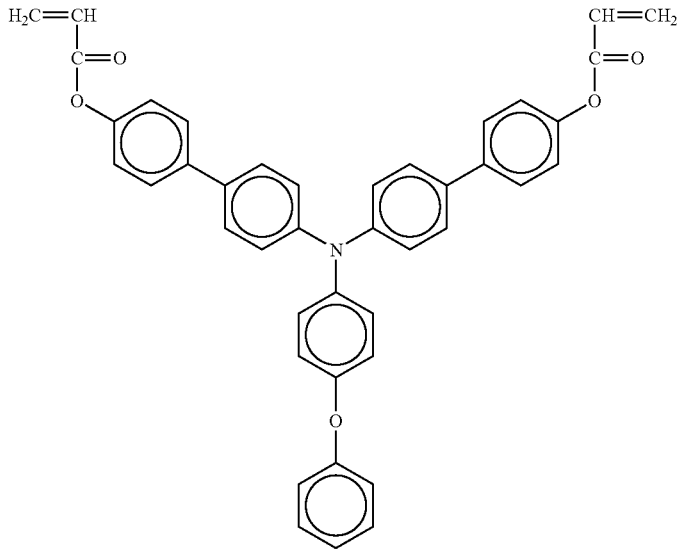
NO. 284
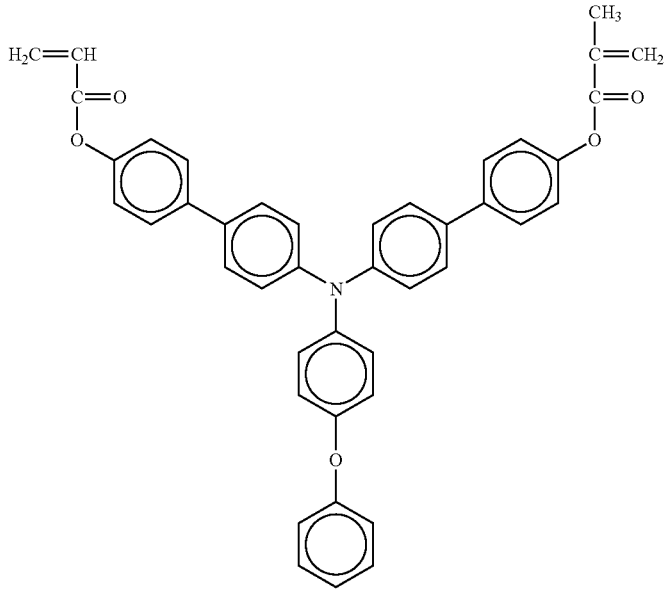

-continued
NO. 285
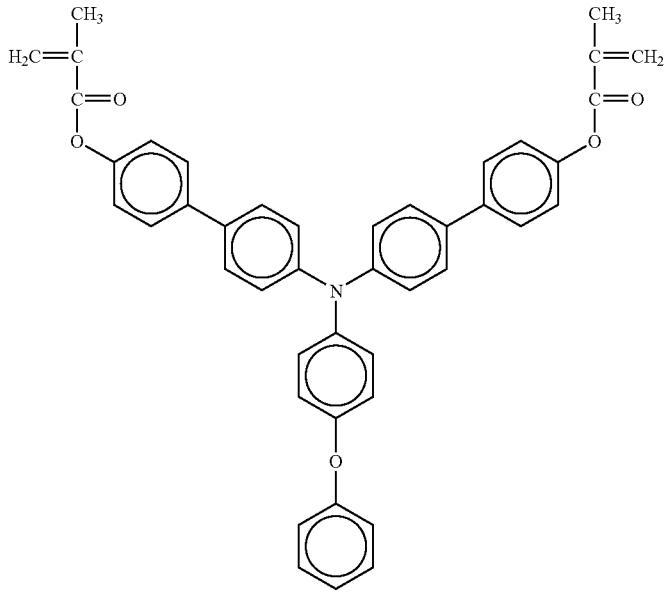
NO. 286
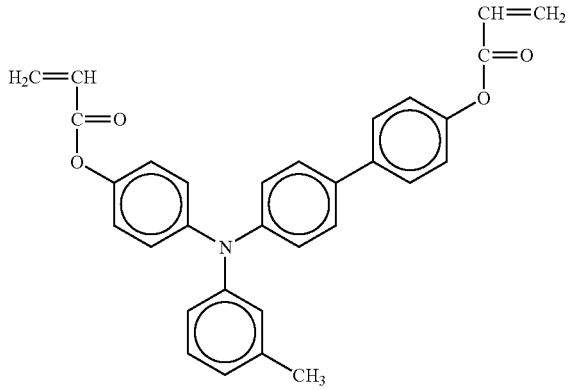
NO. 287
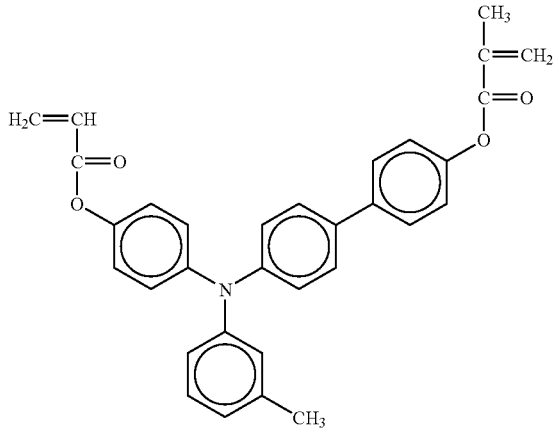

-continued
NO. 288
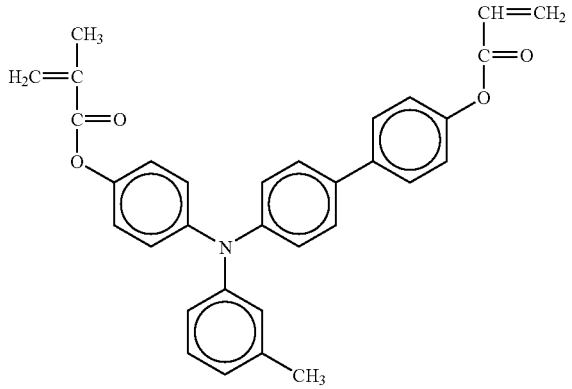
NO. 289
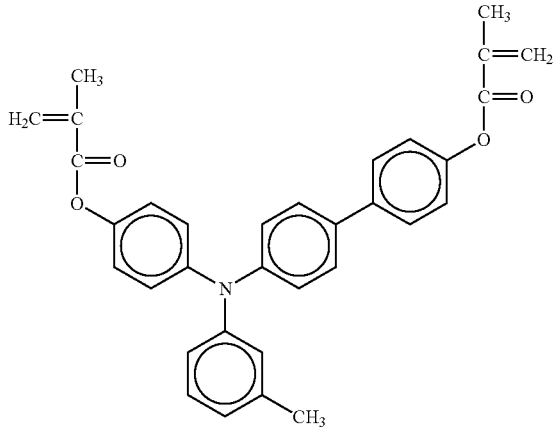
NO. 290
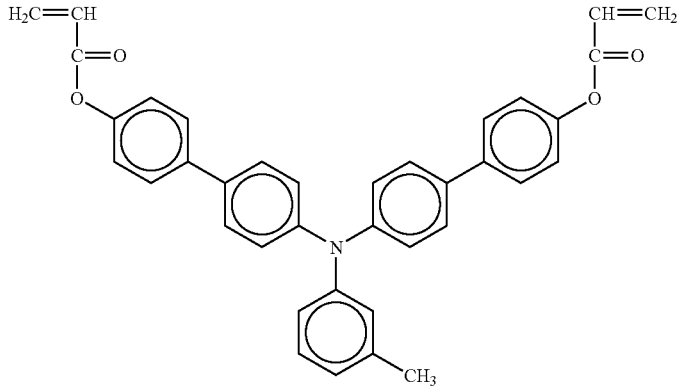

-continued
NO. 291
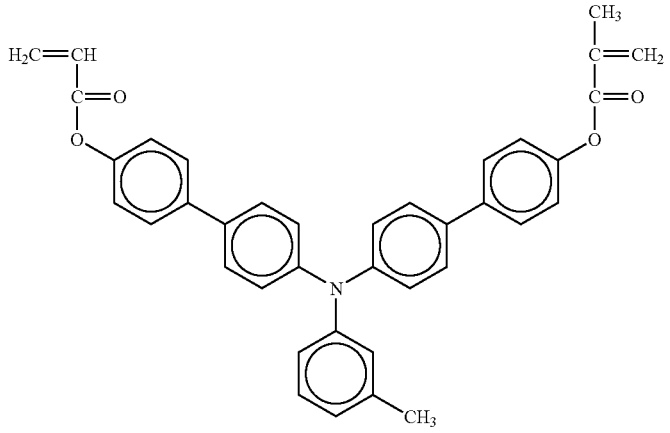
NO. 292
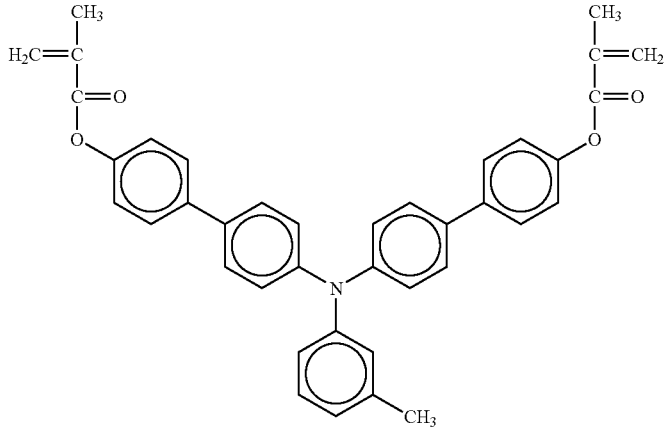
NO. 293
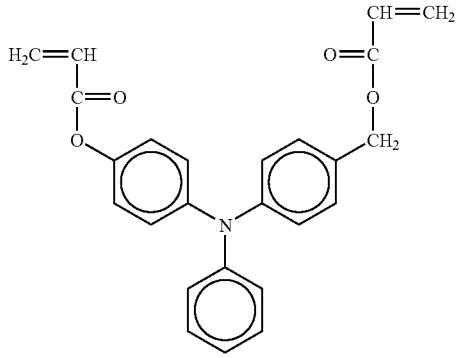
NO. 294
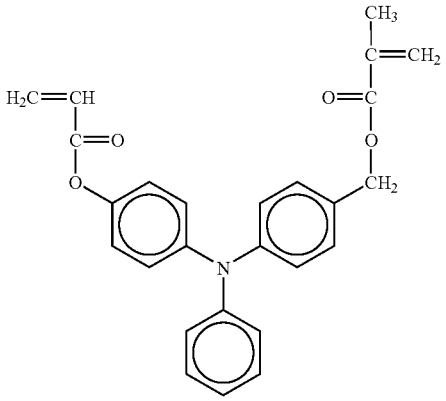

-continued
NO. 295
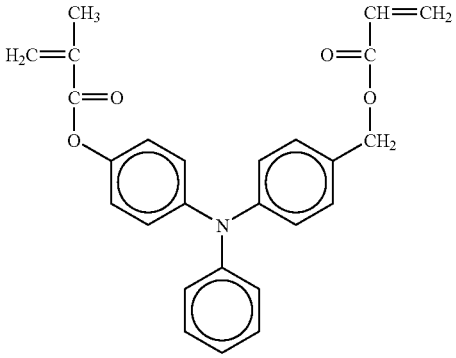
NO. 296
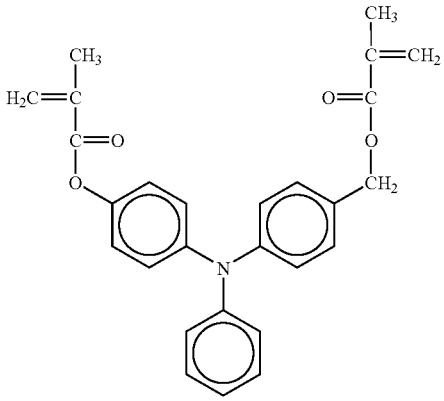
NO. 297
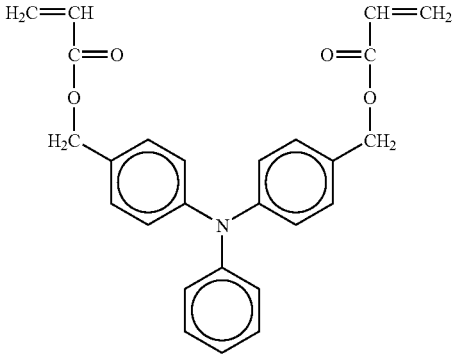
NO. 298
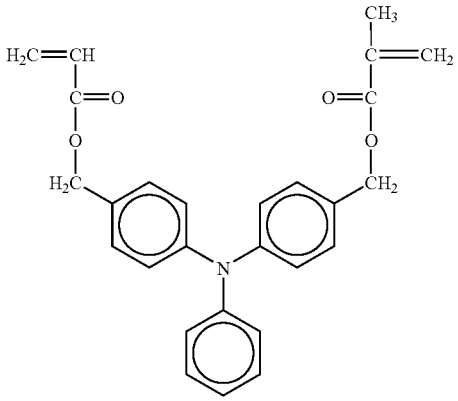
NO. 299
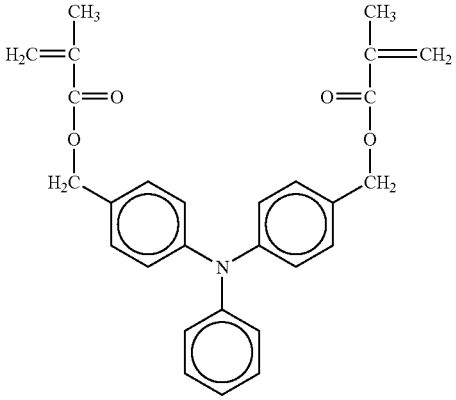
NO. 300
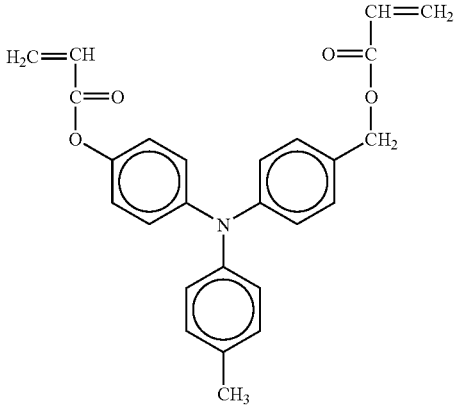

-continued
NO. 301
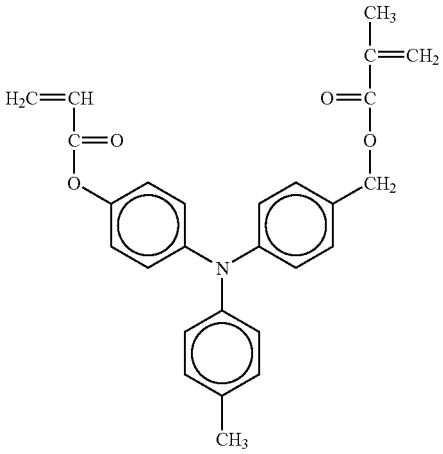
NO. 302
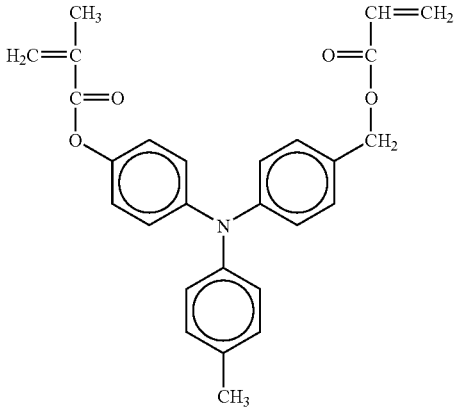
NO. 303
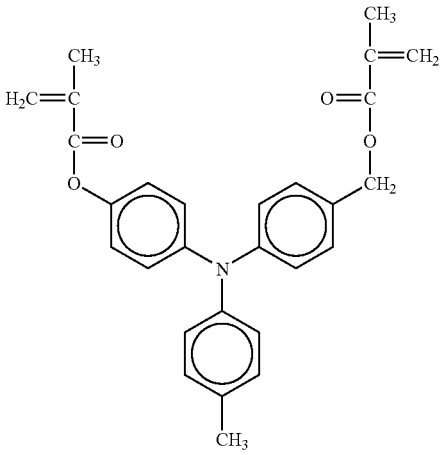
NO. 304
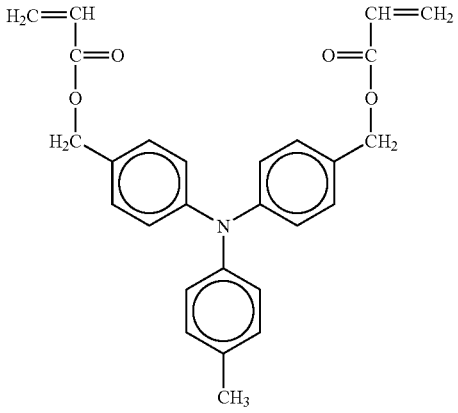
NO. 305
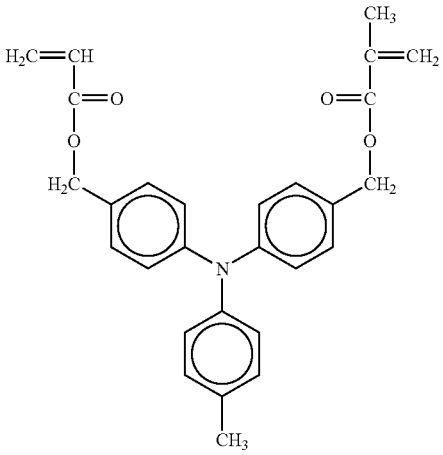
NO. 306
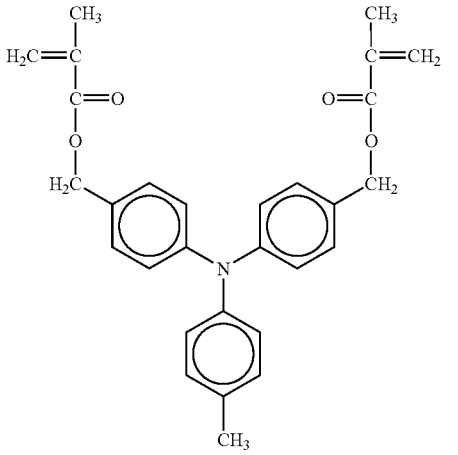

-continued
NO. 307
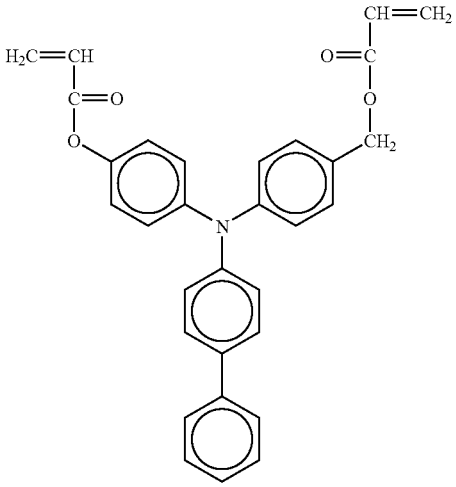
NO. 308
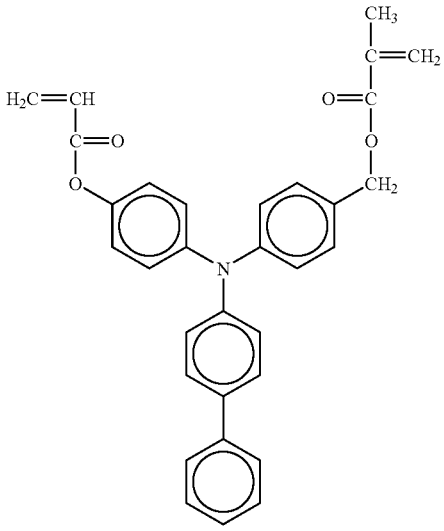
NO. 309
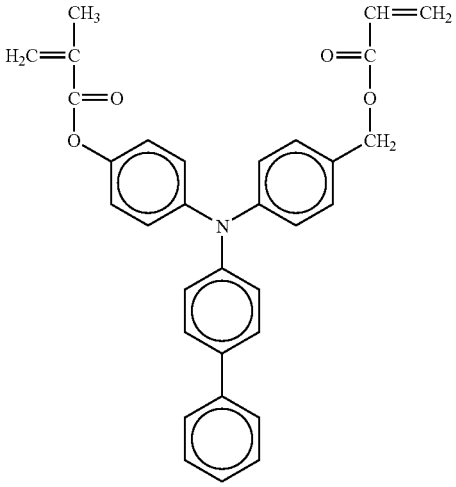
NO. 310
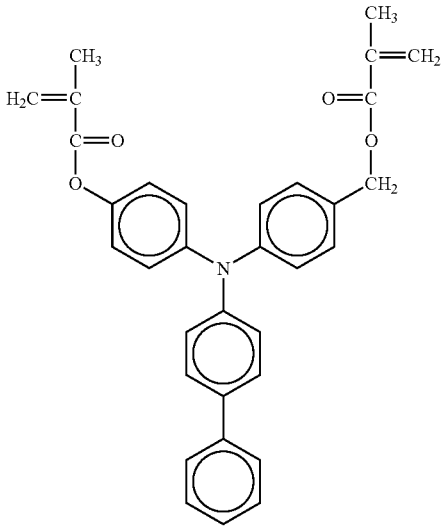
NO. 311
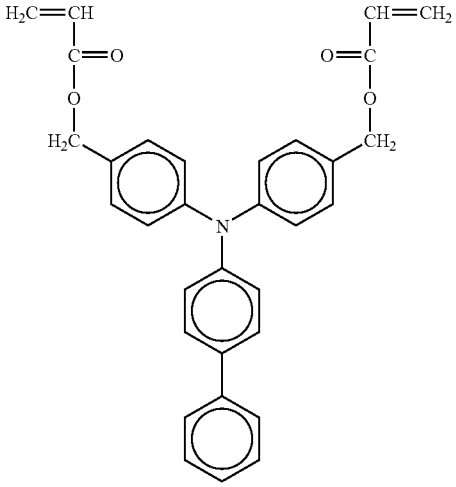
NO. 312
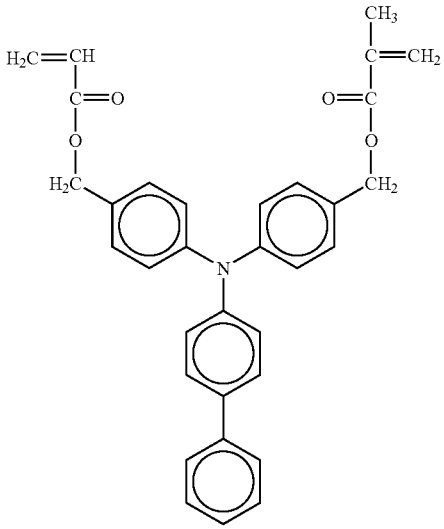

-continued
NO. 313
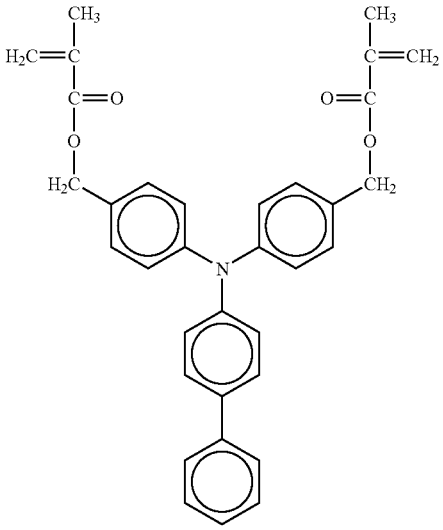
NO. 314
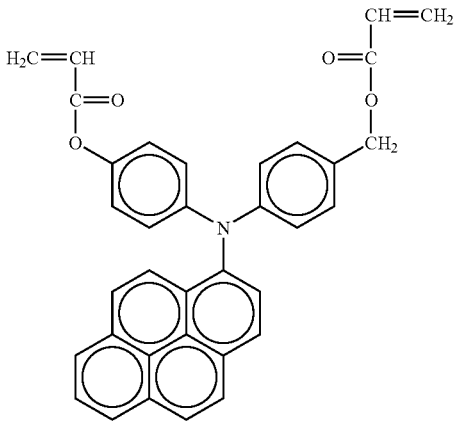
NO. 315
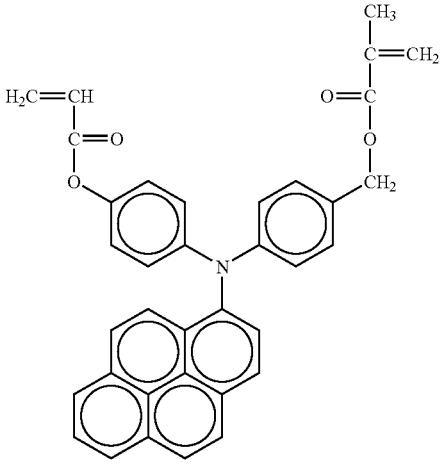
NO. 316
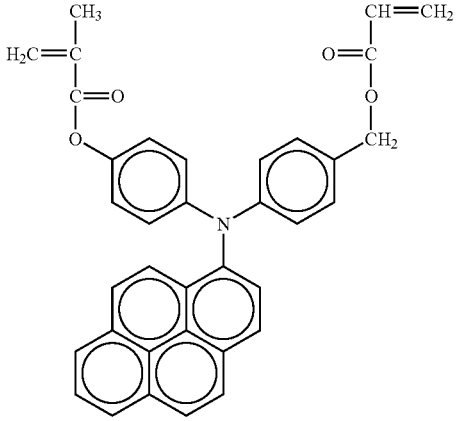
NO. 317
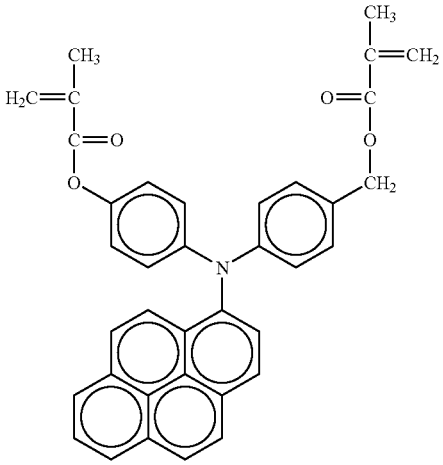
NO. 318
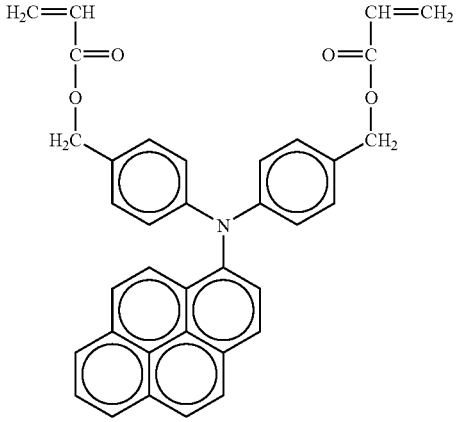

-continued
NO. 319
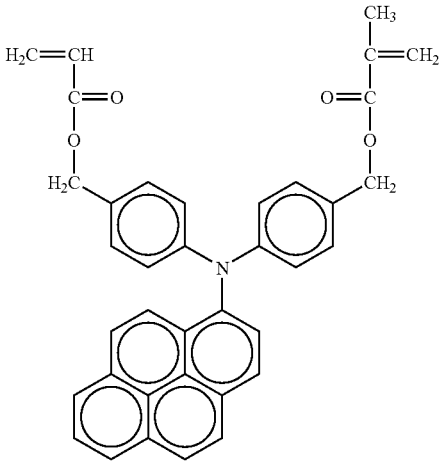
NO. 320
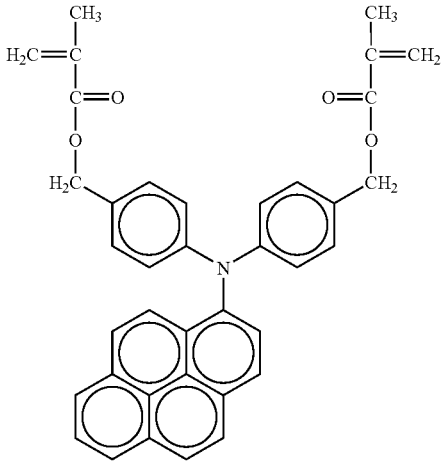
NO. 321
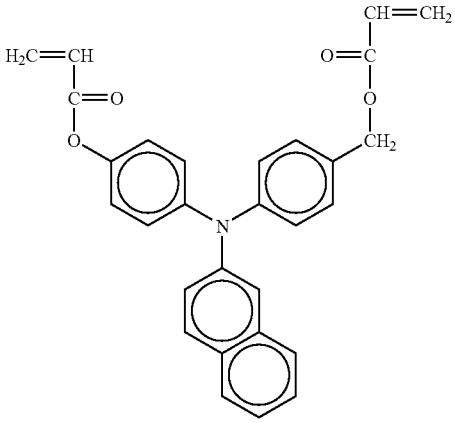
NO. 322
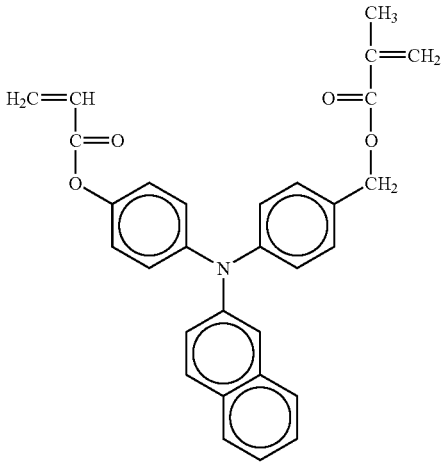
NO. 323
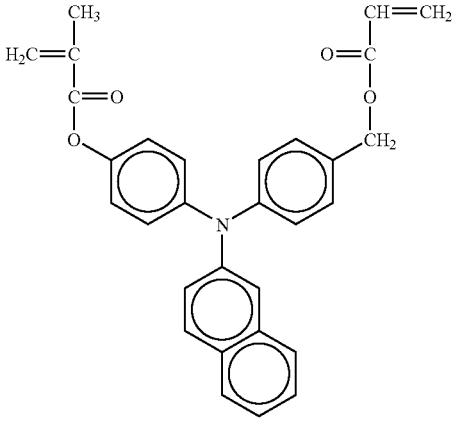
NO. 324
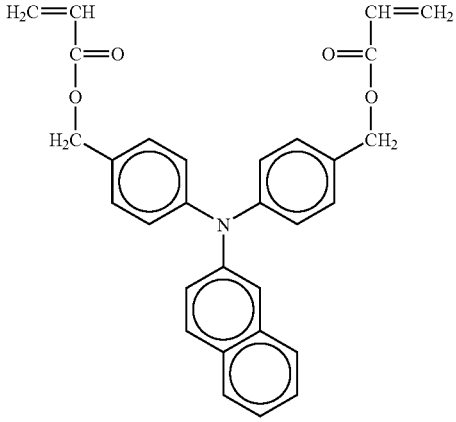

-continued
NO. 325
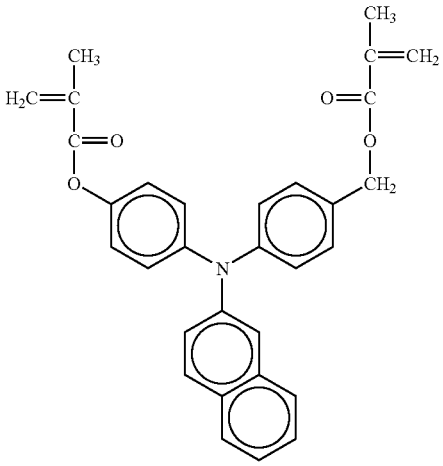
NO. 326
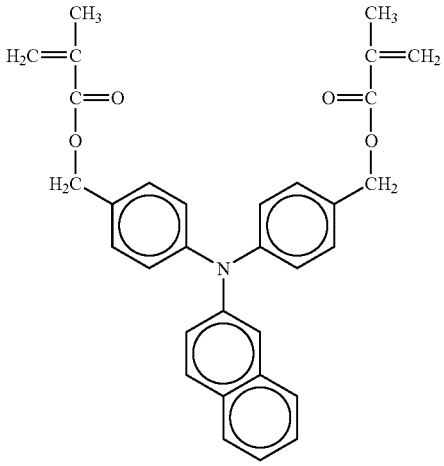
NO. 327
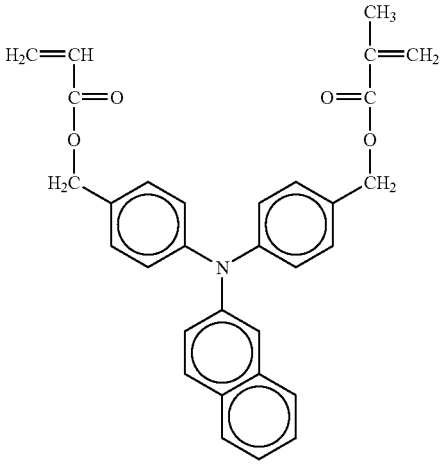
NO. 328
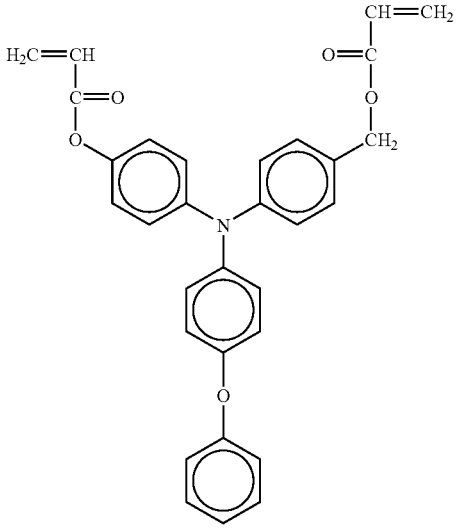
NO. 329
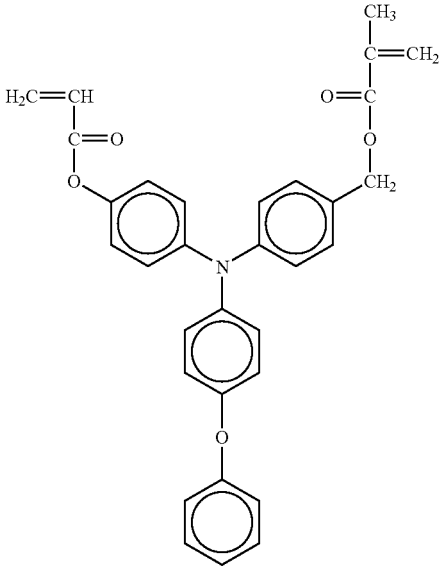
NO. 330
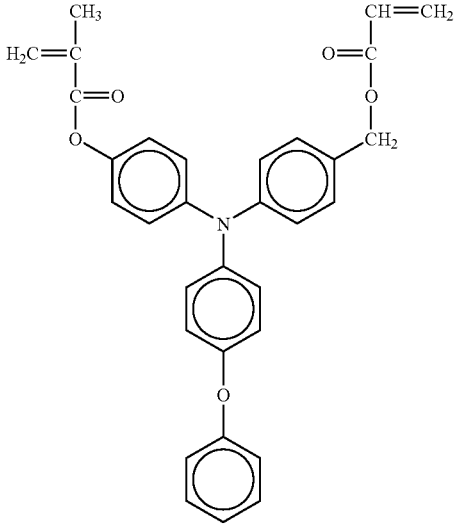

-continued
NO. 331
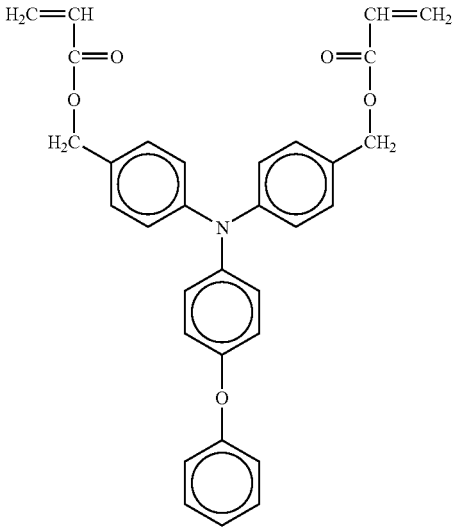
NO. 332
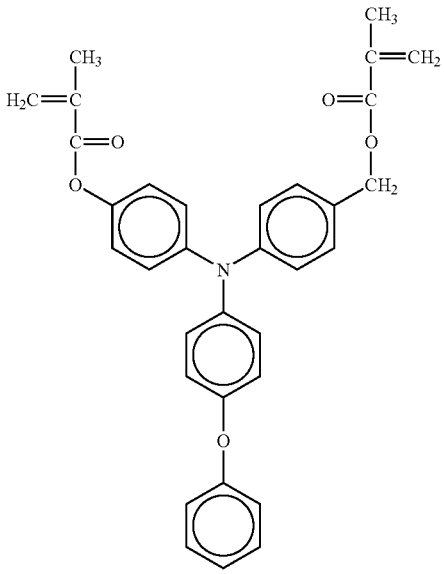
NO. 333
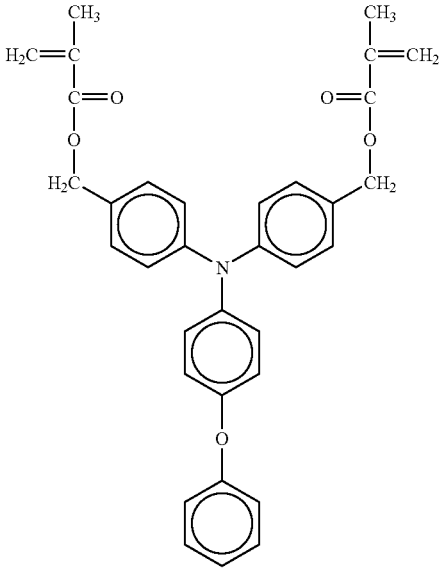
NO. 334
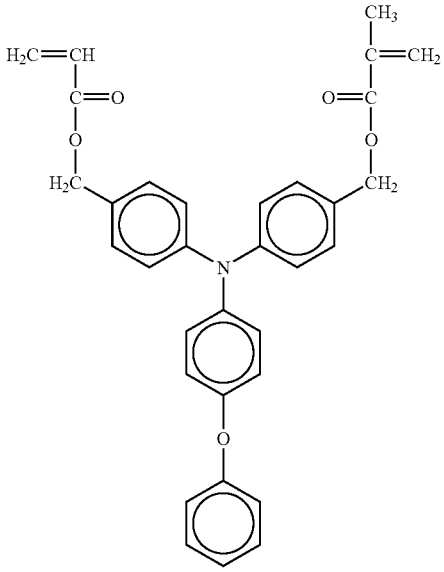
NO. 335
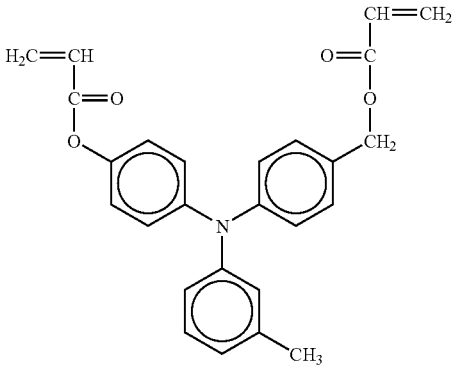
NO. 336
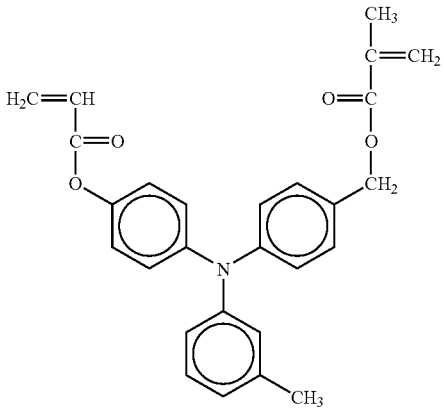

-continued
NO. 337
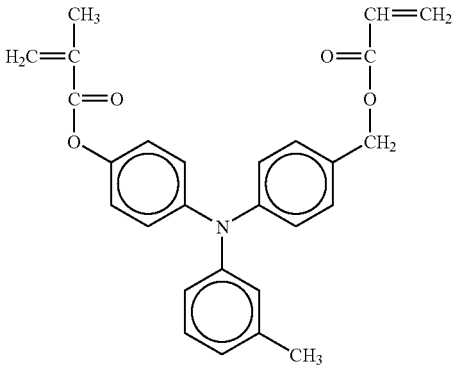
NO. 338
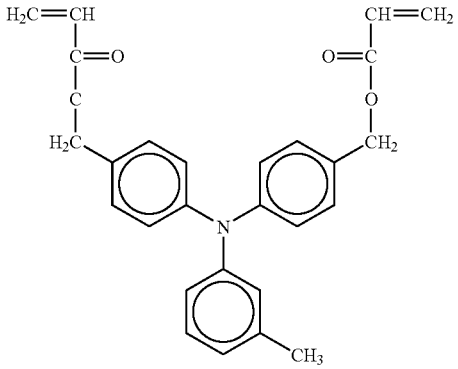
NO. 339
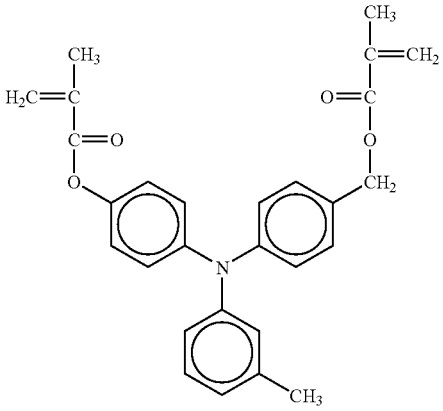
NO. 340
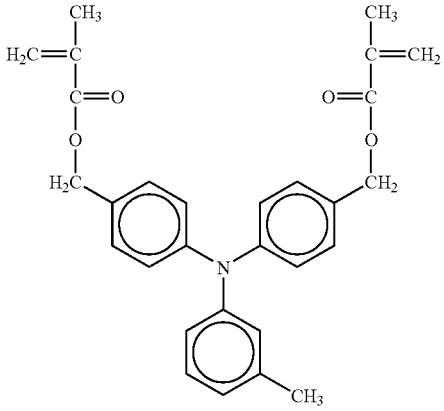
NO. 341
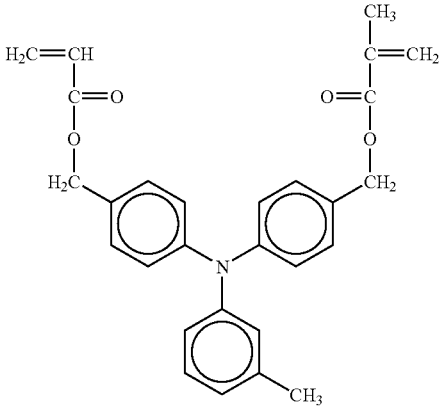
NO. 342
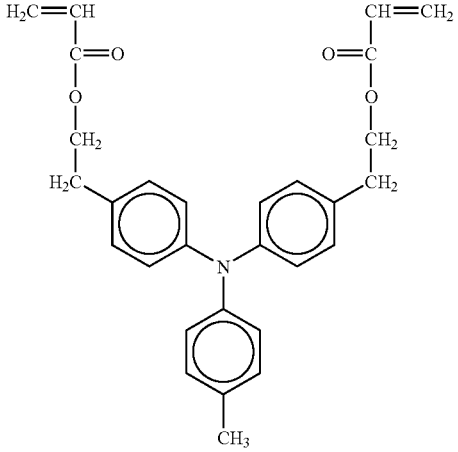

-continued
NO. 343
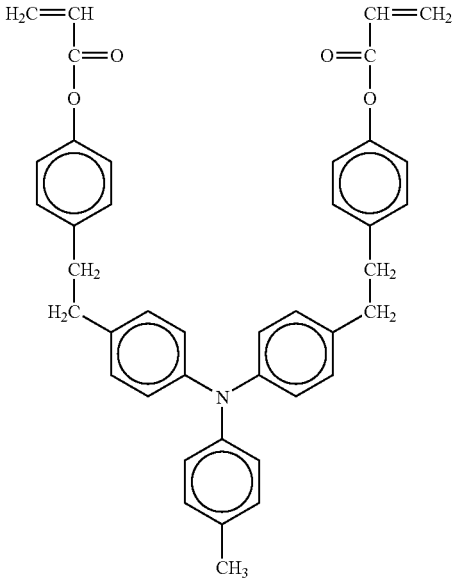
NO. 344
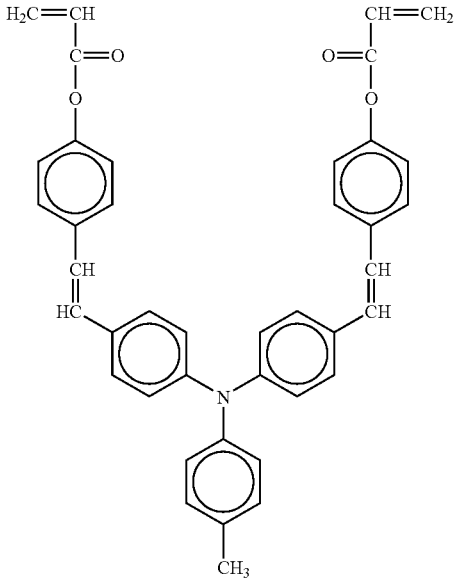
NO. 345
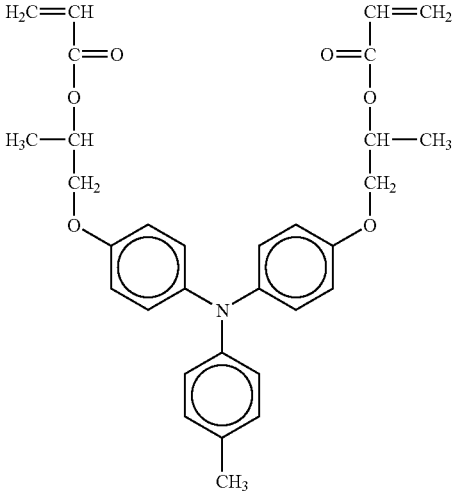
NO. 346
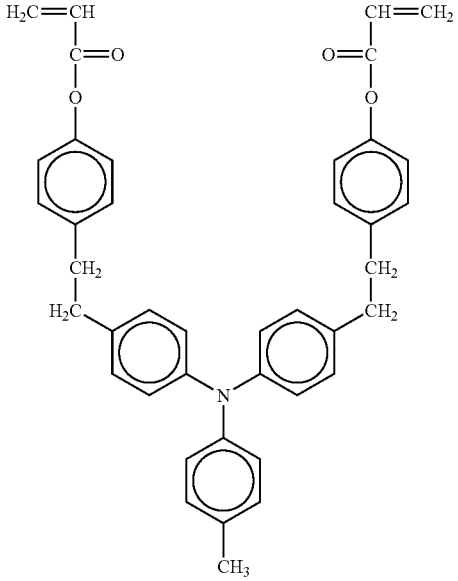
NO. 347
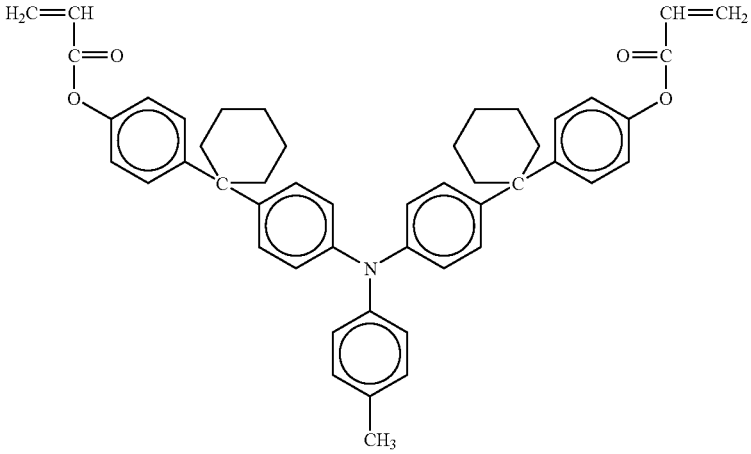

-continued
NO. 348
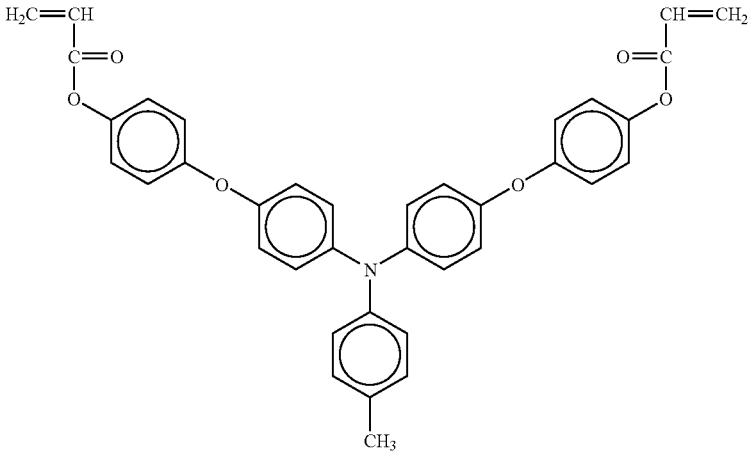
NO. 349
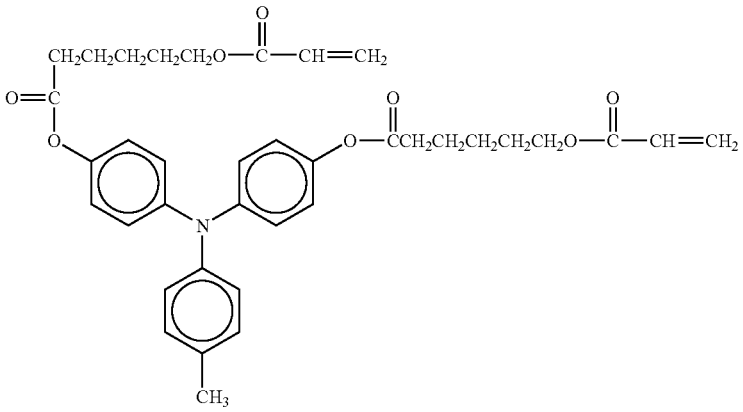
NO. 350
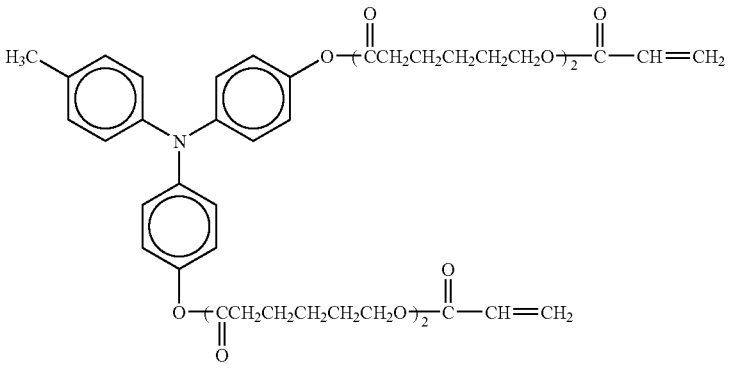

-continued
NO. 351
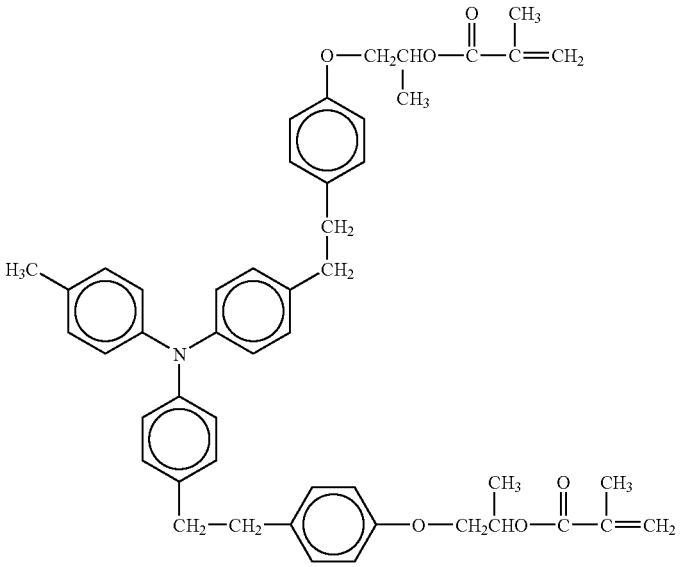
NO. 352
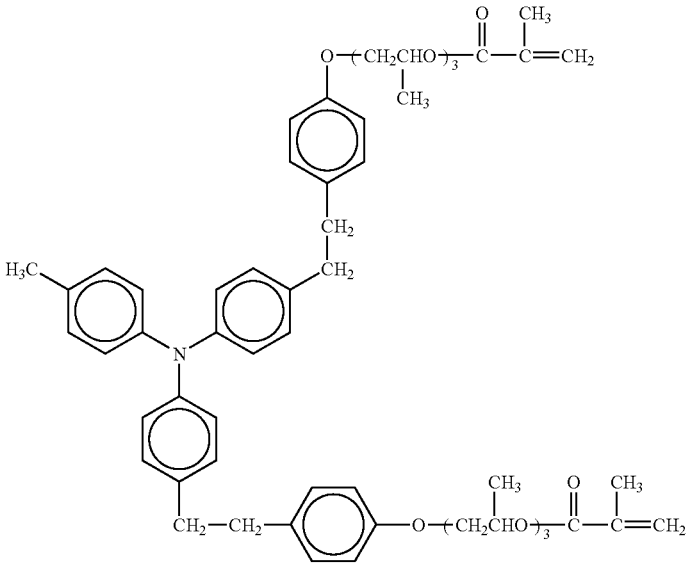
NO. 353
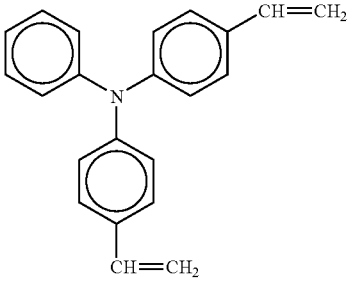
NO. 354
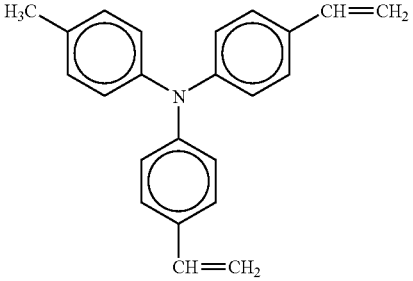

-continued
NO. 355
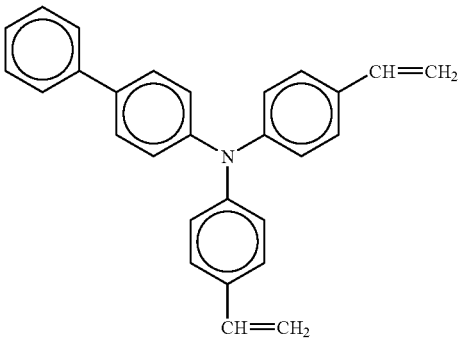
NO. 356
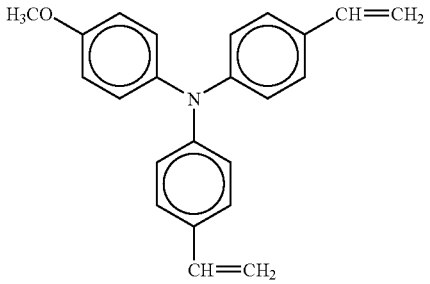
NO. 357
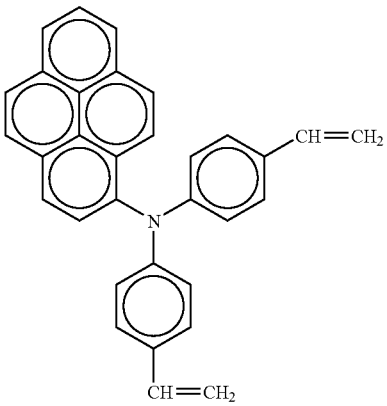
NO. 358
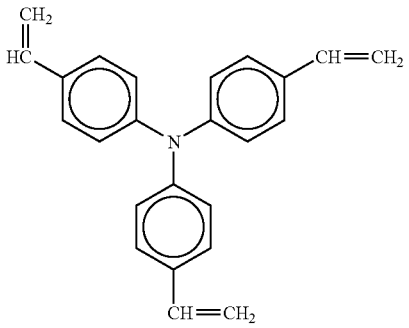
NO. 359
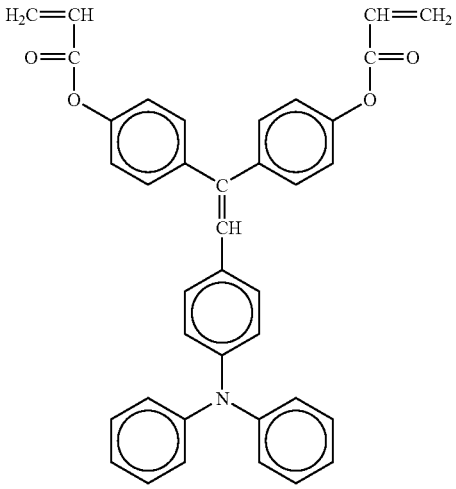
NO. 360
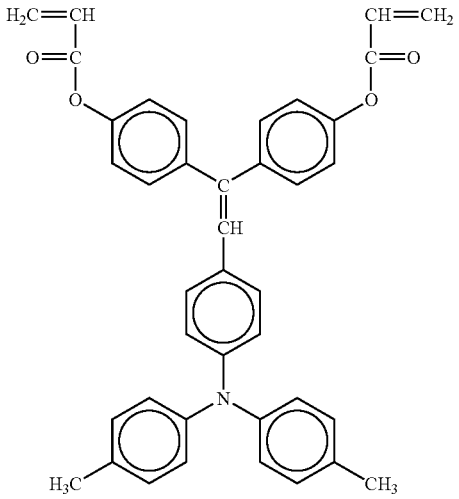

-continued
NO. 361
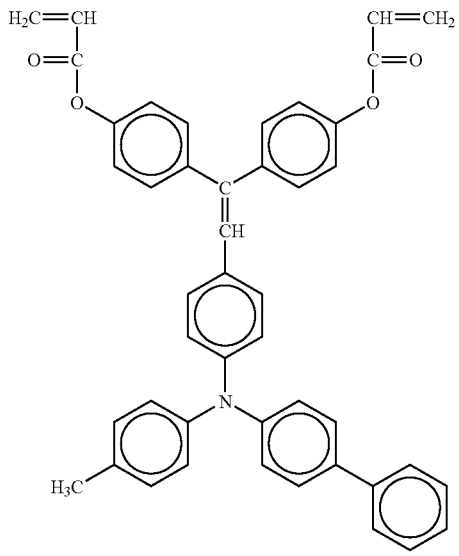
NO. 362
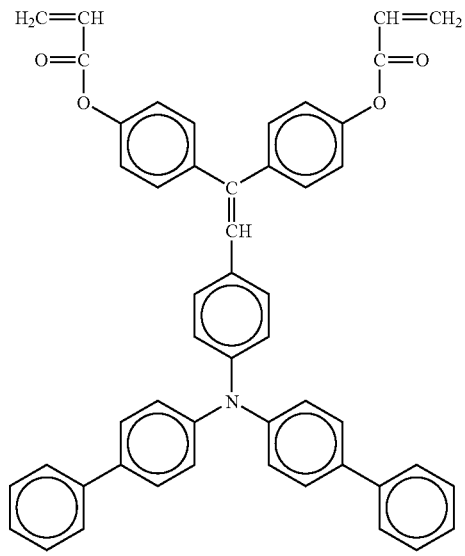
NO. 363
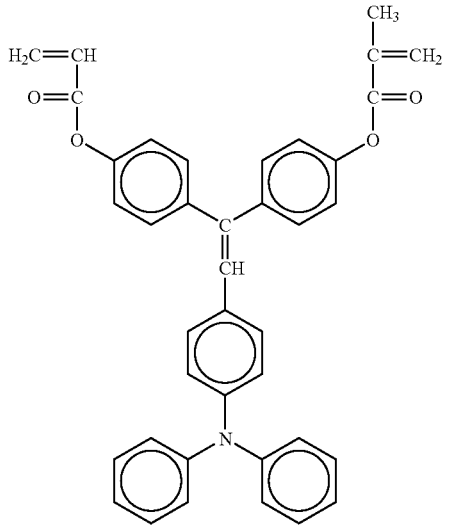
Specific examples of the bifunctional radical polymerizing compound having a charge transportable structure include, but are not limited to, the following materials.
NO. 364
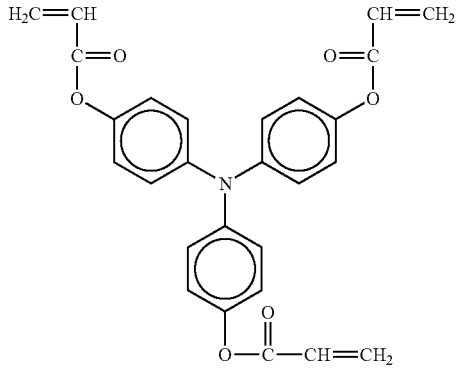
-continued
NO. 365
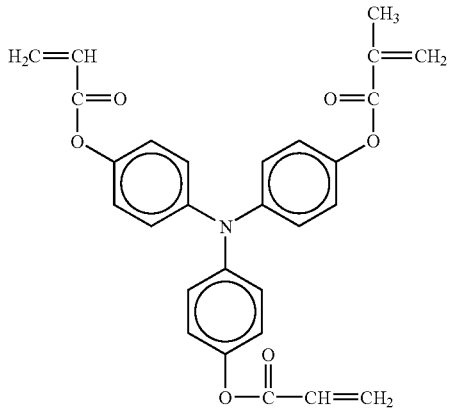

NO. 366
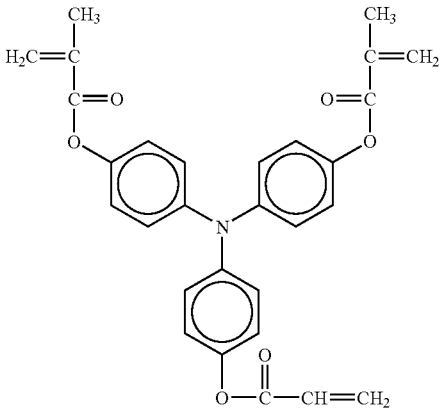
NO. 367
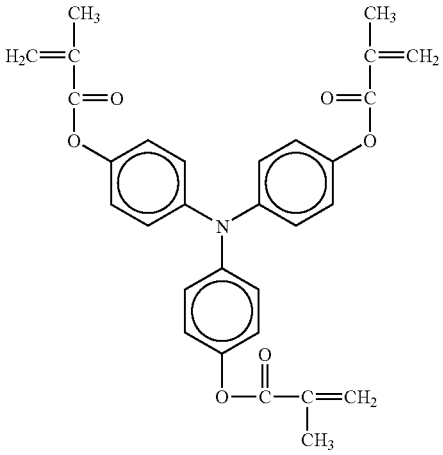
NO. 368
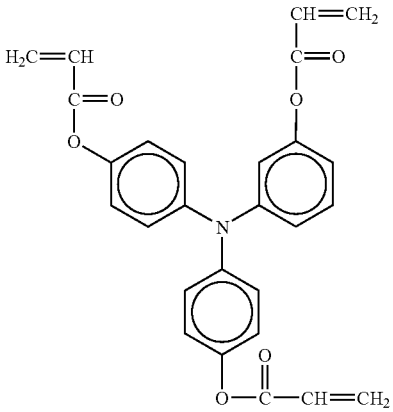
NO. 369
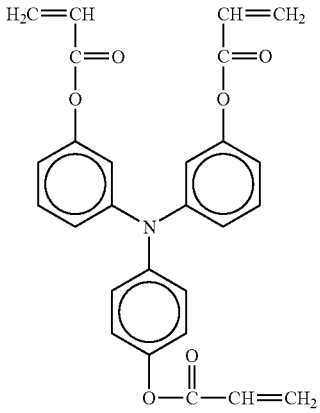
NO. 370
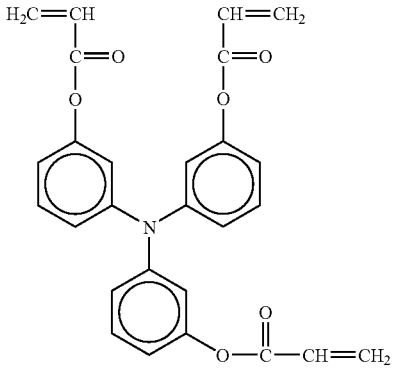
NO. 371
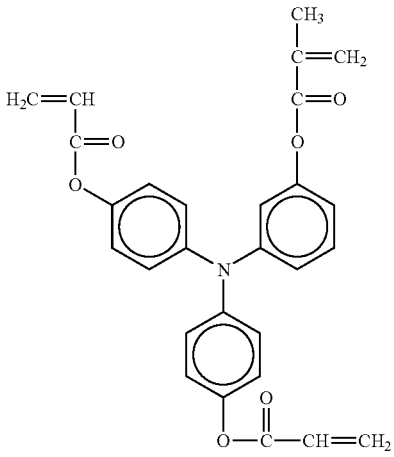

-continued
NO. 372
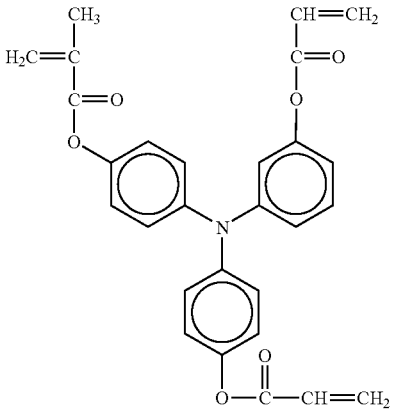
NO. 373
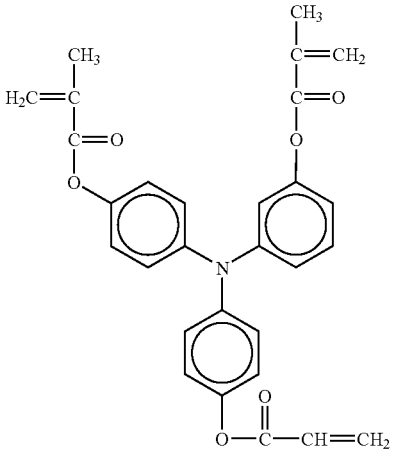
NO. 374
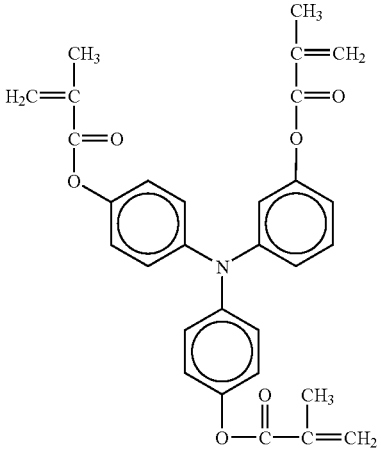
-continued
NO. 375
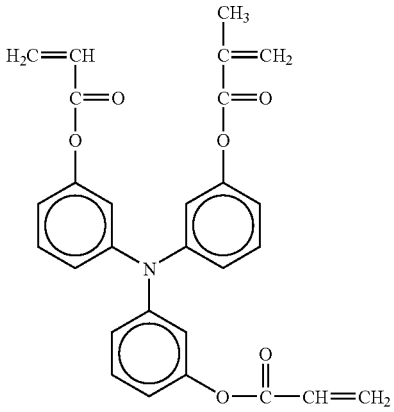
NO. 376
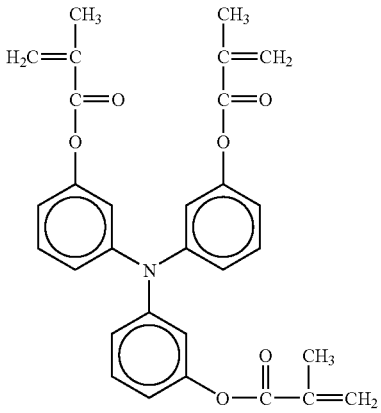
NO. 377
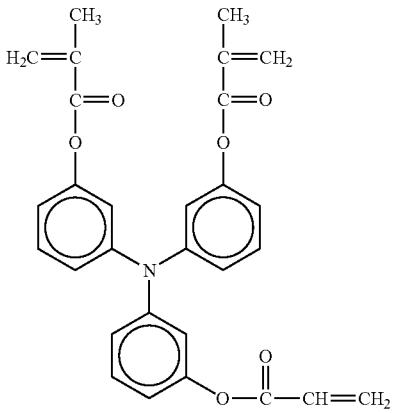

-continued
NO. 377
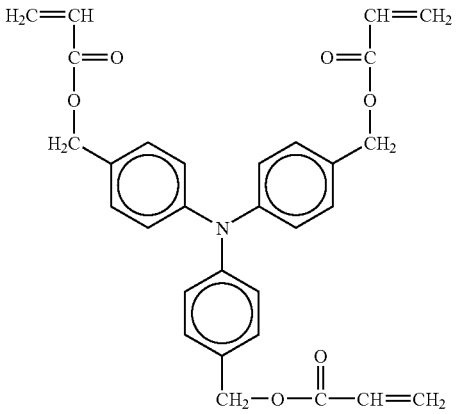
NO. 378
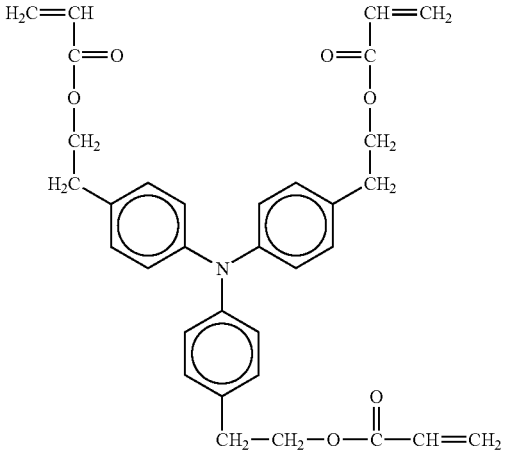
NO. 379
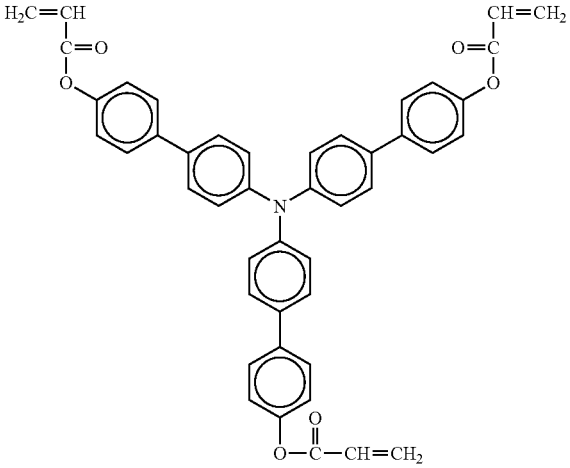
-continued
NO. 380
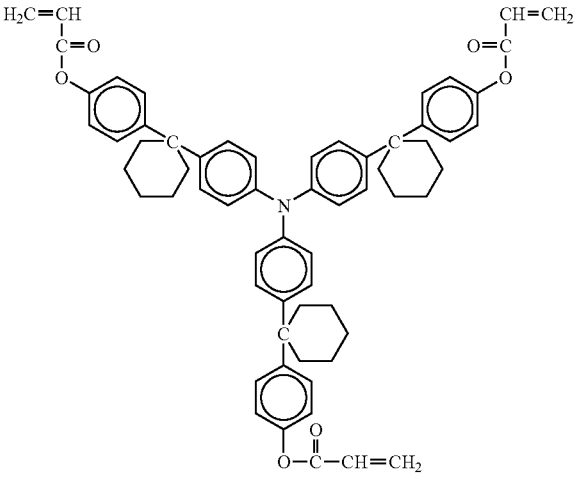
NO. 381
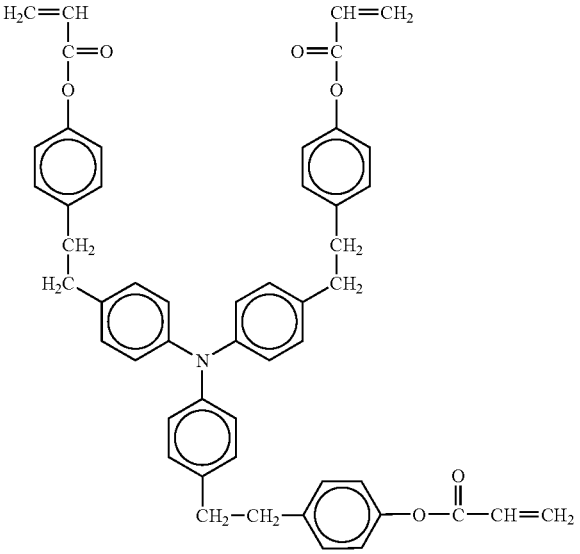

-continued

NO. 382

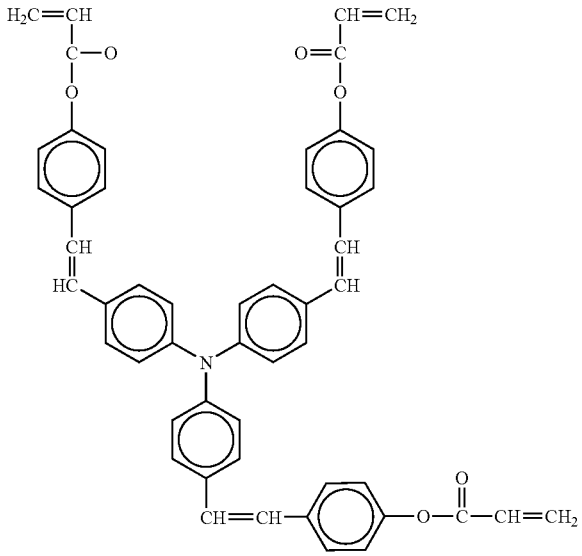

The radical polymerizing compound having a charge transportable structure for use in the present invention is essential for imparting a charge transportability to the crosslinked surface layer, and is preferably included therein in an mount of 20 to 80% by weight, and more preferably from 30 to 70% by weight based on total weight thereof. When less than 20% by weight, the crosslinked surface layer cannot maintain the charge transportability, a sensitivity of the resultant photoreceptor deteriorates and a residual potential thereof increases in repeated use. When greater than 80% by weight, a content of the monomer having three or more functional groups and no charge transportable structure decreases and the crosslinked density deteriorates, and therefore the resultant photoreceptor does not have a high abrasion resistance. Although it depends on a required abrasion resistance and electrical properties, in consideration of a balance therebetween, a content of the monofunctional radical polymerizing compound having a charge transportable structure is most preferably from 30 to 70% by weight.

The surface layer of the present invention is a crosslinked surface layer wherein at least the radical polymerizing monomer having three or more functional groups and no charge transportable structure and the radical polymerizing compound having a charge transportable structure are hardened, and can include a monofunctional or bifunctional radical polymerizing monomer or oligomer as well to control a viscosity of the surface layer when coated, reduce a stress of thereof, impart a low surface free energy thereto and reduce friction coefficient thereof. Known radical polymerizing monomers and oligomers can be used.

Specific examples of the monofunctional radical monomer include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc.

Specific examples of the bifunctional radical polymerizing monomer include 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc.

Specific examples of the functional monomers include octafluoropentylacrylate 2-perfluorooctylethylacrylate, 2-perfluorooctylethylmethacrylate, 2-perfluoroisononylethylacrylate, etc. wherein a fluorine atom is substituted; vinyl monomers having a polysiloxane group such as acryloylpolydimethylsiloxaneethyl, methacryloylpolydimethylsiloxaneethyl, acryloylpolydimethylsiloxanepropyl, acryloylpolydimethylsiloxanebutyl and diacryloylpolydimethylsiloxanediethyl having a siloxane repeat unit of from 20 to 70, disclosed in Japanese Patent Publications Nos. 5-60503 and 6-45770; acrylate and methacrylate.

Specific examples of the radical polymerizing oligomer include epoxyacrylate oligomers, urethaneacrylate oligomers and polyetseracrylate oligomers. However, when the crosslinked surface layer includes a large amount of the monofunctional or bifunctional radical polymerizing monomer or oligomer, the three-dimensional crosslinked bonding density thereof substantially deteriorates, resulting in deterioration of the abrasion resistance thereof. Therefore, the surface layer of the present invention preferably includes the monomers or oligomers in an amount not greater than 50 parts by weight, and more preferably not greater than 30 parts by weight per 100 parts by weight of the radical polymerizing monomer having three or more functional groups.

The surface layer of the present invention is a crosslinked surface layer wherein at least the radical polymerizing monomer having three or more functional groups and no charge transportable structure and the radical polymerizing compound having a charge transportable structure are hardened with light energy, and may optionally include a polymerization initiator to effectively proceed the crosslinking reaction.

Specific examples of the polymerization initiators include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis (2,4-dimethoxybenzoyl)-2,4,4-trimethylpentylphosphineoxide, methylphenylglyoxyester, 9,10-phenanthrene, acridine compounds, triazine compounds and imidazole compounds. Further, a material having a photo polymerizing effect can be used alone or in combination with the above-mentioned photo polymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone.

These polymerization initiators can be used alone or in combination. The surface layer of the present invention preferably includes the polymerization initiators in an amount of 0.5 to 40 parts by weight, and more preferably from 1 to 20 parts by weight per 100 parts by weight of the total radical polymerizing contents.

Further, a coating liquid for the surface layer of the present invention may optionally include various additives such as plasticizers (to soften a stress and improve adhesiveness thereof), leveling agents and low-molecular-weight charge transport materials without a radical reactivity. Known additives can be used, and specific examples of the plasticizers include plasticizers such as dibutylphthalate and dioctylphthalate used in typical resins. A content thereof is preferably not greater than 20% by weight, and more preferably not greater than 10% based on total weight of solid contents of the coating liquid. Specific examples of the leveling agents include silicone oil such as dimethylsilicone oil and methylphenylsilicone oil; and polymers and oligomers having a perfluoroalkyl group in the side chain. A content thereof is preferably not greater than 3% by weight.

The crosslinked surface layer of the present invention is formed by coating and hardening a coating liquid including at least the radical polymerizing monomer having three or more functional groups and no charge transportable structure and the radical polymerizing compound having a charge transportable structure. The coating liquid can include other components when the radical polymerizing monomer is a liquid, and is optionally diluted with a solvent and coated. Specific examples of the solvent include alcohols such as methanol, ethanol, propanol andbutanol; ketones such as acetone, methyl ethyl ketone, methyl isobutyl ketone and cyclohexanone; esters such as ethyl acetate and butyl acetate; ethers such as tetrahydrofuran, dioxane and propylether; halogens such as dichloromethane, dichloroethane, trichloroethane and chlorobenzene; aromatics such as benzene, toluene and xylene; and Cellosoves such as methyl Cellosolve, ethyl Cellosolve and Cellosolve acetate. These solvents can be used alone or in combination. A dilution ratio with the solvent can optionally be decided upon solubility of the compositions, a coating method and a purposed layer thickness. The crosslinked surface layer can be coated by a dip coating method, a spray coating method, a bead coating method, a ring coating method, etc.

In the present invention, after coating the coating liquid, a light energy is externally applied thereto for hardening the layer. Specific examples of the light source include high pressure mercury lamps and metal halide lamps having an emission wavelength of UV light; and a visible light source adaptable for absorption wavelength of the radical polymerizing compounds and photo polymerization initiators. An irradiation light intensity is preferably from 300 to 1,000 mW/cm$^2$. When less than 300 mW/cm$^2$, the hardening reaction takes time. When greater than 1,000 mW/cm$^2$, the reaction nonuniformly proceeds and the crosslinked surface layer has a large surface roughness.

When irradiated, the surface temperature of a photoreceptor increases and a solvent remaining thereon quickly decreases, resulting in lower hardening speed. Therefore, it is necessary to control the surface temperature so as to have a temperature not higher than a boiling point of the solvent for a surface layer coating liquid.

Specific examples of methods of controlling the surface temperature include, but are not limited to, any methods capable of controlling the surface temperature, such as (1) placing a material having a large heat capacity in a photoreceptor drum, (2) blowing cold wind to the surface of the photoreceptor when irradiated and (3) feeding cold wind in the photoreceptor drum.

In addition, when irradiated, the oxygen density is preferably from 0.001 to 2.0% to prevent the oxygen from obstructing the crosslinkage. As the oxygen density is about 21% in the atmospheric air, a gas such as nitrogen, helium and argon is fed into an irradiation tank to replace the air therein. In such an irradiation tank wherein the oxygen density is maintained at from 0.001 to 2.0%, the resultant surface layer has large crosslinked density and high surface smoothness even with a low irradiation amount.

The crosslinked surface layer coating liquid can include a binder resin, provided the surface smoothness, electrical properties or durability of a photoreceptor is not impaired. However, when the crosslinked surface layer includes a polymer resin having poor compatibility with a hardened material produced by a reaction between the polymer material and the radical polymerizing constituents, i.e., the radical polymerizing monomer and the radical polymerizing compound having a charge transportable structure as a binder resin, the crosslinked surface layer has a layer separation, resulting in large concavities and convexities thereon. Therefore, it is preferable not to use a binder resin.

The crosslinked surface layer of the present invention needs to have a bulky charge transportable structure to maintain electrical properties, and high crosslinked density to be highly strengthened. When an extremely high energy is quickly applied to the crosslinked surface layer to be hardened, the crosslinked surface layer is nonuniformly hardened, resulting in large concavities and convexities thereon. Therefore, a light source capable of controlling the reaction speed according to the irradiation intensity and an amount of the polymerization initiator is preferably used. For example, when an acrylate monomer having three acryloyloxy groups and a triarylamine compound having one acryloyloxy group are used in the coating liquid, content ratio (acrylate monomer having three acryloyloxy groups/triarylamine compound having one acryloyloxy group) thereof is preferably from 7/3 to 3/7. In addition, a polymerization initiator is included therein in an amount of from 3 to 20% by weight based on total weight of the acrylate compound, and further as solvent is included therein. For example, when the crosslinked surface layer is formed by spray coating on a charge transport layer, which is a lower layer thereof, including a triarylamine donor as a charge transport material and polycarbonate as a binder resin, the crosslinked surface layer coating liquid preferably includes tetrahydrofuran, 2-butanone, ethylacetate, etc. as a solvent in an amount of from 3 to 10 parts by weight based on total weight of the acrylate compound.

Next, on a photoreceptor wherein an undercoat layer, a charge generation layer and a charge transport layer are layered in this order on an electroconductive substrate, the coating liquid is spray-coated. Then, the photoreceptor is dried at from 25 to 80° C. for 1 to 10 min, and irradiated to be hardened.

A metal halide lamp, etc. is used when irradiating UV light thereto, the light intensity of which is preferably from 300 to 1,000 mW/cm$^2$. For example, when UV light having an intensity of 600 mW/cm$^2$ is irradiated thereto, the photoreceptor drum is irradiated for 45 to 360 sec while rotated such that the whole surface is uniformly irradiated.

After hardening, the photoreceptor is heated at from 100 to 150° C. for 10 to 30 min to reduce the solvent remaining thereon.

Hereinafter, the present invention will be explained, according to the layer structures.

Figure 1B:
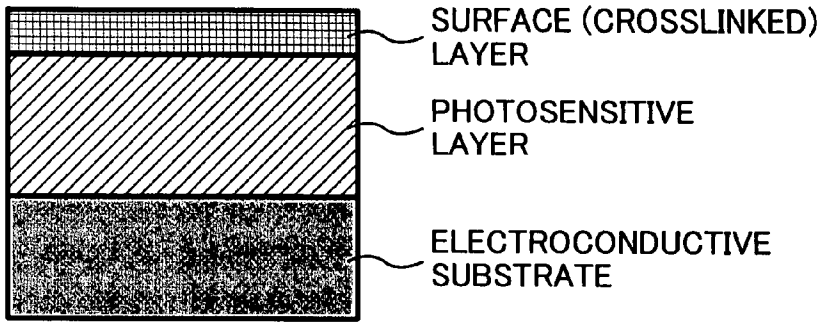

FIGS. 1A and 1B are cross-sectional views of embodiments of layers of the electrophotographic photoreceptor of the present invention, which is a single-layered photoreceptor formed of a photosensitive layer having both charge generatability and charge transportability, and overlying an electroconductive substrate. In FIG. 1A, the photosensitive layer is wholly a crosslinked surface layer. In FIG. 1B, a crosslinked surface layer is a surface part of the photosensitive layer.

Figure 2A:
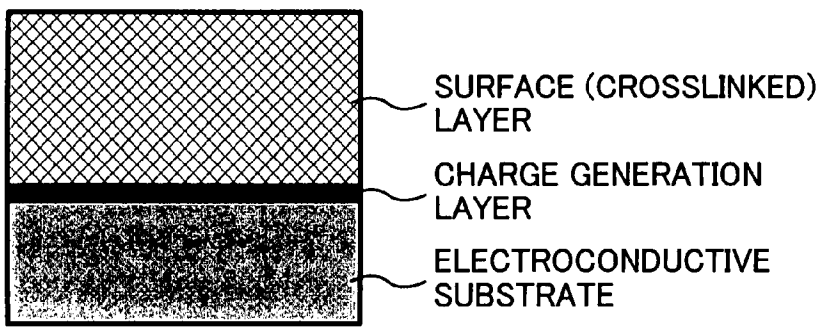
FIGS. 2A and 2B are cross-sectional views of other embodiments of layers of the electrophotographic photoreceptor of the present invention.
Figure 2B:
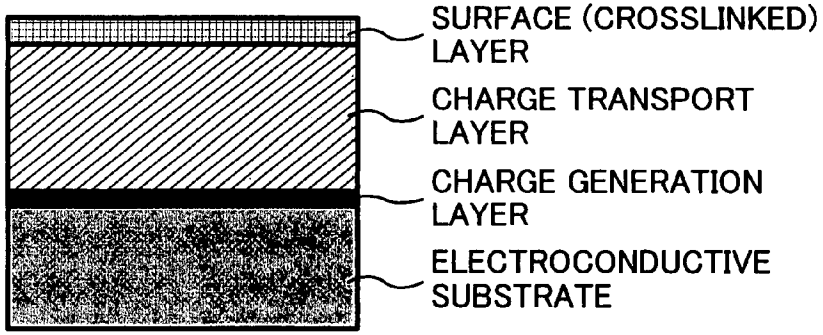

FIGS. 2A and 2B are cross-sectional views of other embodiments of layers of the electrophotographic photoreceptor of the present invention, which is a multilayered photoreceptor formed of a charge generatable charge generation layer and a charge transportable charge transport layer, and which are overlying an electroconductive substrate. In FIG. 2A, the charge transport layer is wholly a crosslinked surface layer. In FIG. 2B, a crosslinked surface layer is a surface part of the charge transport layer.

Suitable materials for use as the electroconductive substrate include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the substrate.

Furthermore, substrates, in which a coating liquid including a binder resin and an electroconductive powder is coated on the supporters mentioned above, can be used as the substrate.

Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be preferably used as the substrate.

Next, the photosensitive layer will be explained. The photosensitive layer may be a single-layered or a multilayered. The multilayered photosensitive layer is formed of a charge generatable charge generation layer and a charge transportable charge transport layer. The single-layered photosensitive layer is a layer having both the charge generatability and charge transportability.

Hereinafter, the multilayered photosensitive layer and single-layered photosensitive layer will be explained respectively.

The charge transport layer (CGL) is mainly formed of a charge generatable charge generation material, and optionally includes a binder resin. Suitable charge generation materials include inorganic materials and organic materials.

Specific examples of the inorganic charge generation materials include crystalline selenium, amorphous selenium, selenium-tellurium alloys, selenium-tellurium-halogen alloys, selenium-arsenic alloys, amorphous silicon, etc. The amorphous silicon includes a dangling bond terminated with a hydrogen atom or a halogen atom, a doped boron atom, a doped phosphorus atom, etc.

Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments, etc. Among these pigments, a phthalocyanine pigment, particularly titanylphthalocyanine having a crystal form comprising main peaks of Bragg (2θ) at 9.6±0.2°, 24.0±0.2° and 27.2±0.2° in a X-ray diffraction spectrum when irradiated with Cu—Kα ray is effectively used. These charge transport materials can be used alone or in combination.

Specific examples of the binder resin optionally used in the CGL include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination. In addition, a charge transport polymer material can also be used as the binder resin in the CGL besides the above-mentioned binder resins. Specific examples thereof include polymer materials such as polycarbonate resins, polyester resins, polyurethane resins, polyether resins, polysiloxane resins and acrylic resins having an arylamine skeleton, a benzidine skeleton, a hydrazone skeleton, a carbazole skeleton, a stilbene skeleton, a pyrazoline skeleton, etc.; and polymer materials having polysilane skeleton.

Specific examples of the former polymer materials include charge transport polymer materials disclosed in Japanese Laid-Open Patent Publications Nos. 01-001728, 01-009964, 01-013061, 01-019049, 01-241559, 04-011627, 04-175337, 04-183719, 04-225014, 04-230767, 04-320420, 05-232727, 05-310904, 06-234838, 06-234839, 06-234840, 06-234839, 06-234840, 06-234841, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084; 09-302085, 09-328539, etc.

Specific examples of the latter polymer materials include polysilylene polymers disclosed in Japanese Laid-Open Patent Publications Nos. 63-285552, 05-19497, 05-70595, 10-73944, etc.

The CGL also can include a low-molecular-weight charge transport material.

The low-molecular-weight charge transport materials include positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoquinone derivatives, etc. These electron transport materials can be used alone or in combination.

Specific examples of the positive hole transport materials include electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other known materials. These positive hole transport materials can be used alone or in combination.

Suitable methods for forming the charge generation layer are broadly classified into a vacuum thin film forming method and a solvent dispersion casting method.

Specific examples of the former vacuum thin film forming method include a vacuum evaporation method, a glow discharge decomposition method, an ion plating method, as puttering method, a reaction sputtering method, CVD (chemical vapor deposition) methods, etc. A layer of the above-mentioned inorganic and organic materials can be formed by these methods.

The casting method for forming the charge generation layer typically includes the following steps:

(1) preparing a coating liquid by mixing one or more inorganic or organic charge generation materials mentioned above with a solvent such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butylacetate, etc., optionally with a binder resin and a leveling agent such as a dimethylsilicone oil and methylphenyl silicone oil, and then dispersing the materials with a ball mill, an attritor, a sand mill, beads mill, etc. to prepare a CGL coating liquid;

(2) coating the CGL coating liquid, which is diluted if necessary, on a substrate by a method such as dip coating, spray coating, bead coating and ring coating; and (3) drying the coated liquid to form a CGL.

The thickness of the CGL is preferably from about 0.01 to about 5 μm, and more preferably from about 0.05 to about 2 μm.

The charge transport layer (CTL) is a layer having charge transportability, and the crosslinked surface layer of the present invention is effectively used as a CTL. When the crosslinked surface layer is a whole CTL, as mentioned above, after a coating liquid including the radical polymerizing constituents (the radical polymerizing monomer having no charge transportability and the radical polymerizing compound having charge transportability) of the present invention is coated on the CGL and is optionally dried to form a coated layer thereon, and an external energy is applied thereto to harden the coated layer to form the crosslinked surface layer. The crosslinked surface layer preferably has a thickness of from 10 to 30 μm, and more preferably from 10 to 25 μm. When thinner than 10 μm, a sufficient charged potential cannot be maintained. When thicker than 30 μm, a contraction in volume thereof when hardened tends to cause a separation thereof from a lower layer.

When the crosslinked surface layer is formed at a surface part of the CTL, the CTL is formed by coating a CGL with a coating liquid wherein a charge transport material having charge transportability and a binder resin are dispersed in a proper solvent to form a coated layer thereon, and drying the coated layer. The crosslinked surface layer is formed by coating the CGL with a coating liquid including the above-mentioned radical polymerizing constituents of the present invention to form a coated layer thereon, and crosslinking and hardening the coated layer with an external energy.

Specific examples of the charge transport materials include electron transport materials, positive hole transport materials and charge transport polymer materials used in the CGL. Particularly, the charge transport polymer materials are effectively used to reduce a solution of a lower layer when a surface layer is coated thereon.

Specific examples of the binder resins include thermoplastic or thermosetting resins such as polystyrene, styrene-acrylonitrile copolymers, styrene-butadiene copolymers, styrene-maleic anhydride copolymers, polyester, polyvinylchloride, vinylchloride-vinylacetate copolymers, polyvinylacetate, polyvinylidenechloride, polyarylate resins, phenoxy resins, polycarbonate, cellulose acetate resins, ethylcellulose resins, polyvinylbutyral, polyvinylformal, polyvinyltoluene, poly-N-vinylcarbazole, acrylic resins, silicone resins, epoxyresins, melamine resins, urethane resins, phenol resins and alkyd resins. The CTL preferably includes the charge transport material in an amount of from 20 to 300 parts by weight, and more preferably from 40 to 150 parts by weight per 100 parts by weight of the binder resin. However, the charge transport polymer material can be used alone or in combination with the binder resin.

Specific examples of a solvent used for coating the CTL include the solvents used for coating the CGL, and particularly the solvents solving the charge transport material and binder resin well are preferably used. These solvents can be used alone or in combination. The CTL can be formed by the same coating methods used for coating the CGL.

The CTL may optionally include a plasticizer and a leveling agent.

Specific examples of the plasticizers include plasticizers for typical resins, such as dibutylphthalate and dioctylphthalate, and a content thereof is preferably from 0 to 30 parts by weight per 100 parts by weight of the binder resin.

Specific examples of the leveling agents include silicone oil such as dimethyl silicone oil and methylphenyl silicone oil; and polymers or oligomers having a perfluoroalkyl group in the side chain, and a content thereof is preferably from 0 to 1 part by weight per 100 parts by weight of the binder resin.

The CTL preferably has a thickness of from 5 to 40 μm, and more preferably from 10 to 30 μm.

When the crosslinked surface layer is a surface part of the CTL, as mentioned in the method of forming a crosslinked surface layer, a coating liquid including the radical polymerizing constituents of the present invention is coated on the CTL and optionally dried to form a coated layer thereon, and an external energy is applied thereto to harden the coated layer to form the crosslinked surface layer thereon. The crosslinked surface layer preferably has a thickness of from 1 to 20 μm, and more preferably from 2 to 10 μm. When thinner than 1 μm, uneven thickness thereof causes uneven durability thereof. When thicker than 20 μm, a total thickness of the CTL and crosslinked surface layer is so thick that charges are scattered, resulting in deterioration of image reproducibility of the resultant photoreceptor.

The single-layered photosensitive layer has both charge generatability and charge transportability, and the crosslinked surface layer having charge transportability and including a charge generation material having charge generatability of the present invention is effectively used as a single-layered photosensitive layer. As mentioned in the casting method of forming the CGL, a charge generation material is dispersed in a coating liquid including the radical polymerizing constituents, and the coating liquid is coated on an electroconductive substrate and optionally dried to form a coated layer thereon, then a hardening reaction is performed in the coated layer with an external energy to form the crosslinked surface layer. The charge generation material may previously be dispersed in a solvent to prepare a dispersion, and the dispersion may be added into the coating liquid for forming the crosslinked surface layer. The crosslinked surface layer preferably has a thickness of from 10 to 30 μm, and more preferably from 10 to 25 μm. When thinner than 10 μm, a sufficient charged potential cannot be maintained. When thicker than 30 μm, a contraction in volume thereof when hardened tends to cause a separation thereof from an undercoat layer.

When the crosslinked surface layer is a surface part of the single-layered photosensitive layer, the photosensitive layer can be formed by coating and drying a liquid wherein a charge generation material having a charge generation function, a charge transport material having a charge transport function and a binder resin are dispersed or dissolved in a proper solvent. The photosensitive layer may optionally include an additive such as plasticizers and leveling agents. The methods of dispersing a charge generation material, charge generation materials, charge transport materials, plasticizers and leveling agents mentioned in the above CGL and CTL can be used. Besides the binder resins mentioned in the above CTL, the binder resins in the above CGL can be mixed therewith. In addition, the above-mentioned charge transport polymer material can effectively be used to prevent components of the lower photosensitive layer from mixing in the crosslinked surface layer. The photosensitive layer preferably has a thickness of from 5 to 30 μm, and more preferably from 10 to 25 μm.

When the crosslinked surface layer is a surface part of the single-layered photosensitive layer, as mentioned in the method of forming a crosslinked surface layer, a coating liquid including the radical polymerizing compositions of the present invention and a binder resin is coated on the photosensitive layer and optionally dried to form a coated layer thereon, and an external energy is applied thereto to harden the coated layer to form the crosslinked surface layer thereon. The crosslinked surface layer preferably has a thickness of from 1 to 20 μm, and more preferably from 2 to 10 μm. When thinner than 1 μm, uneven thickness thereof causes uneven durability thereof.

The single-layered photosensitive layer preferably includes a charge generation material in an amount of from 1 to 30% by weight, a binder resin of from 20 to 80% by weight and a charge transport material of from 10 to 70 parts by weight based on total weight thereof.

The photoreceptor of the present invention can have an intermediate layer between a crosslinked surface layer and a photosensitive layer when the crosslinked surface layer overlies the layer. The intermediate layer prevents components of the lower photosensitive layer from mixing in the crosslinked surface layer to avoid a hardening reaction inhibition and concavities and convexities thereof. In addition, the intermediate layer can improve an adhesiveness between the crosslinked surface layer and photosensitive layer.

The intermediate layer includes a resin as a main component. Specific examples of the resin include polyamides, alcohol-soluble nylons, water-soluble polyvinyl butyral, polyvinyl butyral, polyvinyl alcohol, etc. The intermediate layer can be formed by one of the above-mentioned known coating methods. The intermediate layer preferably has a thickness of from 0.05 to 2 μm.

The photoreceptor of the present invention may have an undercoat between the substrate and photosensitive layer. The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can also be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. Besides these materials, known materials can be used. The thickness of the undercoat layer is preferably from 0 to 5 μm.

In the present invention, an antioxidant can be included in each of the layers, i.e., the crosslinked surface layer, charge generation layer, charge transport layer, undercoat layer and intermediate layer to improve the stability to withstand environmental conditions, namely to avoid decrease of photosensitivity and increase of residual potential.

Specific examples of the antioxidant for use in the present invention include the following compound.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidene-bis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3', 5'-di-t-butyl-4'-hydroxyphenyl)propionate]methane, bis[3,3'-bis(4'-hydroxy-3'-t-butylphenyl)butyric acid]glycol ester, tocophenol compounds, etc.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(d) Organic Sulfur-containing Compounds

Dilauryl-3,3'-thiodipropionate, distearyl-3,3'-thiodipropionate, ditetradecyl-3,3'-thiodipropionate, etc.

(e) Organic Phosphorus-containing Compounds

Triphenylphosphine, tri(nonylphenyl)phosphine, tri(dinonylphenyl)phosphine, tricresylphosphine, tri(2,4-dibutylphenoxy)phosphine, etc.

These compounds are known as antioxidants for rubbers, plastics, fats, etc., and marketed products thereof can easily be obtained.

Each of the layers preferably includes the antioxidant in an amount of from 0.01 to 10% by weight based on total weight thereof.

Next, the image forming method and image forming apparatus of the present invention will be explained in detail, referring to the drawings.

The image forming method and image forming apparatus of the present invention include a photoreceptor having a smooth transporting crosslinked surface layer having a low surface energy, wherein the photoreceptor is charged and irradiated with an imagewise light to form an electrostatic latent image thereon; the electrostatic latent image is developed to form a toner image; the toner image is transferred onto an image bearer (transfer sheet) and fixed thereon; and a surface of the photoreceptor is cleaned.

The process is not limited thereto in such a method as to directly transfer an electrostatic latent image onto a transfer sheet and develop the electrostatic latent image thereon.

Figure 3:
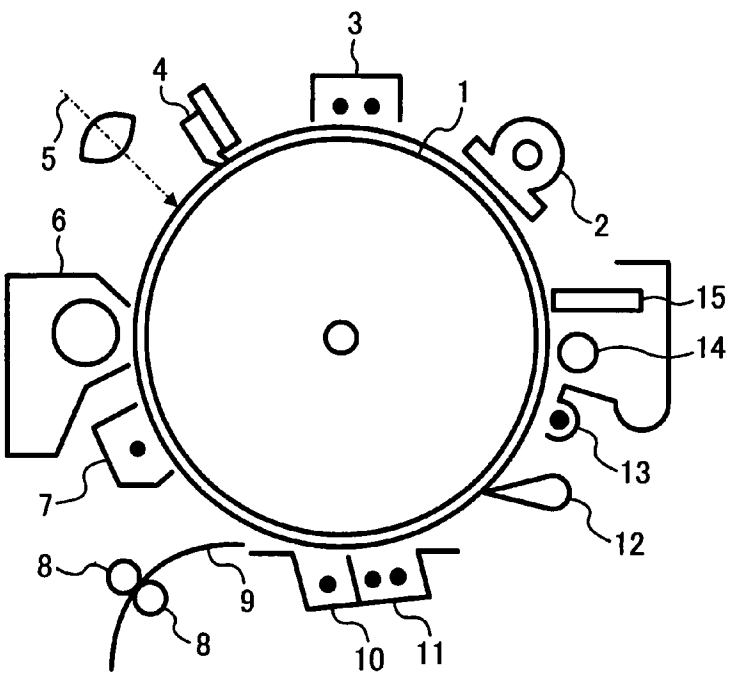
FIG. 3 is a schematic view illustrating a partial cross-section of an embodiment of the image forming apparatus of the present invention.
Figure 5:
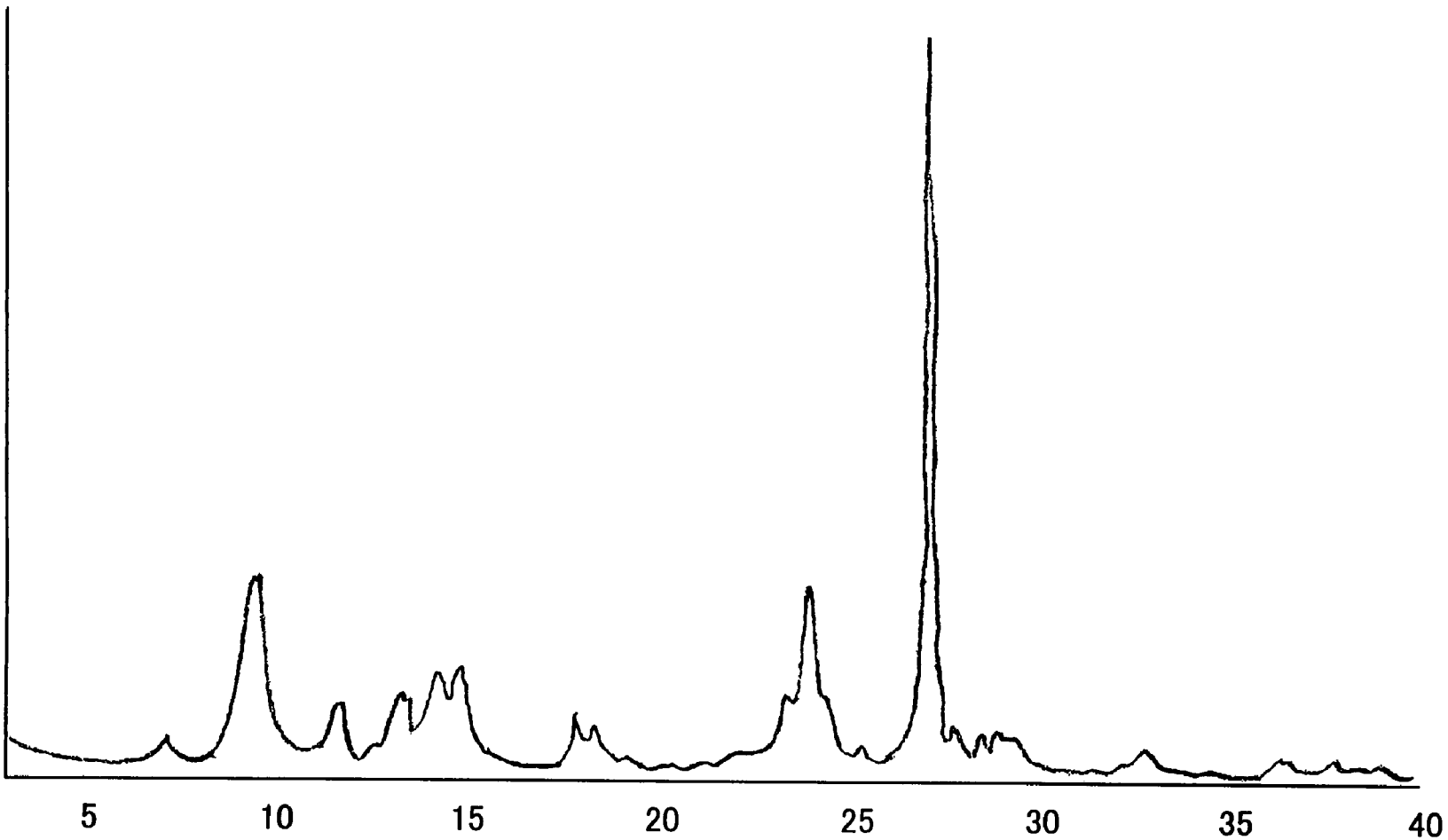
FIG. 5 is a X-ray diffraction spectrum of the titanylphthalocyanine pigment of the present invention.

FIG. 3 is a schematic view illustrating a partial cross-section of an embodiment of the image forming apparatus of the present invention. A charger (3) is used to uniformly charge a photoreceptor (1). Specific examples of the charger include known chargers such as corotron devices, scorotron device, solid state chargers, needle electrode devices, roller charging devices and electroconductive brush devices.

Next, an imagewise irradiator (5) is used to form an electrostatic latent image on the photoreceptor (1). Suitable light sources thereof include typical light emitters such as fluorescent lamps, tungsten lamps, halogen lamps, mercury lamps, sodium lamps, light emitting diodes (LEDs), laser diodes (LDs), light sources using electroluminescence (EL), etc. In addition, to obtain light having a desired wave length range, filters such as sharp-cut filters, band pass filters, near-infrared cutting filters, dichroic filters, interference filters and color temperature converting filters can be used.

Next, a developing unit (6) is used to visualize an electrostatic latent image formed on the photoreceptor (1). The developing methods include a one-component developing method and a two-component developing method using a dry toner; and a wet developing method using a wet toner. When the photoreceptor positively or negatively charged is exposed to imagewise light, an electrostatic latent image having a positive or negative charge is formed on the photoreceptor. When the latent image having a positive charge is developed with a toner having a negative charge, a positive image can be obtained. In contrast, when the latent image having a positive charge is developed with a toner having a positive charge, a negative image can be obtained.

Next, a transfer charger (10) is used to transfer a toner image visualized on the photoreceptor onto a transfer sheet (9). A pre-transfer charger (7) may be used to perform the transfer better. Suitable transferers include a transferer charger, an electrostatic transferee using a bias roller, an adhesion transferer, a mechanical transferer using a pressure and a magnetic transferee. The above-mentioned chargers can be used for the electrostatic transferer.

Next, a separation charger (11) and a separation pick (12) are used to separate the transfer sheet (9) from the photoreceptor (1). Other separation means include an electrostatic absorption induction separator, a side-edge belt separator, a tip grip conveyor, a curvature separator, etc. The above-mentioned chargers can be used for the separation charger (11).

Next, a fur brush (14) and a cleaning blade (15) are used to remove a toner left on the photoreceptor after transferred therefrom. A pre-cleaning charger (13) may be used to perform the cleaning more effectively. Other cleaners include a web cleaner, a magnet brush cleaner, etc., and these cleaners can be used alone or in combination.

Next, a discharger is optionally used to remove a latent image in the photoreceptor. The discharger includes a discharge lamp (2) and a discharger, and the above-mentioned light sources and chargers can be used respectively.

Known means can be used for other an original reading process, a paper feeding process, a fixing process, a paper delivering process, etc.

Figure 4:
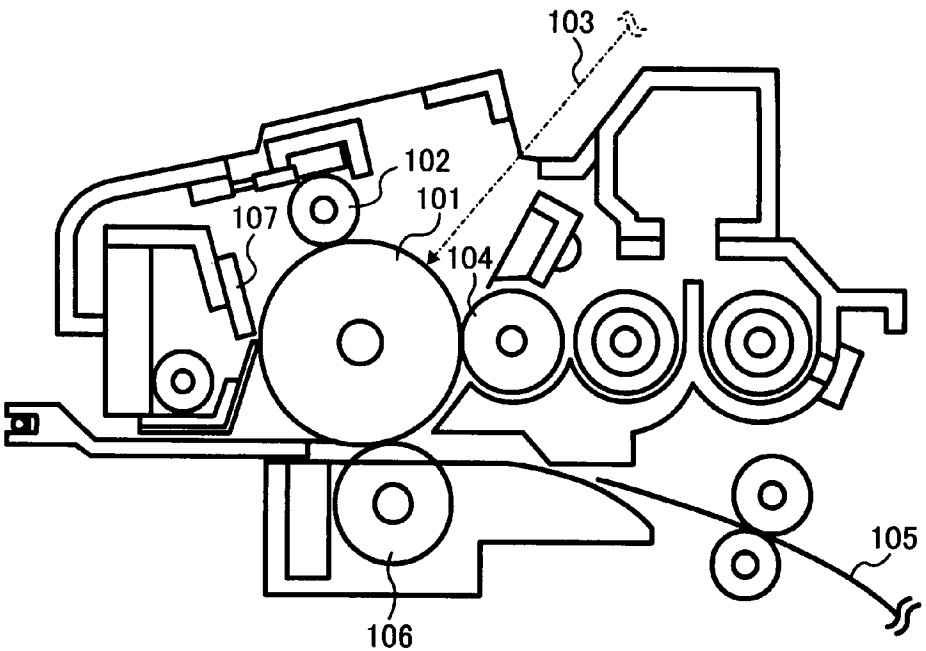
FIG. 4 is a schematic view illustrating a cross-section of an embodiment of the process cartridge detachable from an image forming apparatus of the present invention.

The above-mentioned image forming unit may be fixedly set in a copier, a facsimile or a printer. However, the image forming unit may be detachably set therein as a process cartridge. FIG. 4 is a schematic view illustrating a cross-section of an embodiment of the process cartridge for the image forming apparatus of the present invention.

The process cartridge means an image forming unit (or device) which includes a photoreceptor (101) and at least one of a charger (102), an image developer (104), a transferer (106), a cleaner (107) and a discharger (not shown).

While the photoreceptor (101) rotates in a direction indicated by an arrow, the photoreceptor (101) is charged by the charger (102) and irradiated by an irradiator (103) to form an electrostatic latent image relevant to imagewise light thereon The electrostatic latent image is developed by the image developer (104) with a toner to form a form a toner image, and the toner image is transferred by the transferer (106) onto a transfer sheet (105) to be printed out. Next, a surface of the photoreceptor after the toner image is transferred is cleaned by the cleaner (107), discharged by a discharger (not shown) and these processes are repeated again.

As is apparent from the explanations mentioned above, the electrophotographic photoreceptor of the present invention can widely be used in electrophotography applied fields such as a laser beam printer, a CRT printer, a LED printer, a liquid crystal printer and a laser engraving.

The compound having a charge transporting structure of the present invention is synthesized by, e.g., a method disclosed in Japanese Patent No. 3164426. The following method is one of the examples thereof.

(1) Synthesis of a Hydroxy Group Substituted Triarylamine Compound Having the Following Formula B 113.85 g (0.3 mol) of a methoxy group substituted triarylamine compound having the formula A, 138 g (0.92 mol) of sodium iodide and 240 ml of sulfolane were mixed to prepare a mixture. The mixture was heated to have a temperature of 60° C. in a nitrogen stream.

A

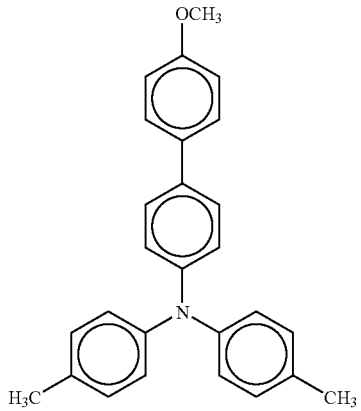

99 g (0.91 mol) of trimethylchlorosilane were dropped therein for 1 hr and the mixture was stirred for 4 hrs at about 60° C. About 1.5 L of toluene were added thereto and the mixture was cooled to have a room temperature, and repeatedly washed with water and an aqueous solution of sodium carbonate. Then, a solvent removed therefrom and refined by a column chromatographic process using silica gel as an absorption medium, and toluene and ethyl acetate (20-to-1) as a developing solvent. Cyclohexane was added to the thus prepared buff yellow oil to separate a crystal out. Thus, 88.1 g (yield of 80.4%) of a white crystal having the following formula B and a melting point of from 64.0 to 66.0° C. was prepared.

B

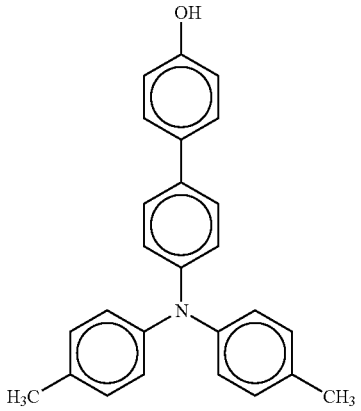

Elemental Analysis Value (%)

| | C | H | N |
|---|---|---|---|
| Found value | 85.06 | 6.41 | 3.73 |
| Calculated value | 85.44 | 6.34 | 3.83 |

(2) A Triarylamino Group Substituted Acrylate Compound (Compound No. 54 in Table 1)

82.9 g (0.227 mol) of the hydroxy group substituted triarylamine compound having the formula B prepared in (1) were dissolved in 400 ml of tetrahydrofuran to prepare a mixture, and an aqueous solution of sodium hydrate formed of 12.4 g of NaOH and 100 mil of water was dropped therein in a nitrogen stream. The mixture was cooled to have a temperature of 5° C., and 25.2 g (0.272 mol) of chloride acrylate was dropped therein for 40 min. Then, the mixture was stirred at 5° C. for 3 hrs. The mixture was put in water and extracted with toluene. The extracted liquid was repeatedly washed with water and an aqueous solution of sodium carbonate. Then, a solvent removed therefrom and refined by a column chromatographic process using silica gel as an absorption medium and toluene as a developing solvent. N-hexane was added to the thus prepared colorless oil to separate a crystal out. Thus, 80.73 g (yield of 84.8%) of a white crystal of the compound No. 54 having a melting point of from 117.5 to 119.0° C. was prepared.

Elemental Analysis Value (%)

| | C | H | N |
|---|---|---|---|
| Found value | 83.13 | 6.01 | 3.16 |
| Calculated value | 83.02 | 6.00 | 3.33 |

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, a specific example of synthesizing a titanylphthalocyanine pigment for used in the Examples will be explained.

Synthesis Example 1

292 g of 1,3-diiminoisoindoline and 2,000 ml of sulfolane were mixed, and 204 g of titaniumtetrabutoxide were dropped into the mixture under a nitrogen gas stream. The mixture was gradually heated until the mixture had a temperature of 180° C. and stirred for 5 hrs while the reaction temperature was maintained from 170 to 180° C. After the mixture was cooled, a precipitated material (powder) was filtered and washed with chloroform until the powder became blue. Next, the powder was washed with methanol for several times, and further washed with hot water having a temperature of 80° C. for several times to prepare a crude titanylphthalocyanine pigment. The crude titanylphthalocyanine pigment was mixed in a concentrated sulfonic acid in an amount of 20 times as much as the crude titanylphthalocyanine pigment and stirred therein to dissolve the pigment therein, and the mixture was dropped in iced water in an amount of 100 times as much as the mixture while stirred, and a precipitated crystal was filtered. Then, the crystal was repeatedly washed with water until the water after washed became neutral to prepare a wet cake of a titanylphthalocyanine pigment. The wet cake was thoroughly washed with ion-exchanged water until xx ion was not detected from the ion-exchanged water after washed.

20 g of the wet cake was placed in 200 g of 1,2-dichloroethane and the mixture was stirred for 4 hrs. After 1,000 g of methanol was placed in the mixture and the mixture was stirred for 1 hr, the mixture was filtered and dried to prepare a titanylphthalocyanine pigment powder.

X-ray diffraction spectrum of the titanylphthalocyanine powder was measured by the following conditions to find that the titanylphthalocyanine powder at least has main peaks of Bragg (2θ) at 9.6±0.2°, 24.0±0.2° and 27.2±0.2° in the X-ray diffraction spectrum when irradiated with Cu—Kα ray.

X-ray tube: Cu

Voltage: 40 kV

Current: 20 mA

Scanning speed: 1°/min

Scanning range: 3 to 40°

Time constant: 2 sec

The result is shown in FIG. 4.

Example 1

An undercoat coating liquid having the following formulation was coated on an aluminium cylinder having an outer diameter of 30 mm by a dip coating method, and dried to form an undercoat layer of 3.5 μm thick thereon.

| Undercoat layer coating liquid | |
|---|---|
| Alkyd resin (BEKKOZOL 1307-60-EL from Dainippon Ink & Chemicals, Inc.) | 6 |
| Melamine resin (SUPER BEKKAMIN G-821-60 from Dainippon Ink & Chemicals, Inc.) | 4 |
| Titanium dioxide powder (CR-EL from ISHIHARA SANGYO KAISHA, LTD.) | 40 |
| Methyl ethyl ketone | 50 |

A charge generation layer coating liquid having the following formulation including a bisazo pigment was coated on the undercoat layer by a dip coating method, and dried to form a CGL of 0.2 μm thick thereon.

| CGL coating liquid | |
|---|---|
| Titanylphthalocyanine pigment prepared in Synthesis Example 1 | 2.5 |
| Polyvinylbutyral (BX-1 from Sekisui Chemical Co., Ltd.) | 0.5 |
| Cyclohexanone | 200 |
| Methyl ethyl ketone | 80 |

A charge transport layer coating liquid having the following formulation was coated on the CGL by a dip coating method, and dried to form a CTL of 23 μm thick thereon.

| CTL coating liquid | |
|---|---|
| Bisphenol Z-type Polycarbonate | 10 |
| Lo-molecular-weight charge transport material having the following formula: | 10 |

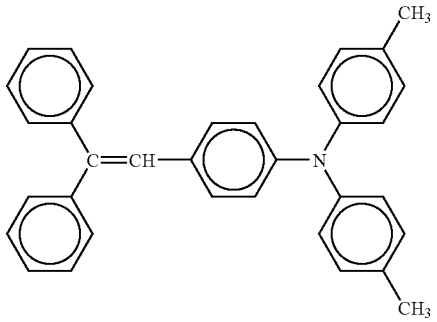

| | |
|---|---|
| Tetrahydrofuran | 80 |
| Tetrahydrofuran solution including silicone oil by 1% (KF50 from Shin-Etsu Chemical Industry Co., Ltd.) | 0.2 |

The CTL was further coated with a crosslinked surface layer coating liquid having the following formulation by a spray coating method.

| Crosslinked surface layer coating liquid | |
|---|---|
| Radical polymerizing monomer having three or more functional groups and no charge transportable structure (KAYARAD TMPTA from NIPPON KAYAKU CO., LTD.) | 8 |
| Radical polymerizing monomer having three or more functional groups and no charge transportable structure (KAYARAD DPCA from NIPPON KAYAKU CO., LTD.) | 2 |
| Monofunctional radical polymerizing compound having a charge transportable structure (Compound No. 54) | 10 |
| Photo polymerization initiator (1-hydroxy-cyclohexyl-phenyl-ketone IRGACURE 184 from CIBA SPECIALTY CHEMICALS) | 1 |
| Tetrahydrofuran (having a boiling point of from 64 to 65° C.) | 80 |

The coated layer was irradiated with a metal halide lamp at an irradiation intensity of 450 mW/cm$^2$ for 120 sec, and further dried at 130° C. for 30 min to form a crosslinked surface layer having a thickness of 5.0 μm. When irradiated, cold wind was blown inside the photoreceptor drum such that the surface maximum temperature thereof was not over 60° C. Thus, an electrophotographic photoreceptor of the present invention was prepared.

Example 2

The procedure for preparation of the electrophotographic photoreceptor in Example 1 was repeated to prepare an electrophotographic photoreceptor except that the surface maximum temperature thereof was 40° C. when irradiated.

Comparative Example 1

The procedure for preparation of the electrophotographic photoreceptor in Example 1 was repeated to prepare an electrophotographic photoreceptor except that the surface maximum temperature thereof was 100° C. when irradiated.

Example 3

The procedure for preparation of the electrophotographic photoreceptor in Example 1 was repeated to prepare an electrophotographic photoreceptor except for replacing Compound No. 54 with Compound No. 182 in the crosslinked surface layer coating liquid. The crosslinked surface layer had a thickness of 4.8 μm.

Example 4

The procedure for preparation of the electrophotographic photoreceptor in Example 1 was repeated to prepare an electrophotographic photoreceptor except for replacing Compound No. 54 with Compound No. 109 in the crosslinked surface layer coating liquid. The crosslinked surface layer had a thickness of 4.4 μm.

Comparative Example 2

The procedure for preparation of the electrophotographic photoreceptor in Example 2 was repeated to prepare an electrophotographic photoreceptor except that the surface maximum temperature thereof was 100° C. when irradiated.

Comparative Example 3

The procedure for preparation of the electrophotographic photoreceptor in Example 3 was repeated to prepare an electrophotographic photoreceptor except that the surface maximum temperature thereof was 100° C. when irradiated.

Comparative Example 4

The procedure for preparation of the electrophotographic photoreceptor in Example 4 was repeated to prepare an electrophotographic photoreceptor except that the surface maximum temperature thereof was 100° C. when irradiated.

Comparative Example 5

The procedure for preparation of the electrophotographic photoreceptor in Example 4 was repeated to prepare an electrophotographic photoreceptor except that the surface maximum temperature thereof was 90° C. when irradiated.

Comparative Example 6

The procedure for preparation of the electrophotographic photoreceptor in Example 4 was repeated to prepare an electrophotographic photoreceptor except that the surface maximum temperature thereof was 70° C. when irradiated.

Comparative Example 7

The procedure for preparation of the electrophotographic photoreceptor in Example 1 was repeated to prepare an electrophotographic photoreceptor except for not forming the crosslinked surface layer.

Each of the photoreceptors was installed in a modified imagio Neo 270 using a laser diode as an imagewise light source emitting light having a wavelength of 655 nm. 200,000 images were produced thereby using A4-type My Paper from NBS RICOH CO., Ltd. Each of the photoreceptors had an initial charged potential of −700V. The abrasion resistance, potential, cleaning blade behavior and image quality thereof were evaluated, and the results are shown in Tables 3, 4 and 5.

TABLE 3

| | Abraded amount (μm) | |
|---|---|---|
| | 50,000 images | 100,000 images |
| Example 1 | 0.73 | 1.32 |
| Example 2 | 0.66 | 1.28 |
| Example 3 | 0.64 | 1.19 |
| Example 4 | 0.62 | 1.14 |
| Comparative Example 1 | 2.45 | 4.88 |
| Comparative Example 2 | 2.31 | 4.55 |
| Comparative Example 3 | 2.21 | 3.96 |
| Comparative Example 4 | 2.08 | 3.81 |
| Comparative Example 5 | 1.64 | 2.62 |
| Comparative Example 6 | 1.01 | 2.08 |
| Comparative Example 7 | 5.34 | — |

In Comparative Example 7, the abraded amount was too large to continue producing images.

TABLE 4

| | Potential (-V) | | | | | |
|---|---|---|---|---|---|---|
| | Initial | | 50,000 | | 100,000 | |
| | Dark space | Light space | Dark space | Light space | Dark space | Light space |
| Example 1 | 700 | 130 | 690 | 140 | 695 | 150 |
| Example 2 | 700 | 135 | 700 | 150 | 700 | 155 |
| Example 3 | 700 | 165 | 705 | 175 | 695 | 175 |
| Example 4 | 700 | 140 | 695 | 160 | 705 | 165 |
| Comparative Example 1 | 700 | 195 | 700 | 220 | 700 | 230 |
| Comparative Example 2 | 700 | 200 | 700 | 225 | 705 | 225 |
| Comparative Example 3 | 700 | 195 | 705 | 215 | 700 | 225 |
| Comparative Example 4 | 700 | 205 | 700 | 220 | 705 | 230 |
| Comparative Example 5 | 700 | 195 | 705 | 205 | 710 | 225 |
| Comparative Example 6 | 700 | 190 | 700 | 195 | 705 | 210 |
| Comparative Example 7 | 700 | 125 | 710 | 135 | — | — |

TABLE 5

| | Image quality | | |
|---|---|---|---|
| | Initial | 50,000 | 100,000 |
| Example 1 | ○ | ○ | ○ |
| Example 2 | ○ | ○ | ○ |
| Example 3 | ○ | ○ | Δ |
| Example 4 | ○ | ○ | ○ |
| Comparative Example 1 | Δ | X | X |
| Comparative Example 2 | Δ | X | X |
| Comparative Example 3 | Δ | Δ | X |
| Comparative Example 4 | Δ | X | X |
| Comparative Example 5 | ○ | ○ | Δ |
| Comparative Example 6 | ○ | ○ | Δ |
| Comparative Example 7 | ○ | Δ | — |

○: No stripe image
Δ: Stripe image is locally produced
X: stripe image is evenly produced This application claims priority and contains subject matter related to Japanese Patent Application No. 2004-336341 filed on Nov. 19, 2004, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor, comprising:

an electroconductive substrate; and a photosensitive layer overlying the electroconductive substrate and comprising a crosslinked layer at a surface thereof, wherein the crosslinked layer is formed by a method comprising:

coating a coating liquid comprising:

a solvent;

a radical polymerizing monomer having three or more functional groups and no charge transportable structure; and a radical polymerizing compound having a charge transportable structure on the photosensitive layer; and irradiating the coating liquid to harden it while the surface of the photosensitive layer is controlled to have a temperature not higher than a boiling point of the solvent.

2. The electrophotographic photoreceptor of claim 1, wherein the radical polymerizing compound having a charge transportable structure is monofunctional.

3. The electrophotographic photoreceptor of claim 1, wherein the radical polymerizing monomer having three or more functional groups comprises at least one member selected from the group consisting of acryloyloxy groups and methacryloyloxy groups.

4. The electrophotographic photoreceptor of claim 1, wherein the radical polymerizing compound having a charge transportable structure further comprises a functional group, and wherein the functional group is at least one member selected from the group consisting of acryloyloxy groups and methacryloyloxy groups.

5. The electrophotographic photoreceptor of claim 1, wherein the charge transportable structure of the radical polymerizing compound is a triarylamine structure.

6. The electrophotographic photoreceptor of claim 1, wherein the radical polymerizing compound is at least one member selected from the group consisting of compounds having the following formulae (1), (2) and (3):

(1)

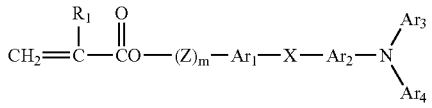

(2)

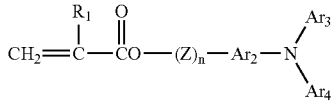

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n independently represent 0 or an integer of from 1 to 3;

(3)

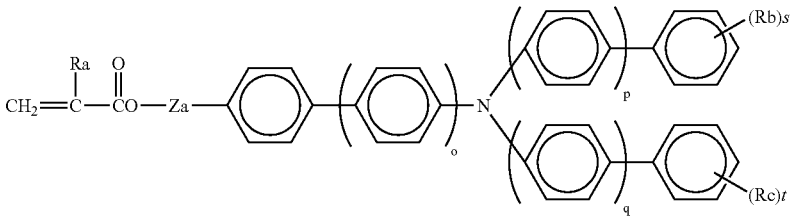

wherein o, p and q independently represent 0 or 1; Ra represents a hydrogen atom or a methyl group; Rb and Rc represents a substituent other than a hydrogen atom and an alkyl group having 1 to 6 carbon atoms, and may be different from each other; s and t represent 0 or an integer of from 1 to 3; Za represents a single bond, a methylene group, ethylene group,

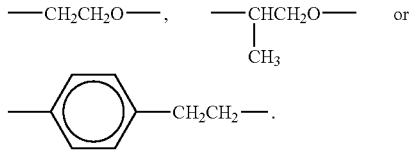

7. The electrophotographic photoreceptor of claim 1, wherein the photosensitive layer comprises titanylphthalocyanine.

8. The electrophotographic photoreceptor of claim 7, wherein the titanylphthalocyanine comprises a crystal form having a Cu—Kα X-ray diffraction spectrum comprising plural diffraction peaks, and wherein main peaks are observed at a Bragg (2θ) angle of 9.6°, 24.0° and 27.2°, and wherein said angles may vary by ±0.2°.

9. The electrophotographic photoreceptor of claim 1, wherein the photosensitive layer is a multilayer comprising:

a charge generation layer;

a charge transport layer; and a surface layer, and wherein the surface layer is the crosslinked layer.

10. An image forming method, comprising:

charging the electrophotographic photoreceptor according to claim 1;

irradiating the electrophotographic photoreceptor to form an electrostatic latent image thereon;

developing the electrostatic latent image with a toner to form a toner image thereon; and transferring the toner image onto a receiving material.

11. An electrophotographic image forming apparatus comprising:

the electrophotographic photoreceptor according to claim 1;

a charger configured to charge the electrophotographic photoreceptor;

an irradiator configured to irradiate the electrophotographic photoreceptor to form an electrostatic latent image thereon;

an image developer configured to develop the electrostatic latent image with a toner to form a toner image thereon; and a transferer configured to transfer the toner image onto a receiving material.

12. A process cartridge detachable from an image forming apparatus, comprising:

the electrophotographic photoreceptor according to claim 1; and at least one of a charger, an image developer, a transferer, a cleaner and a discharger.

13. A method of preparing an electrophotographic photoreceptor, comprising:

forming a photosensitive layer on an electroconductive substrate; and forming a crosslinked layer at the surface of the photosensitive layer by a method comprising:

coating a coating liquid comprising:

a solvent;

a radical polymerizing monomer having three or more functional groups and no charge transportable structure; and a radical polymerizing compound having a charge transportable structure on the photosensitive layer; and irradiating the coating liquid to harden it while the surface of the photosensitive layer is controlled to have a temperature not higher than a boiling point of the solvent.

14. The method of preparing an electrophotographic photoreceptor of claim 13, wherein the radical polymerizing compound having a charge transportable structure is monofunctional.

15. The method of preparing an electrophotographic photoreceptor of claim 13, wherein the a radical polymerizing monomer having three or more functional groups comprises at least one member selected from the group consisting of acryloyloxy groups and methacryloyloxy groups.

16. The method of preparing an electrophotographic photoreceptor of claim 13, wherein the radical polymerizing compound having a charge transportable structure further comprises a functional group, and wherein the functional group is at least one member selected from the group consisting of acryloyloxy groups and methacryloyloxy groups.

17. The method of preparing an electrophotographic photoreceptor of claim 13, wherein the charge transportable structure of the radical polymerizing compound is a triarylamine structure.

18. The method of preparing an electrophotographic photoreceptor of claim 13, wherein the radical polymerizing compound is at least one member selected from the group consisting of compounds having the following formulae (1), (2) and (3):

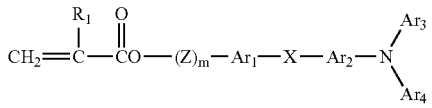

(1)

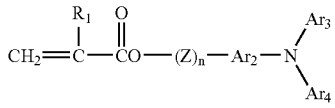

(2)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n independently represent 0 or an integer of from 1 to 3;

(3)

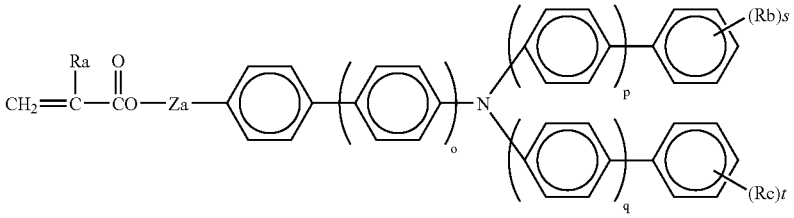

wherein o, p and q independently represent 0 or 1; Ra represents a hydrogen atom or a methyl group; Rb and Rc represents a substituent besides a hydrogen atom and an alkyl group having 1 to 6 carbon atoms, and may be different from each other when having plural carbon atoms; s and t represent 0 or an integer of from 1 to 3; Za represents a single bond, a methylene group, ethylene group,

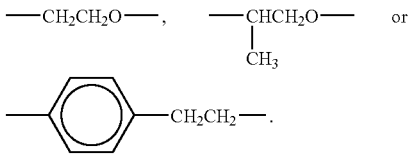

* * * * *